US006192895B1

(12) United States Patent
Yuhara et al.

(10) Patent No.: US 6,192,895 B1
(45) Date of Patent: Feb. 27, 2001

(54) COSMETIC CASE

(75) Inventors: Yukitomo Yuhara, Abiko; Kiyokazu Miyokawa, Narashino; Michiaki Kumagai, Tokyo; Takashi Sugiyama, Higashimurayama, all of (JP)

(73) Assignee: Yoshida Industry Co. Ltd., Tokyo (JP)

( * ) Notice: Subject to any disclaimer, the term of this patent is extended or adjusted under 35 U.S.C. 154(b) by 0 days.

(21) Appl. No.: 09/107,178

(22) Filed: Jun. 29, 1998

(30) Foreign Application Priority Data

| | | |
|---|---|---|
| Aug. 8, 1997 | (JP) | 9-214523 |
| Aug. 13, 1997 | (JP) | 9-218452 |
| Aug. 22, 1997 | (JP) | 9-226688 |
| Jan. 27, 1998 | (JP) | 10-014386 |

(51) Int. Cl.[7] ..... A45D 33/26

(52) U.S. Cl. ..... 132/294; 206/205; 220/524; 220/526; 132/300; 132/303; 132/314

(58) Field of Search ..... 132/293, 294, 132/295, 300, 303, 314, 315; 206/823, 581, 205; 220/524, 526, 324

(56) References Cited

U.S. PATENT DOCUMENTS

| | | | | |
|---|---|---|---|---|
| 1,626,613 | * | 5/1927 | Kendall | 132/303 |
| 2,054,004 | * | 9/1936 | Sandberg | 132/293 |
| 2,078,096 | * | 4/1937 | Parkin | 132/294 |
| 2,137,886 | * | 11/1938 | Zell | 132/300 |
| 2,399,997 | * | 5/1946 | Flaster | 132/300 |
| 5,353,818 | * | 10/1994 | Suzuki et al. | 132/294 |
| 5,875,795 | * | 3/1999 | Bouix | 132/293 |
| 5,908,037 | * | 6/1999 | Peirson | 132/293 |

FOREIGN PATENT DOCUMENTS

| | | | | |
|---|---|---|---|---|
| 0804382 | * | 10/1936 | (FR) | 132/303 |
| 7-184717 | * | 7/1995 | (JP) | 132/303 |

* cited by examiner

*Primary Examiner*—Gene Mancene
*Assistant Examiner*—Eduardo C. Robert
(74) *Attorney, Agent, or Firm*—Morrison & Foerster LLP

(57) ABSTRACT

A cosmetic case containing a replaceable inner case which can be easily removed or inserted, and which is specifically structured to maintain the cosmetic material contained therein in a fresh and usable condition.

The invention is comprised of an outer case with a floor area and inner peripheral wall defining a space for an inner container, an outer cover attached by a hinge to the outer case, a main latch employed to hold the outer cover closed, a replaceable inner container providing a cosmetic holding space, an inner container cover capable of opening or closing over the cosmetic holding space, and a sub-latch employed to hold the inner cover closed against the inner container.

The inner case is equipped with a hinge part to allow opening and closing of the inner cover, said hinge part fitting into a cutout section on the peripheral wall of the outer case so as to expose the hinge and thus allow wide angle opening of the inner case cover. Inner case installation is aided by small protruding ribs formed within the outer case with the purpose of indexing and securing the inner case. An orifice is provided in the floor of the main case to allow the inner case to be pushed up and removed by finger pressure applied from below.

The cosmetic case is characterized by a push-type latch mechanism which opens the outer and inner case covers simultaneously in one movement, an effective sealing mechanism between the inner case and cover, and specific inner cover structures to inhibit the fall of condensation droplets onto the cosmetic surface.

16 Claims, 53 Drawing Sheets

COSMETIC CASE

BACKGROUND OF THE INVENTION

1. Field of the Invention

The invention relates to a cosmetic case assembly of the type in which a sub-case can be easily installed to or detached from a main case, and in which each of the aforesaid cases is equipped with a cover which can be easily opened and closed as a means of allowing convenient access to the cosmetic material contained therein, and as further means of preserving the contained cosmetic material in a desirable and usable condition.

2. Description of the Related Art

Cosmetic cases are generally employed as convenient portable containers for carrying personal-use cosmetic substances. These cases consist of a container body in which a cosmetic substance is held, and an openable cover installed to the case as means of allowing access to the cosmetic material as well as means of sealing the internal case area when the cosmetic material contained therein is not being used. A latch mechanism is employed to keep the cover closed, and can be activated to open the cover when desired.

Recently, cosmetic cases are appearing in which an outer case, appropriately decorated to provide a pleasing external appearance, is structured so as to contain a separate refill case which is employed to hold the cosmetic material. The outer case is often made from expensive materials, designed to provide a beautiful and elegant appearance, and decorated in a pleasing fashion. The refill case contained therein, however, is specifically designed to be functional in regard to holding, preserving, and allowing access to the cosmetic material contained therein, and to be easily detached from and installed within the aforesaid outer case. The aforesaid outer case and refill case are often sold as separate items, thus allowing the purchaser to use the same cosmetic case to carry various types of cosmetics as dictated by personal preference, and to conveniently replace consumed cosmetics, in the form of these refill cases, without the need to buy a new outer cosmetic case.

The aforesaid refill cases, particularly when used together with relatively expensive outer cases, are often constructed similarly to conventional cosmetic cases in that a hinged cover is also installed to the refill case. The use of a hinged cover refill case, however, demands that the user open the outer case cover and refill case cover in multiple sequential operations that are, in many cases, clumsy and inconvenient.

Moreover, a cosmetic case offering the installation and removal of separate refill cases can be significantly improved through a structure which makes it easier and more convenient to both install and remove said refill cases. Furthermore, a preferable structure for this type of cosmetic case would also include a mechanism which eliminates the need to open the outer case and refill case covers as separate sequential operations.

Considering the design of the cosmetic case from a different point of view, it must also be taken into account that many recently developed cosmetic materials utilize water or oil components as solvents which are susceptible to evaporation. These types of cosmetics are becoming increasingly prevalent.

As solvent-based cosmetics are subject to relatively rapid evaporation, the cosmetic cases used to hold them must offer means of preventing evaporation by efficiently sealing the internal area of the case.

Even if a cosmetic case provides an efficient sealing effect for the substance contained therein, the condensation of solvents contained within the sealed cosmetic material can result in condensate droplets collecting on the surface of the cosmetic material and degrading the quality of said material.

The following inventions have been proposed as means of alleviating the problems mentioned above. Japanese patent unexamined publication No.9-37839 proposes various means of improving the sealing efficiency between a cosmetic case with an open and closable cover. Japanese unexamined patent publications Nos.8-347 and 9-37838 propose the installation of an inner cover between the cosmetic case and outer cover, said inner cover being utilized to seal the cosmetic case. In regard to a cosmetic case of the type which can contain a detachable refill case, Japanese unexamined patent publications Nos.9-65920 and 9-98829 propose a cosmetic case with detachable refill case whereby the refill case is specifically structured to hold a cosmetic material containing an evaporable solvent.

Refill cases have been proposed whereby a freely open and closable inner cover is installed to an inner tray. The areas between said inner tray and inner cover can be sealed, thus allowing the inner tray and cover to be employed as a refill case which is installable to and removable from an outer case. In regard to cosmetic cases applicable for use with evaporable solvent based cosmetic materials, Japanese unexamined patent publication No.9-47319 proposes a structure in which an inner tray only, without a cover, can be placed in or removed from an outer case. Japanese unexamined patent publications Nos.8-348 and 9-98828 propose a cosmetic case with a double cover whereby an internal cover is employed between a cosmetic case and external covers Moreover, Japanese unexamined patent publication No.7-184717 proposes a cosmetic case which provides a condensation prevention effect.

The aforesaid Japanese unexamined patent publication No.9-37839 proposes the use of an elastic packing ring installed to the lower perimeter of the cosmetic container within the outer case, and a protruding part on the inner surface of the cover. When the cover is closed, the aforesaid protruding, part is in contact with the aforesaid packing ring at a point below the joint formed between the case and cover. The aforesaid Japanese unexamined patent publication No.8-347 provides for an elastic packing ring of U-shaped cross section installed on the upper perimeter of the aforesaid inner tray, and an elastic packing piece installed to the cover, thus forming a structure in which the aforesaid elastic packing ring and packing piece come into mutual contact when the cover is closed. The aforesaid Japanese unexamined patent publication No.9-37838, similar to the aforesaid Japanese unexamined patent publication No.9-37839, provides for an elastic packing ring on the lower outer periphery of the cosmetic container, and a ring-shaped protrusion on the inner surface of the inner cover, said ring-shaped protrusion coming into contact with the aforesaid elastic packing ring at a point below the joint between the inner cover and cosmetic container.

In regard to a refill type cosmetic case, the aforesaid Japanese unexamined patent publication No.9-65920 mentions an outer case divided into two compartments separated by a wall structure, one of the aforesaid compartments being employed to hold a refill case, and the other as a storage area for a cosmetic application tool. A protrusion on the cover of the refill case fits into a cutout portion provided in the center of the separator wall, said protrusion extending into the space provided for the aforesaid application tool. Similar to the aforesaid Japanese unexamined patent publication No.9-65920, the aforesaid Japanese unexamined patent publication No.9-98829) mentions a separator wall forming two internal compartments within the cosmetic case. A first joint part is formed between the separator wall and facing surface of the cosmetic case, and a second joint part, capable of detaching from the aforesaid first joint part, is formed on the refill case. The connection formed between the first joint part and second joint part secures the refill case in position.

The cosmetic case proposed by the aforesaid Japanese unexamined patent publication No.9-47319 incorporates a separator wall within the case, said wall forming two separate internal compartments, one of said compartments being occupied by the aforesaid inner tray. A joint groove is formed on the lateral periphery of the inner tray. A first joint protrusion, capable of insertion into the aforesaid joint groove, is formed on the inner tray side of the separator wall. Moreover, multiple pairs of fingers are formed as vertical slits at the lower side of the wall surface opposite to the separator wall. A second protrusion capable of inserting into the aforesaid joint groove is also provided. The wall surface between the fingers is formed as a support wall with a lower surface acting as a free surface. The protrusion formed on the support wall presses against inner tray in a direction facing the first joint protrusion.

In the cosmetic case proposed by the aforesaid Japanese unexamined patent publication No.8-348, an inner cover opening piece, installed either on the cosmetic case or inner cover, is utilized as means of forcibly opening the inner cover. Moreover, the cosmetic case mentioned in the aforesaid Japanese unexamined patent publication No.9-98828 employs a first release mechanism as means of releasing a first latch connecting the outer cover to the cosmetic case, and a second release mechanism as means of releasing a second latch connecting the inner cover to the cosmetic case, both of the aforesaid release mechanisms being drivable by single push piece. A single action of the push-piece results in the release of the joints maintained by the aforesaid first and second latches.

The aforesaid Japanese unexamined patent publication No.7-184717 proposes the installation of an absorbent material on the inner side of the cosmetic case cover as means of absorbing the condensate produced by an evaporating solvent within the cosmetic material.

The cosmetic case structures put forth by the aforesaid Japanese unexamined patent publications Nos.9-37839 and 9-37838 require elastic packing rings at the lower periphery of the cosmetic material container, thus necessitating the formation of a recessed channel at the outer periphery of the joint area. As significant space is required for these channels, a cosmetic case made to specific external dimensions would have a smaller opening space than would be otherwise possible, thus decreasing the amount of cosmetic material that could be held in the case. As the aforesaid Japanese unexamined patent publication No.8-347 calls for a separate inner tray and cover to which separate elastic packing pieces must be installed, the number of components comprising the cosmetic case increases, the structure becomes more complicated, and the assembly operation for the cosmetic case becomes more expensive and time consuming. Moreover, the cosmetic case is relatively inconvenient to use as the outer and inner covers require separate operations to open and close.

As the aforesaid Japanese unexamined patent publication No.9-98829 requires a first joint at the separator and case wall, and a second joint at the inner tray, a relatively complex structure is required which correspondingly makes the fabrication of tooling, which is required to manufacture the case, more complex and expensive.

Furthermore, while the aforesaid Japanese unexamined patent publication No.8-348 proposes a push-type mechanism which provides a more convenient opening operation for the inner cover, the inner and outer covers must still be opened by separate operations. Resultantly, there is no significantly improvement in the ease with which the covers can be opened. As the aforesaid Japanese unexamined patent publication No.7-184717 employs a sliding push-piece, space must be provided for the sliding action, a design requirement which reduces the amount of cosmetic material the case can hold in regard to specific external dimensions.

SUMMARY OF THE INVENTION

Firstly, the invention proposes a cosmetic case in which the installation and removal of a refill case is a fast and simple operation, and in which the installation of a refill case cover (hereafter referred to as the inner cover) and outer case cover pose no restriction to convenient access to the cosmetic material contained in the inner case.

Secondly, the invention proposes a cosmetic case whereby both an inner and outer cover can be opened with a single operation when a refill case is installed within the outer case.

Thirdly, the invention proposes a cosmetic case able to effectively prevent the evaporation of solvents within the cosmetic material contained therein through the employment of a specific sealed structure.

Fourthly, the invention proposes a cosmetic case structured in a manner as to prevent the condensate from evaporated solvents within the cosmetic material from collecting on the surface of said material.

To achieve these ends, the cosmetic case invention is comprised of

- an outer case defining an inner compartment space;
- an open and closable outer cover installed to said outer case in a manner as to seal off or allow open access to the aforesaid inner space;
- a main latch installed between the aforesaid outer case and outer cover as a means of connecting said outer case and outer cover,
- a refill case comprised of a cosmetic container and inner cover, said inner cover being open and closable in a manner as to seal the aforesaid cosmetic container or allow access to the cosmetic material contained therein, the aforesaid refill case being further equipped with a sub-latch capable of joining or releasing the aforesaid cosmetic container and cover, the aforesaid refill case being further installable to or detachable from the aforesaid outer case,
- and an operating mechanism installed to the aforesaid outer case or outer cover, said operating mechanism providing a one movement operation capable of simultaneously releasing the closed joints maintained by the aforesaid main latch and refill latch mechanism.

When the outer and inner covers are in a closed condition, activation of the operating mechanism will result in the main latch and sub-latch releasing simultaneously in a single action.

The aforesaid operating mechanism incorporates a push-piece pivotably installed to the outer case or outer cover, said push-piece functioning as the power input component of the operating mechanism. One part of the push-piece operates a first release mechanism to release the aforesaid main latch release mechanism, and another part of the push-piece operates a second release mechanism to release the aforesaid sub-latch.

When the outer and inner covers are in a closed condition, pressure applied to the push-piece will result in a swinging action which mechanically releases the main latch of the first release mechanism and the refill latch of the second release mechanism, thus allowing both the outer cover and inner cover to be opened from a single pivoting action of the push-piece.

Furthermore, as the push piece moves with a pivoting action, minimal space is required for its installation in comparison to a slide action piece, thus allowing the cosmetic case to be made to more compact dimensions.

As the first release mechanism is installed between the outer case and outer cover, the push-piece releases the main latch joint by applying an opposing force between the outer case and outer cover, and as the second release mechanism is installed between the aforesaid outer case and inner cover, the push-piece is also able to release the refill case latch through the application of the same type of opposing force.

The operating mechanism consists of a single push-piece which can be freely installed to the outer case or outer cover as a means of applying an operating movement to release the main latch, and an intermediate piece positioned within the outer case. Said intermediate piece is displaced by the movement of the aforesaid push-piece so as to release the sub-latch on the refill case.

Use of the aforesaid intermediate piece allows the movement of the push-piece to be transferred to the sub-latch as a means of releasing the sub-latch simultaneously with release of the main latch. Such simultaneous release of the outer cover and inner cover through a single movement of the push-piece provides for a refill-type cosmetic case opening action which is simple, easy, and convenient.

Moreover, as the aforesaid intermediate piece can also be structured as integral with the outer case or inner cover, and as the push-piece is an independent component, they can be made of different materials, surface finished to desired colors, and designed to shapes that separately compliment the appearance of the cosmetic case. For example, the push-piece can be formed as an integral design element of the outer case in terms of color and shape, while the intermediate link can be likewise designed to match the interior appearance of the cosmetic case.

As the push-piece is oriented between the outer case and outer cover, it is able to release the main latch joint through an opposing force applied between the outer case and outer cover, and as the intermediate link is oriented between the outer case and refill cover, it is likewise able to release the refill latch through an opposing force applied between the outer case and refill latch.

The intermediate link is structured as an integral component of the outer case, and because it can be fabricated together with the outer case, the number components comprising the cosmetic case can reduced, manufacturing costs lowered, and the assembly process simplified. Furthermore, structural integration of the intermediate piece eliminates the chances of it loosening or separating from the case.

Moreover, the inner cover is attached to the cosmetic container by means of a hinge installed on the opposite side of the cosmetic container from the aforesaid sub-latch, thus allowing the inner cover to extend outward and away from the outer case when opened within the outer case.

A floor surface and perimeter wall are formed within the outer case, said perimeter wall circumscribing and defining said floor area to dimensions larger than the refill case. A cutout area is provided within the aforesaid perimeter wall to allow clearance for the aforesaid refill case hinge and inner cover when said cover is in a open condition and extending out from the outer case. A protruding rib is formed within the aforesaid inner space as means of indexing the position of the refill case when said case is installed within the outer case.

The aforesaid rib establishes the position of the refill case within the outer case, and provides for a secure and stable attachment of said refill case therein. Moreover, a cosmetic application device, such as a soft puff or other like implement, can be placed within the part of the outer case inner space not occupied by the refill case.

As a cutout section is provided within the outer case perimeter wall at the inner case hinge area, the refill cover is able to open widely, without interference with the aforesaid wall, to provide free and convenient access to the cosmetic material within the refill case.

An orifice is provided within the aforesaid floor surface as means of aiding in the removal of the refill case from the outer case. Applying upward pressure to the lower surface of the refill case with a finger, through the aforesaid orifice, allows easy and convenient removal of the refill case from the outer case. The aforesaid orifice is formed as an oblong hole within the area of the outer case floor covered by the installed refill case.

A sealing mechanism is provided at the periphery of the cosmetic container opening, as means of sealing the space enclosed therein. The aforesaid sealing mechanism is comprised of an elastic sealing ring peripherally installed at the opening to the cosmetic container, either to the cosmetic container or inner cover, and a ring-shaped sealing ridge formed on the opposing component, said sealing ridge being oriented so as to come into pressure contact with the aforesaid sealing ring when the inner cover is closed.

The inner or outer diameters of the aforesaid sealing ring and protruding sealing ridge are structured so as to provide sealing surfaces on which a mutually abrasive rubbing action occurs during the inner cover closing movement. Thus, the closing movement of the inner cover results in a highly effective seal being former between the inner cover and inner case. Specifically, as a mutually abrasive rubbing effect is created between the aforesaid sealing ring and sealing ridge, any residual cosmetic material adhering to the sealing ring or ridge is rubbed away and removed from the sealing surfaces, thus creating a clean and tight seal.

To aid in this sealing effect, at least one inclined abrasion surface is formed either on the aforesaid sealing ring or sealing ridge. This inclined abrasion surface operates to steadily increase the abrasion pressure between the sealing ring and sealing ridge as the inner cover is closed, an effect which not only enhances the abrasive cleaning action, but also provides for a maximum sealing pressure between the sealing ring and ridge when the inner cover is fully closed.

Furthermore, the seal surface established between the aforesaid sealing ring and sealing ridge is arranged at a level above the level of the cosmetic material contained in the case.

Moreover, the aforesaid sealing ring is capable of elastic deformation in an inward or outwardly radial direction, thus allowing means to be established either on the inner case or inner case cover to purposely radially deform the sealing ring.

Furthermore, a joint groove is formed along the periphery of the aforesaid sealing ring, on either the inner case or inner cover, and a ring part is likewise installed on either the inner case or inner cover as means of securing the aforesaid sealing ring to the aforesaid joint groove.

Moreover, a seal protrusion part may be radially formed on either the upper or lower side of the aforesaid sealing ring as means of applying additional pressure to the sealing ring.

Furthermore, an elastic expanded part is formed into the outer periphery of the aforesaid sealing ring. The inner perimeter of the aforesaid ring-shaped ridge is formed to a smaller diameter than the aforesaid elastic expanded part of the sealing ring, and thus the ring-shaped ridge generates abrasive pressure against said elastic expanded part while the inner cover is closing. As the inner periphery of the sealing ridge provides an abrasive action and pressurized joint at the expanded part of the sealing ring, a highly effective seal is maintained for the internal area of the cosmetic container.

Moreover, when the ring-shaped sealing ridge applies abrasive pressure to the expanded part of the sealing ring as a result of the inner cover closing movement, any cosmetic material which may be adhering to the inner periphery of the sealing ridge is wiped away as a result of the abrasive cleaning effect, and thus a clean, tight, and efficient seal is propagated.

A compression ridge is formed on the component to which the aforesaid ring-shaped sealing ridge is formed, either the inner case or inner cover, as means of applying compression pressure to the upper or lower side of said sealing ring and thus further radially deforming the aforesaid expanded part in an outward direction.

When the inner cover is closed, the aforesaid compression ridge makes it possible to further pressurize the sealing ring while the aforesaid expanded part of the sealing ring is pressurized by the inner perimeter of the sealing ridge, and thus provides for a stronger and tighter seal.

The invention also provides a condensation droplet collection means whereby a specific inner cover structure is provided to collect and hold condensation droplets resulting from the condensation of evaporated solvents contained in the cosmetic material. The underside of the inner cover is specifically structured to serve as means of collecting and/or guiding the movement of the aforesaid droplets. The invention is therefore able to prevent said droplets from gathering on the surface of the cosmetic material and thus maintain the cosmetic material in a desirably usable condition.

A multiply grooved surface is formed on the underside of the inner cover, said grooved surface extending from the central part of said cover and sloping downward to the peripheral region, as means of collecting and guiding condensation droplets form the center area of the inner cover to the peripheral area. The droplets are prevented from falling onto the surface of the cosmetic material as a result of their flow toward the peripheral inner case area within the grooves on the aforesaid grooved surface.

The aforesaid grooved surface provides means for smoothly guiding the flow of condensation droplets to the peripheral area of the case. The grooved surface also provides a larger surface area compared to a flat surface, and thus also aids in inhibiting condensation of evaporated cosmetic solvents. The enlarged surface area of the grooved surface also provides for a larger adhesion area for droplets to collect on, and is thus able to hold more droplets and reduce the possibility of said droplets falling onto the cosmetic material surface.

The aforesaid grooved surface can be formed as a separate grooved surface inner plate attached to the underside of the inner cover.

The aforesaid condensation droplet collection means may also exist as a structure in which a condensation space is formed between the aforesaid inner plate and the underside of the inner cover, and in which orifices are provided to aid in the flow of air between the spaces below and above the aforesaid inner plate.

Moreover, the use of an inner plate installed to the underside of the inner cover has the effect of reducing the number of condensation droplets which can form directly over the cosmetic material. Furthermore, this construction eliminates the need to use an absorbent material on the underside of the inner cover, and thus improves the appearance of the inner case.

The aforesaid condensation droplet collection means can also be structured as multiple line grooves, said line grooves also providing means of preventing condensation droplets from collecting on the cosmetic material surface. The aforesaid line grooves also make the undersides of the inner case easier to clean, and thus allow a clean appearance of the inner case to be maintained with less effort.

The aforesaid multiple line grooves can be oriented in parallel and in the same direction as the aforesaid inner cover hinge as means of further preventing condensation droplets from falling when the inner cover is opened.

The condensation droplet collection means may further be structured as multiple hemispherical depressions and/or protrusions located on the underside of the inner cover, or on any gap forming surfaces within the inner cover. These hemispherical depressions and protrusions are particularly effective in holding condensation droplets. Furthermore, use of these hemispherical depressions and protrusions in specific sizes and patterns can add a pleasing decorative effect to the underside of the inner cover and add to the appeal of the cosmetic case.

DESCRIPTION OF PREFERRED EMBODIMENTS

The following discussion will explain the preferred embodiments of the cosmetic case invention.

Figure 1:
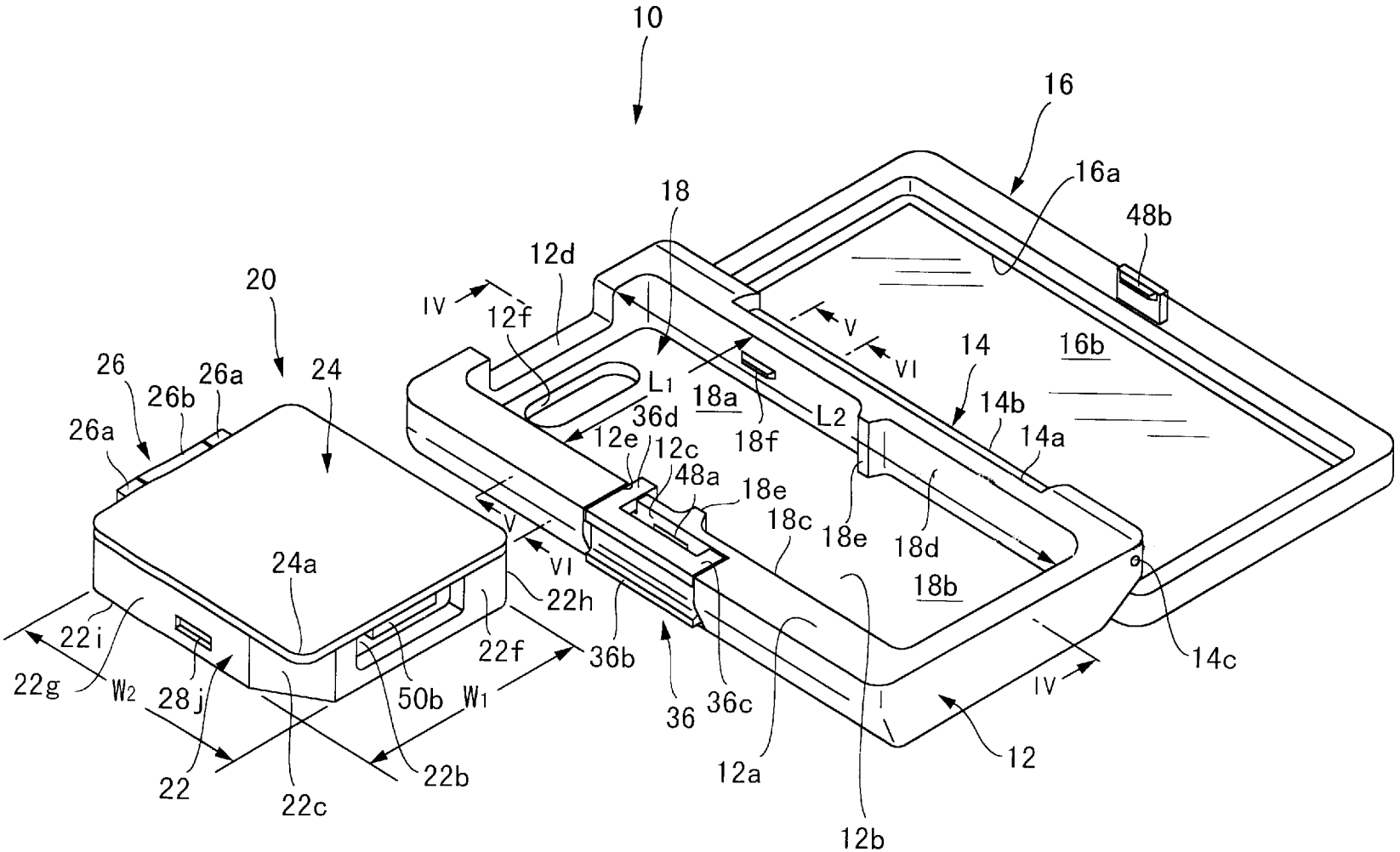
FIG. 1 is an oblique view of the first embodiment of the cosmetic case invention.
Figure 2:
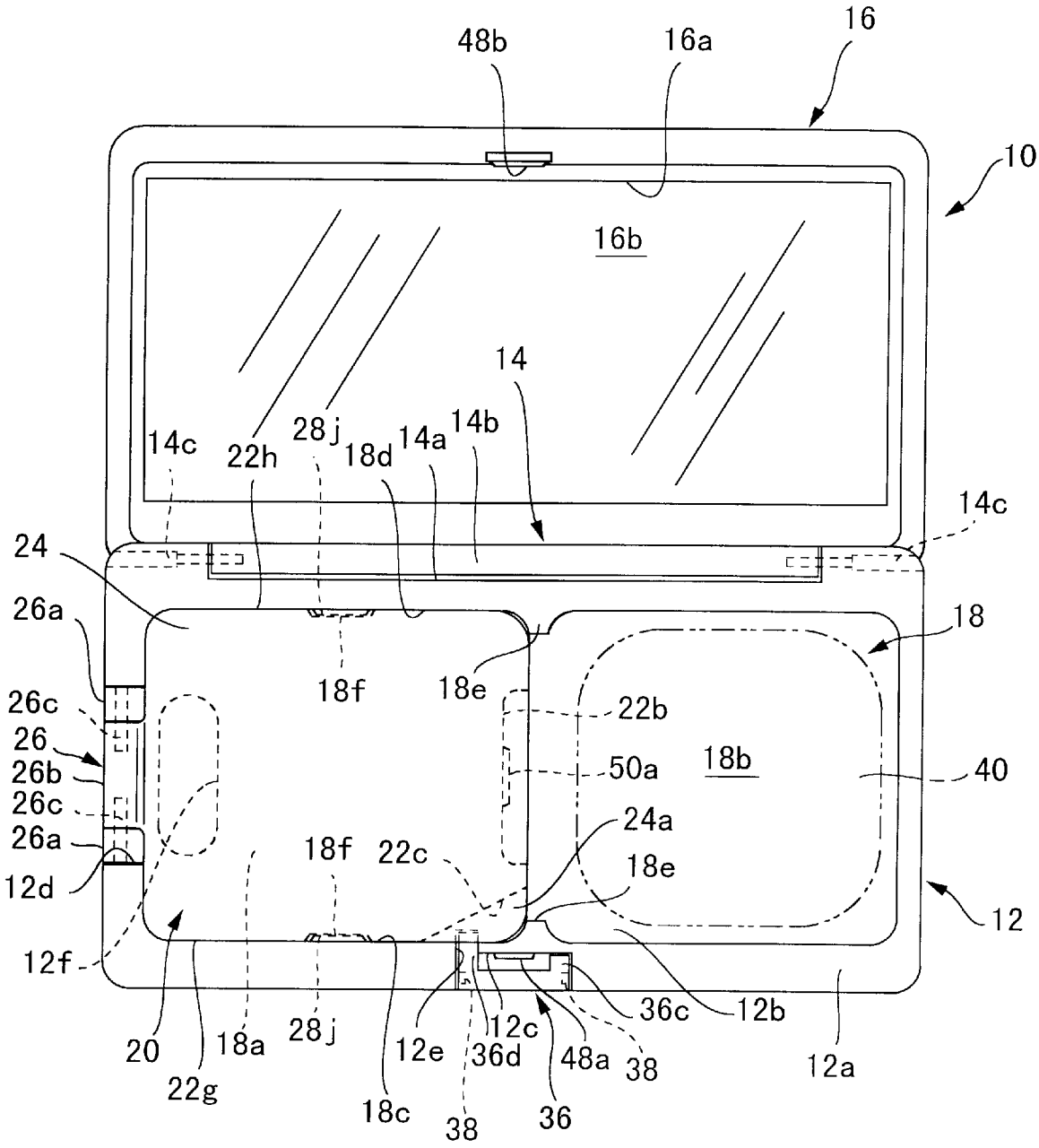
FIG. 2 is a plan view of the FIG. 1 embodiment with the outer cover open.

FIGS. 1 and 2 present a first embodiment of the invention. In this embodiment, cosmetic case 10 is comprised of outer case 12 to which outer cover 16 is installed by means of outer hinge 14. A compartment area is defined within outer case 12 by means of peripheral wall 12*a* and floor 12*b*, and rectangular compartment 18 is formed along the outer periphery of the aforesaid compartment area. First compartment 18*a* is formed on one side of space 18 and serves as the installation space for inner case 20. Outer hinge 14 is installed to outer case 12 at recessed space 14*a* which is formed in the center outer edge of outer case 12, protruding part 14*b* is formed as part of outer cover 16, and hinge pin 14*c* is inserted into outer hinge 14 in the area occupied by recessed space 14*a* and protruding part 14*b*. Second latch 48*b* is installed to the outer edge on the underside of outer cover 16, and first latch 48*a* is installed in a recessed section located in the center of the peripheral edge of outer case 12. Second latch 48*b* connects or disconnects to first latch 48*a* as a means of maintaining outer cover 16 in a closed condition or releasing said outer cover. Vanity mirror 16*b* is installed to a recessed area on the underside of outer cover 16.

Refill case 20 is employed as a container to hold the cosmetic material, and functions as what is commonly known as a cosmetic powder compact. Refill case 20 is comprised of cosmetic container 22*a* in which the cosmetic material is placed, inner case 22, and inner cover 24 which is employed to seal inner case 22. Inner cover 24 is pivotably installed to the left side of inner case 22 by means of hinge mechanism 26. Hinge mechanism 26 protrudes from the left side of inner case 22 between hinge support posts 26*a*, and is connected to inner case 22 by means of hinge pin 26*c* which is inserted in the aforesaid hinge support posts and the protruding part of inner cover 24. As hinge mechanism 26 is established on refill case 20 in this type of protruding condition, upward facing cutout section 12*d* is formed on peripheral wall 12*a* of first compartment 18*a* as means of allowing clearance for hinge part 26 when inner case 20 is installed to the cosmetic case.

Second latch 50*b* is peripherally installed to the opening side periphery of inner cover 24 and connects to or releases from first latch 50*a*, latch 50*a* being installed to inner case 22 in a manner as to be able to maintain inner cover 24 in a closed condition. First latch 50*a* is installed within recess 22*b* at the center of the right side of inner case 22. Second latch 50*b* resides in recess 22*b* when inner cover 24 is in a closed condition. Relatively large angular cutout section 22*c* forms a void at the right front corner of inner case 22, and right front corner 24*a* of inner cover 24 extends beyond cutout section 22C when inner cover 24 is in a closed condition.

Figure 4:
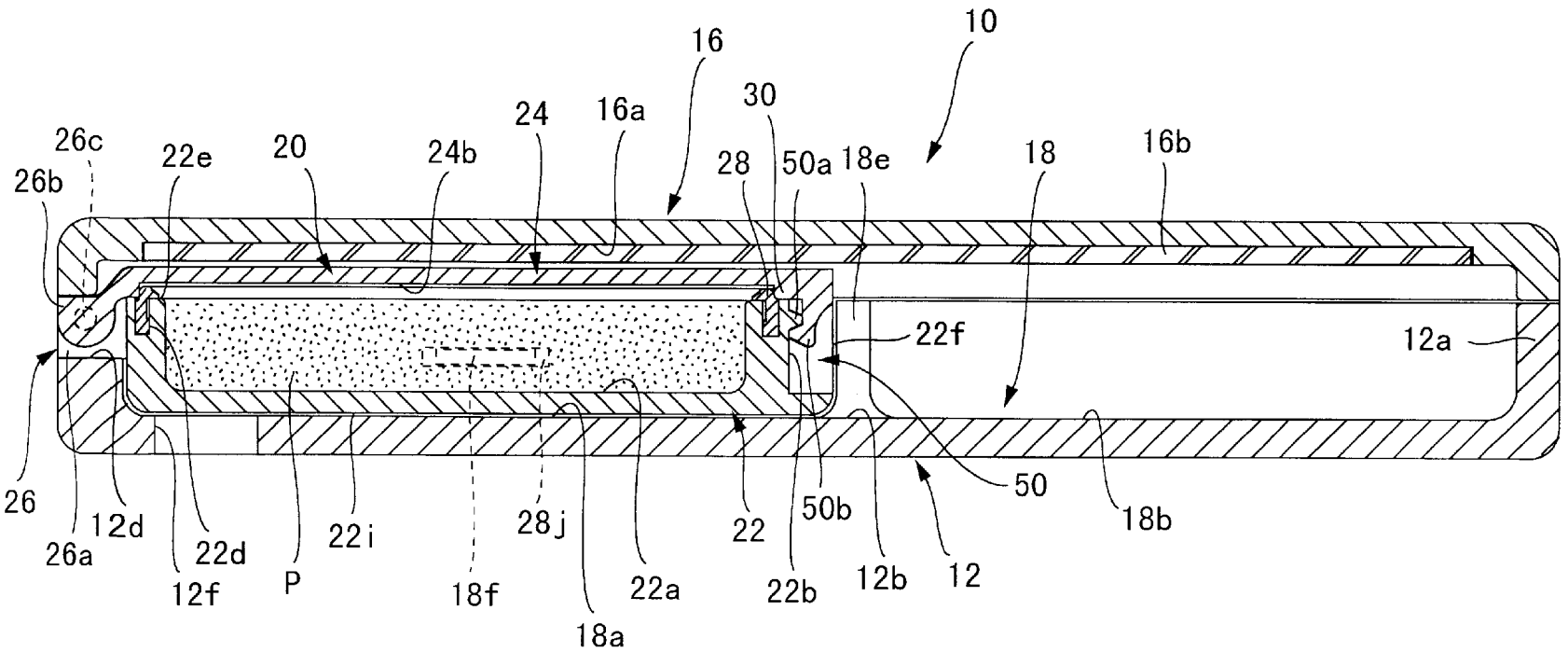
FIG. 4 is a cross section at line IV—IV of FIG. 1.
Figure 5:
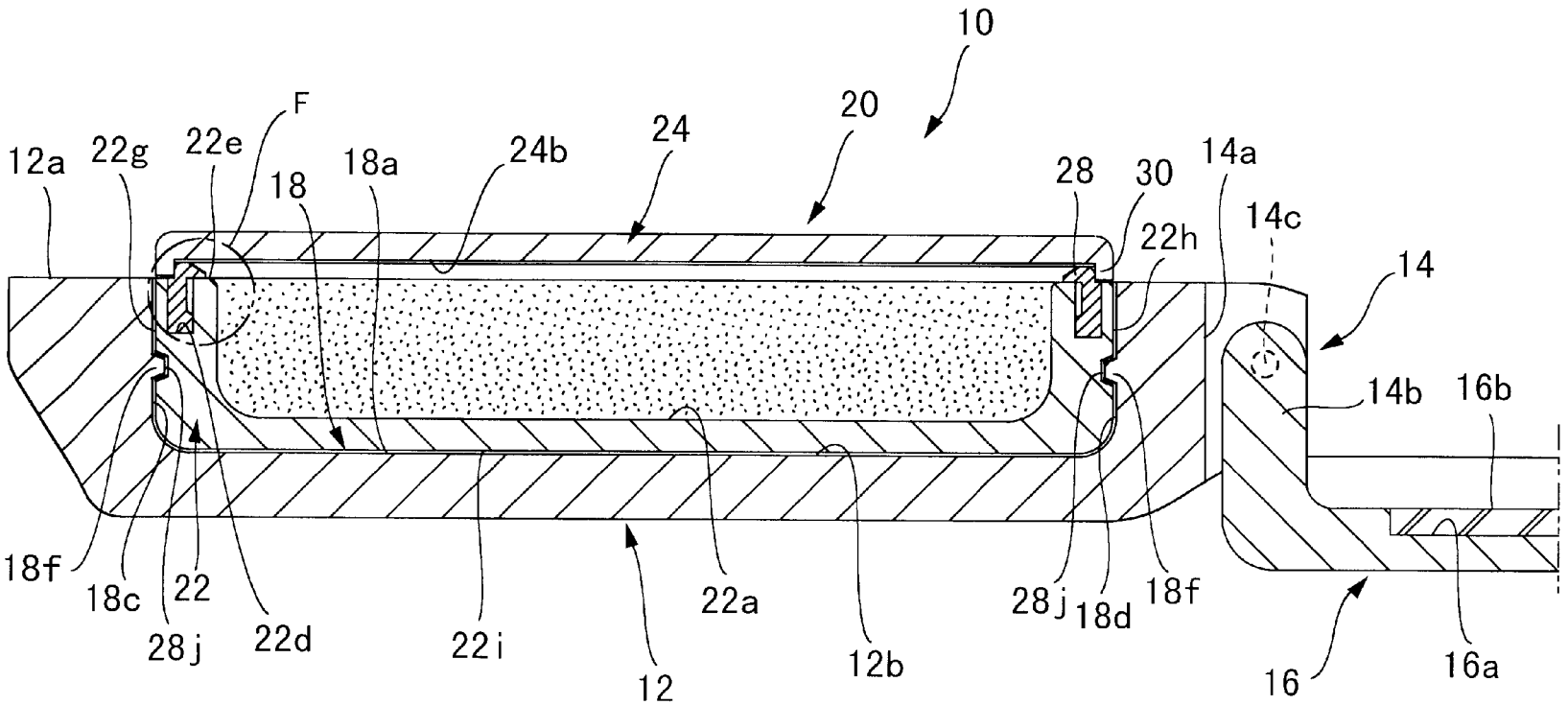
FIG. 5 is a cross section at line V—V of FIG. 1.
Figure 27:
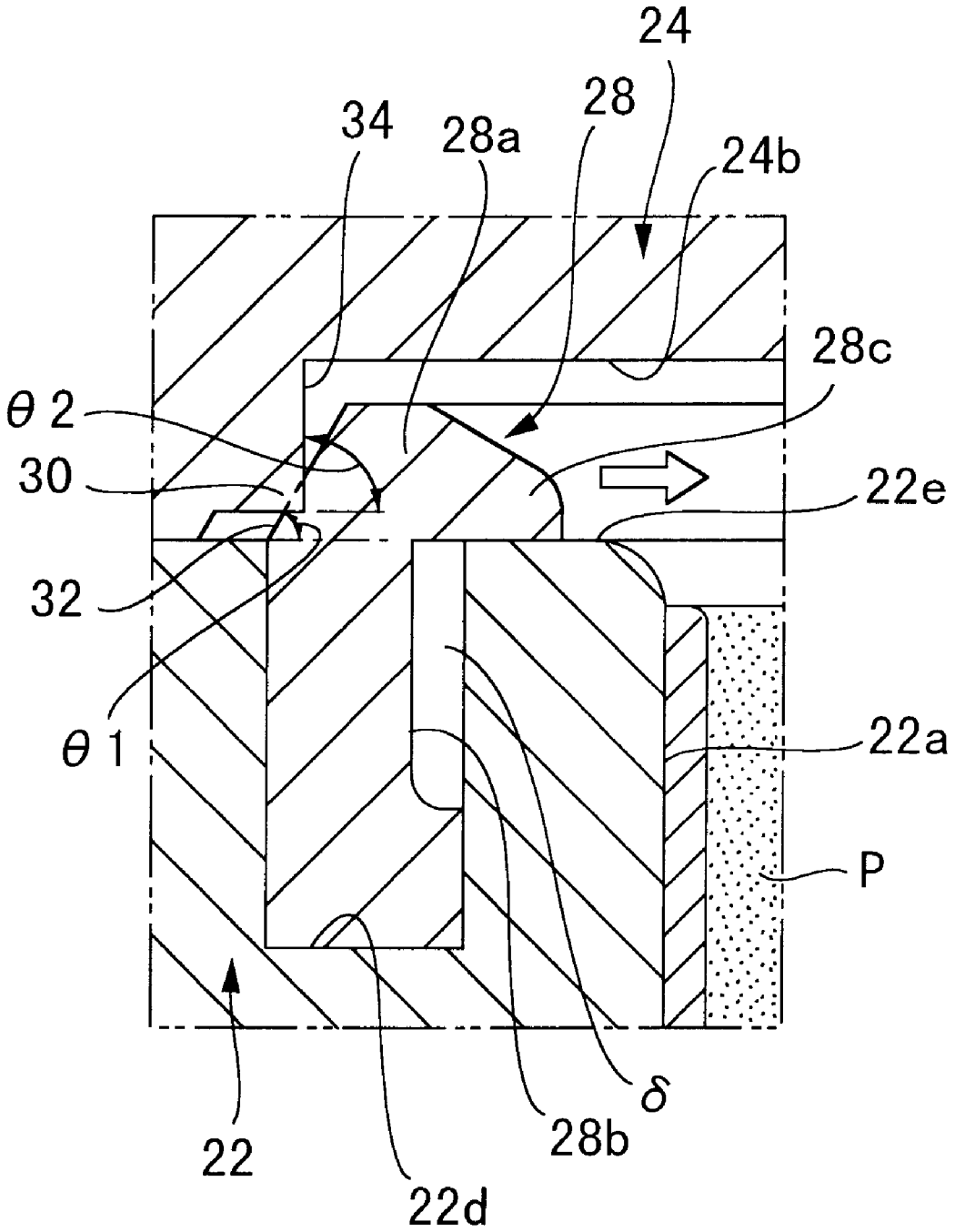
FIG. 27 is a preferred cosmetic case sealing mechanism shown as an enlargement of part F in FIG. 5.

A sealing mechanism is provided between inner cover 24 and inner case 22 with the purpose of maintaining the internal cosmetic container 22*a* in a sealed condition. As shown in FIG. 4, sealing ring 28 is installed around the peripheral opening to cosmetic container 22*a*, and sealing ridge 30 is formed on inner cover 24 in the same general contours as sealing ring 28. Sealing ring 28 is of band shape and composed of rubber or other known appropriate sealing material. As shown in FIG. 27, sealing ring 28 is installed in sealing groove 22*d* on the upper periphery of cosmetic container 22*a*. The upper part of sealing ring 28 extends above the upper peripheral edge of cosmetic container 22*a* to form seal head 28*a*. Seal chamfer 28*b* is formed along the inner periphery of sealing ring 28*a* directly beneath seal head 28*a*, and establishes an area of elastic compression when sealing ring 28 is compressed. Seal chamfer 28*b* forms space "δ" at the inner circumference of sealing groove 22*d*, the purpose of space "δ" being to provide an expansion area for the inward radial deformation of sealing ring 28. Inner sealing flange 28*c* is formed on the inner circumference of sealing ring 28 and extends in an inward radial direction from seal head 28*a* over horizontal surface 22*e* of cosmetic container 22*a* in a manner as to slide freely over horizontal surface 22*e*. First inclined sealing surface 32 is formed on the upper outer circumference of seal head 28*a* at the outer periphery of inner case 22, and forms an increasingly larger diameter in the downward direction.

Recess 24*c* is formed on the inner surface of inner cover 24 opposite to cosmetic container 22*a*, and sealing ridge 30 is formed by the resulting stepped configuration at the periphery of recess 24*c*. Second inclined sealing surface 34 is formed on the inner periphery of inner cover 24 extending upward from seal ridge 30 over first inclined sealing surface 32 on seal head 28*a*. Because angle "θ1" of second inclined sealing surface 34 is larger than angle "θ2" of first inclined sealing surface 32, the following mechanism can take place. As inner cover 24 closes, sealing ridge 30 comes into contact with seal head 28*a* after which the angular face on the inner circumference of sealing ridge 30 (second inclined sealing surface 34) rides over and abrades against first inclined sealing surface 32 on sealing ring 28 until inner cover 24 is completely closed. In this first embodiment of the invention, second inclined sealing surface 34 (angle "θ2") is established as a 90-degree right angle.

As shown in FIG. 1, fore-aft length dimension L1 of space 18 formed within outer case 12 is approximately equivalent to the fore-aft W1 width dimension of inner case 22, and width dimension L2 of outer case 12 is approximately twice as long as the width dimension W2 of inner case 22. Ribs 18*e* are formed. on wall surfaces 18*c* and 18*d* 18 and extend inwardly into space 18. Tabs 18*f* are formed onwalls 18*c* and 18*d* of first compartment 18*a*, and indexing slots 28*j* are opened on walls 22*g* and 22*h* of inner case 22 as a means of positioning inner case 22 within first compartment 18*a*. Push-out orifice 12*f* is opened within floor 12*b* of outer case 12, within the area defined by first compartment 18*a*, as a means of allowing refill case 20 to be pushed out of outer case 12 by applying finger pressure from below in an upward direction.

Figure 3:
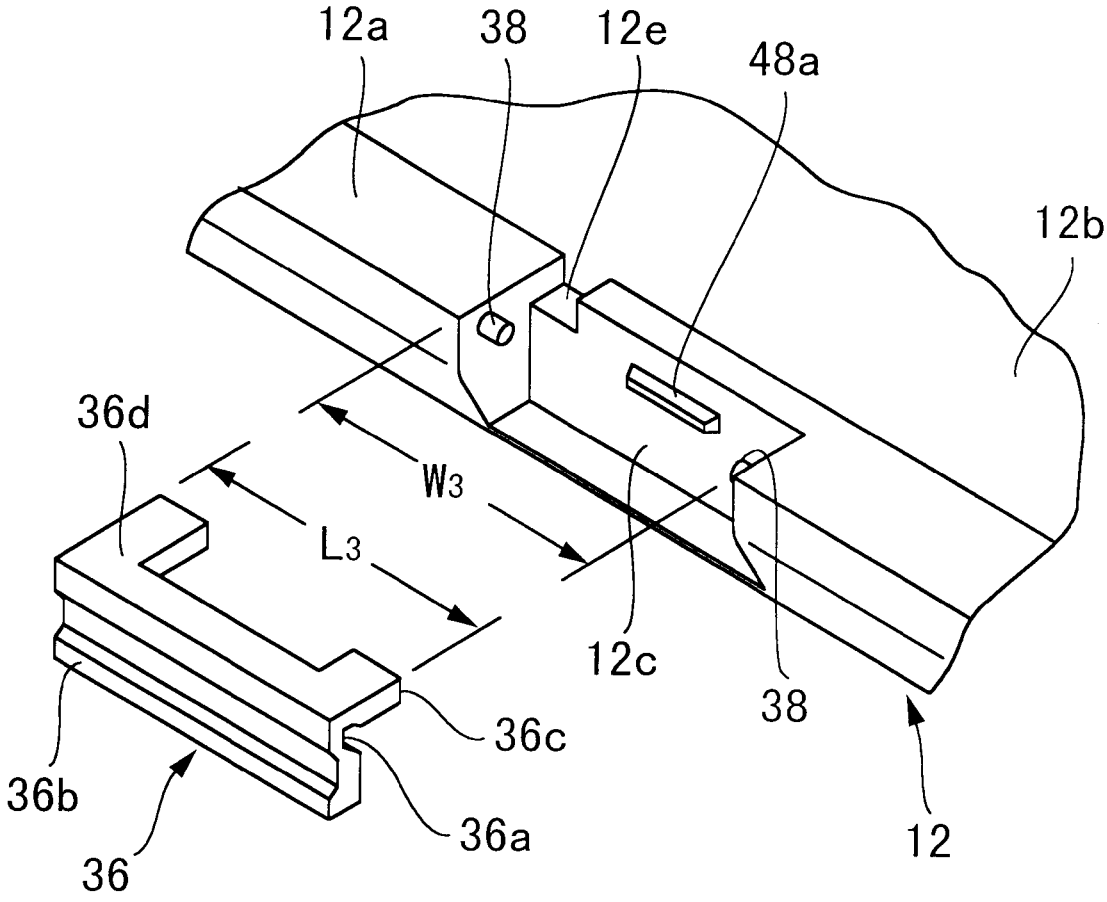
FIG. 3 is an oblique view of the FIG. 1 embodiment showing the push-piece in a removed condition.

Push-piece 36 is installed to outer case 12 as a means of releasing main latch mechanism 48 and sub-latch mechanism 50. As shown in FIG. 3, push-piece 36 is installed to recess 12*c* on outer cover 12, width L3 of push-piece 36 being approximately equivalent to width W3 of recess 12*c*. Split pivot orifices 36*a* are formed toward the upper internal area of push-piece 36, and fit over a pair of pivot pins 38 installed within recess 12*c* as means of allowing push-piece 36 to move with a pivoting action. Touch part 36*b* is formed as a horizontally protruding edge at the lower area of push-piece 36. First release tab 36*c* is formed on the upper ride side, and second release tab 36*d* on the upper left side of push-piece 36. As can be seen in FIG. 2, first release tab 36*c* extends to first latch 48*a* within recess 12*c*, and second release tab 36*d* passes through slot 12*e* formed on the upper surface of recess 12*c*. The lower surface of outer cover 16 is in contact with the end of first release tab 36*c* when cover 24 is in a closed condition, and the lower surface of part 24*a* at the front right of inner cover 24 is in contact with second release tab 36*d*.

Figure 6:
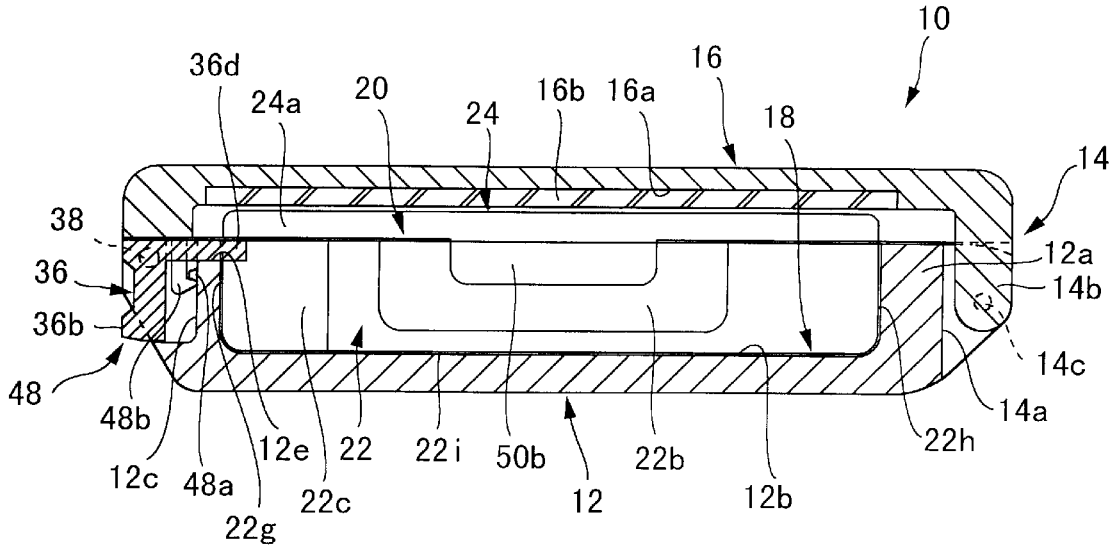
FIG. 6 is a cross section at line VI—VI of FIG. 1 with the outer and inner covers closed.
Figure 7:
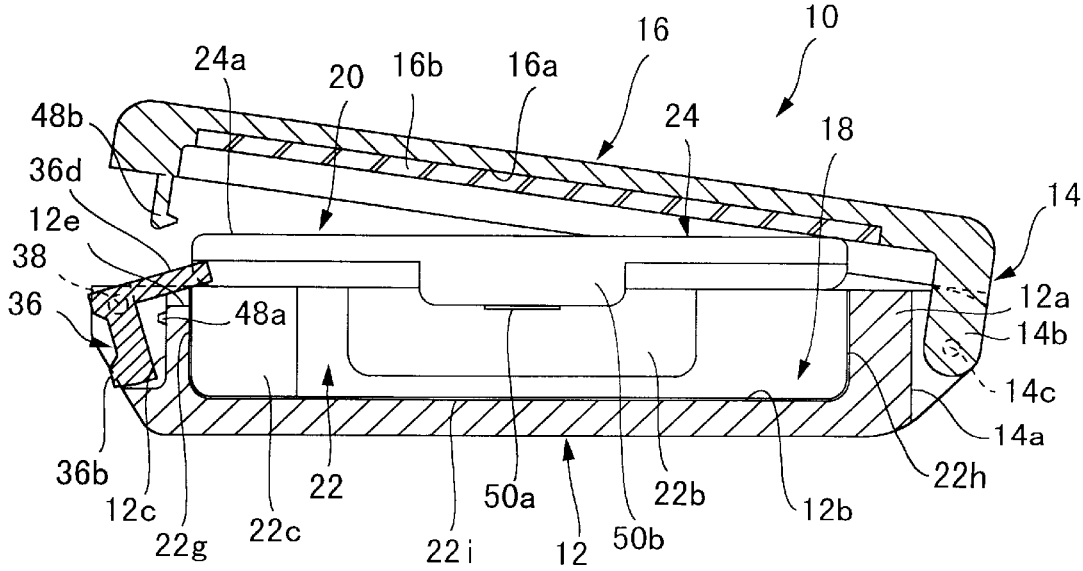
FIG. 7 is the same cross section as FIG. 6 with the outer cover open.
Figure 8:
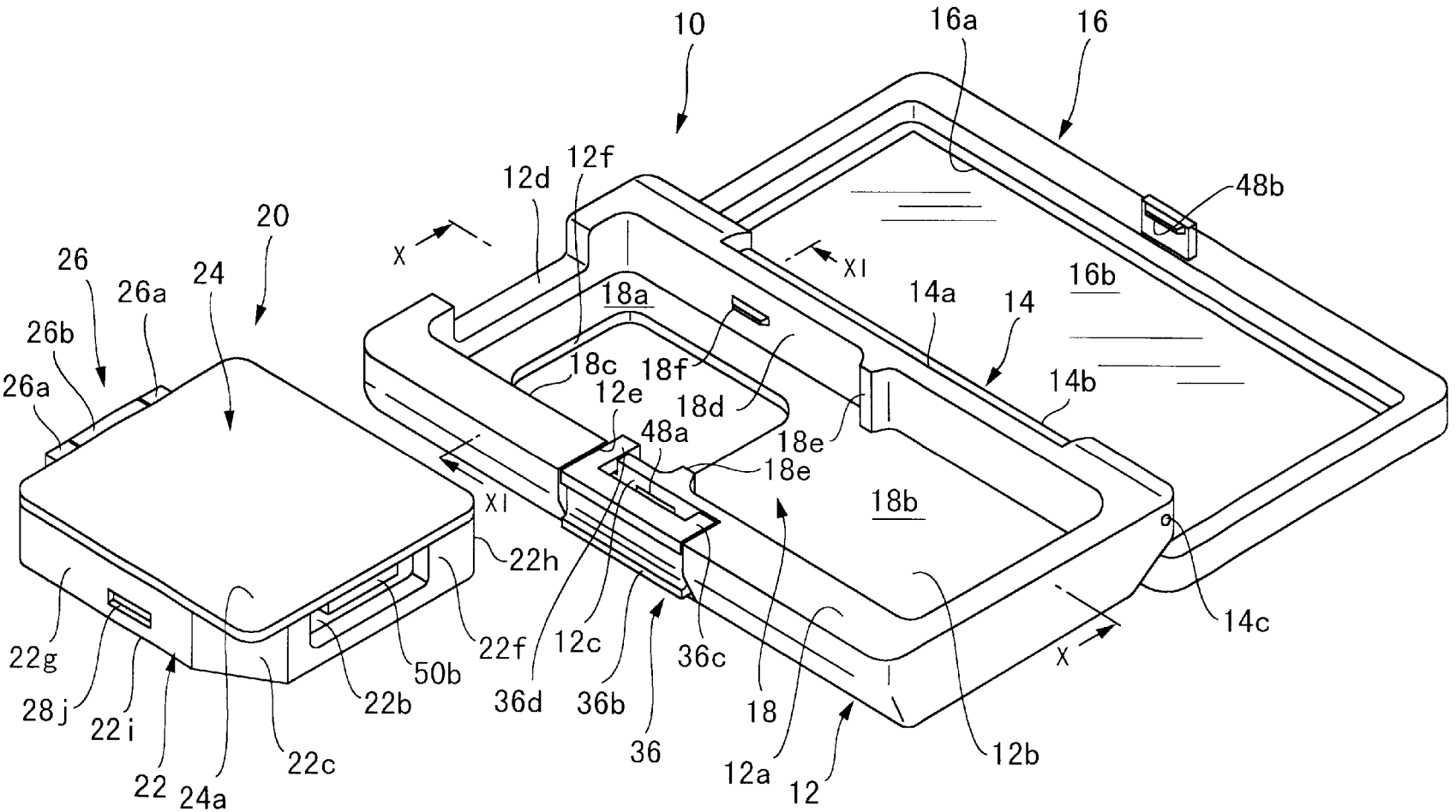
FIG. 8 is an oblique view of the second embodiment of the cosmetic case invention.
Figure 9:
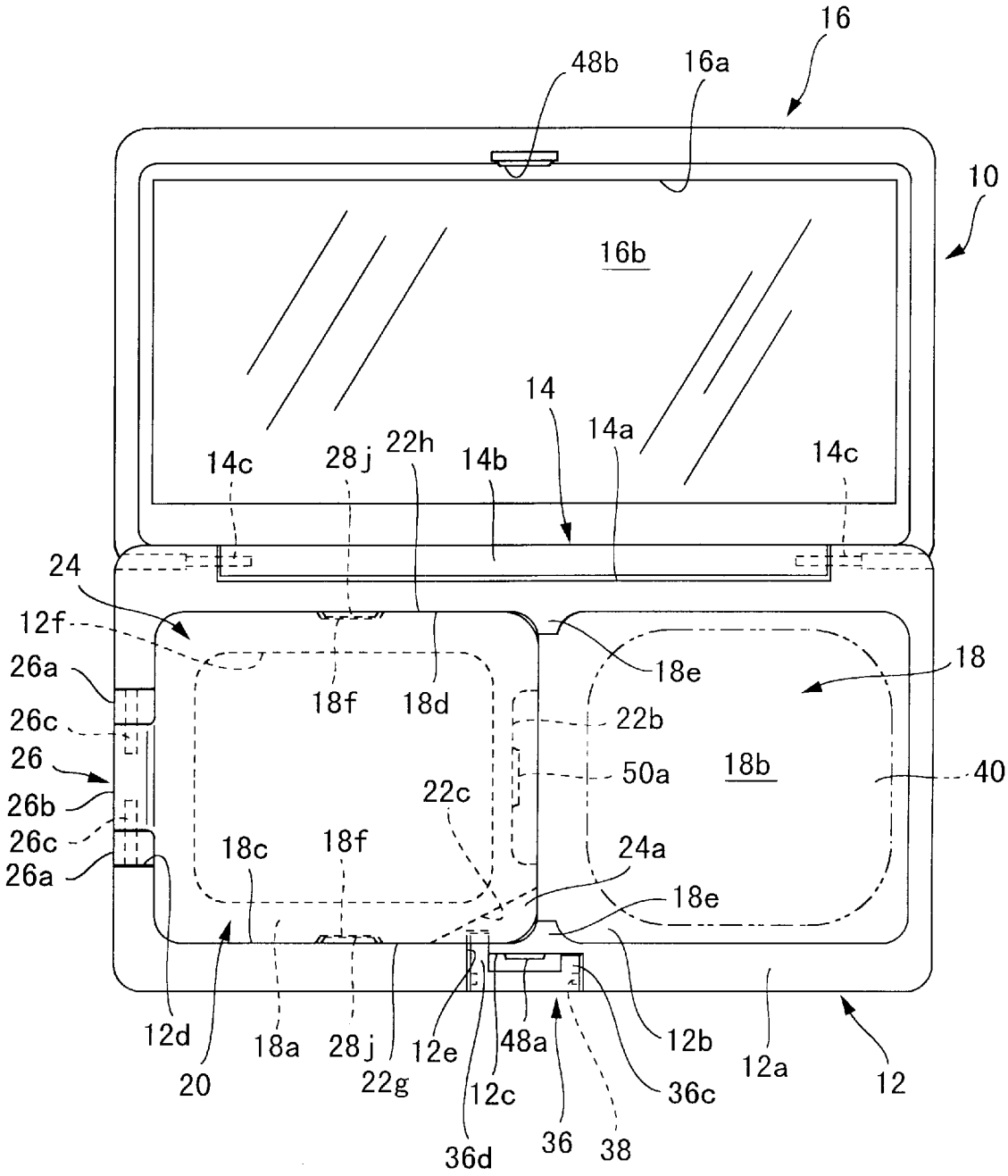
FIG. 9 is a plan view of the FIG. 8 embodiment with the outer cover open.
Figure 10:
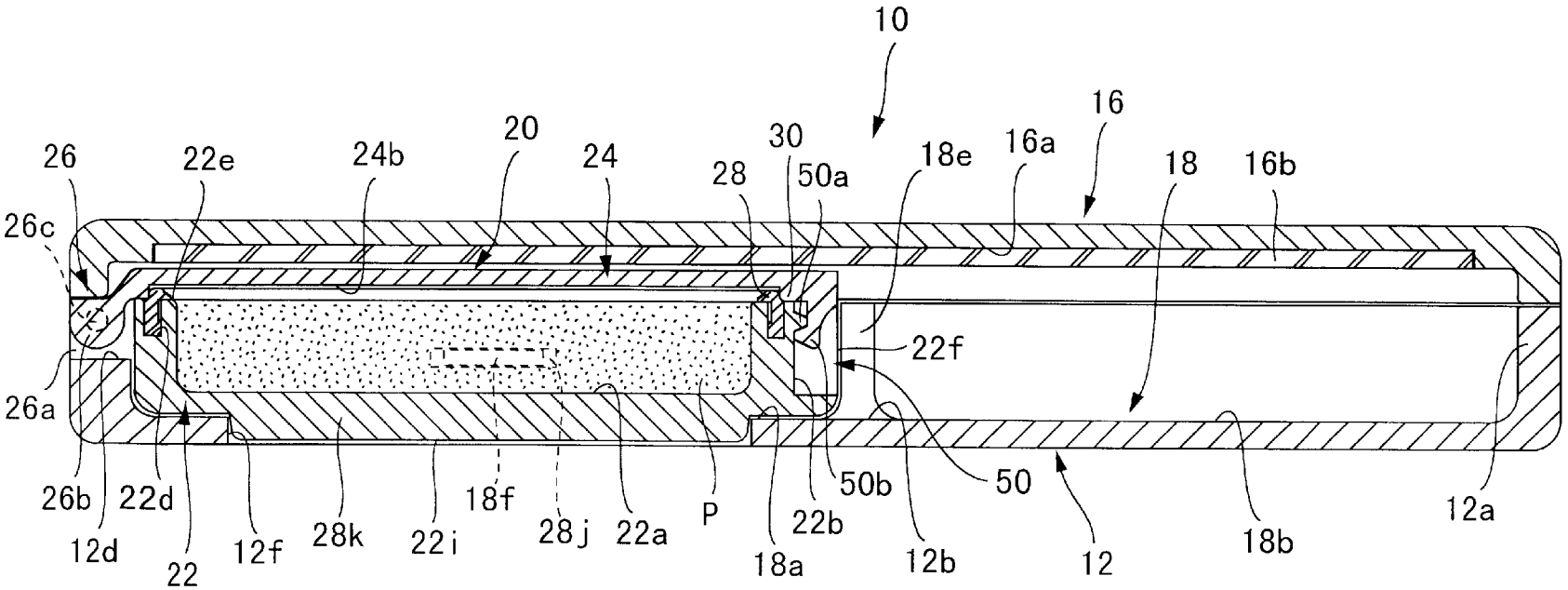
FIG. 10 is a cross section at line X—X of FIG. 8.
Figure 11:
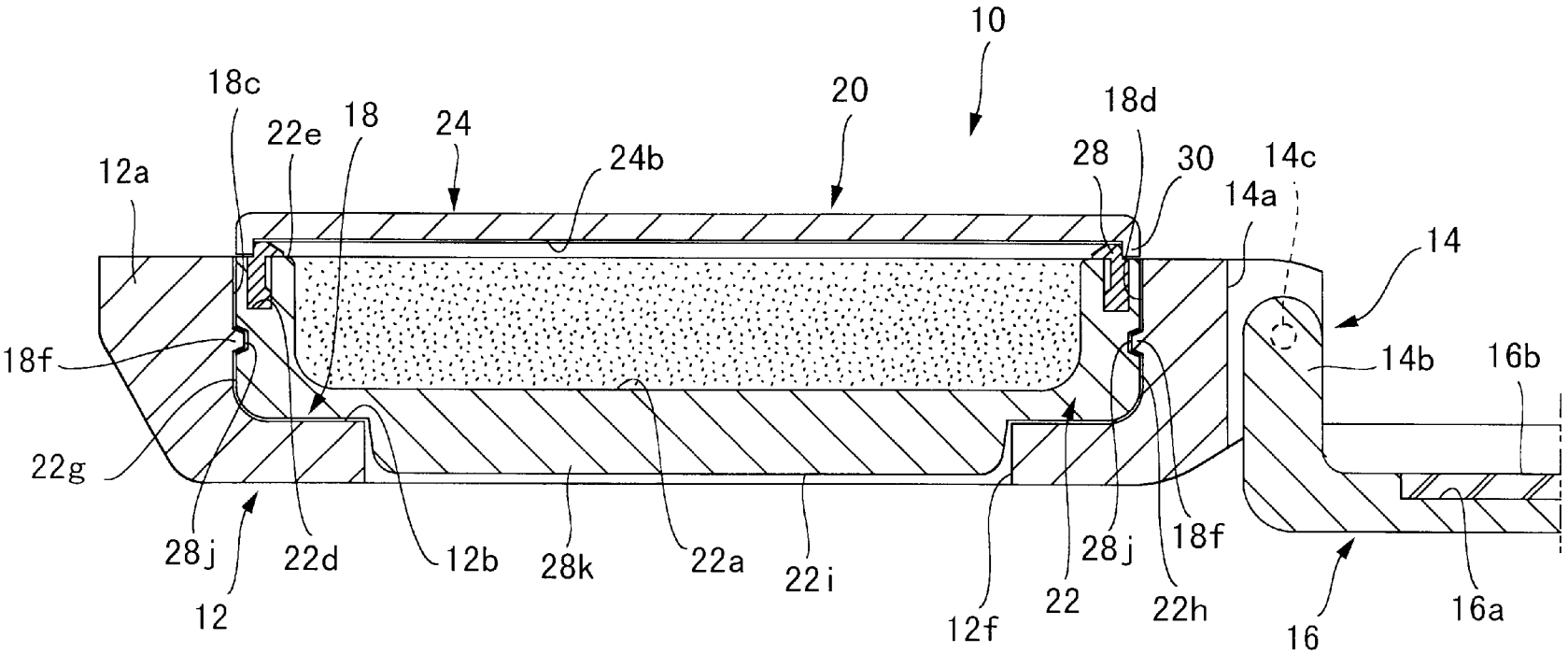
FIG. 11 is a cross section at line X1—X1 of FIG. 8.

With the first embodiment of cosmetic case 10 being thus structured, main latch mechanism 48 and sub-latch mechanism 50 are able to maintain outer cover 16 and inner cover 24 in a closed condition as shown in FIGS. 4 and 6. Pressing in push-piece 36, however, will release both main latch mechanism 48 and sub-latch mechanism 50, and thereby cause outer cover 16 and inner cover 24 to open simultaneously, thus providing fast and convenient access to cosmetic material P contained within cosmetic container 22*a*. Specifically, applying pressure to touch part 36*b* of push-piece 36 will result in push-piece 36 rotating on pivot pins 38 which results in an upward motion of first and second release tabs 36*c* and 36*d*, a movement which forcefully pushes open outer cover 16 and inner cover 24. The upward force applied through the push-piece releases the joint at first latch 48*a* and second latch 48*b*, and also the connection at first latch 50*a* and second latch 50*b*. FIG. 7 shows outer cover 16 and inner cover 24 in a released and slightly opened condition from which the user can easily open the covers to their full open positions.

This first embodiment of the cosmetic case invention has presented a structure in which a single pushing action applied to a push-piece is able open both outer cover 16 and inner cover 24 of the refill-type cosmetic case. The aforesaid structure not only provides means for convenient opening of a dual-compartment refill-type cosmetic case, but also provides for the efficient use of the inner case area as a result of the minimum amount of space required by the pivoting action of the aforesaid push-piece.

As cutout section 12*d* is provided on outer wall 12*b* ask clearance for hinge mechanism 26, the opening of inner cover 24 does not interfere with outer wall 12*b*, thereby allowing inner cover 24 to open completely in an outward direction from outer case 12 as means of providing free and convenient access to the cosmetic material. As further shown in FIG. 7, the mechanism can be structured so inner cover 24 pushes up against outer cover 16 when push-piece 36 is pressed, thus creating a larger initial opening angle for outer cover 16.

Closing inner cover 24 and then outer cover 16 in sequence engages sub-latch mechanism 50 and main latch mechanism 48 so as to maintain both covers in a tightly closed condition. Maintaining inner cover 24 tightly closed in this manner provides an effective seal of the inner area of cosmetic container 22*a* through the operation of sealing ring 28. The sealing mechanism set forth in this embodiment provides for an increasing pressurization and abrasive rubbing action applied against sealing ring 28 along the entire length of sealing ridge 30 while inner cover 24 is in the process of closing, the aforesaid rubbing action serving as means whereby cosmetic material adhering to sealing ring 28 or sealing groove 30 is removed to maintain a tight and effective sealing condition. As a result, when inner cover 24 comes to a completely closed position, sealing ridge 30 is applying pressure to sealing ring 28 through a sealing surface which has been cleansed of any residual cosmetic materials, thus forming a tight and effective seal.

Moreover, as first inclined sealing surface 32 operates as the seal contact area between sealing ring 28 and sealing ridge 30, the closing action of inner cover 24 provides an abrasive action of continuously increasing pressure between the sealing surfaces, thus providing a process which is highly effective in removing residual cosmetic material from the sealing area. With inner cover 24 in a completely closed condition, the operation of first inclined sealing surface 32 provides effective sealing pressure between sealing ring 28 and sealing ridge 30 in a manner which further improves the abrasive cleaning and sealing effect. The result is that the cosmetic material stored within cosmetic container 22*a* can be maintained in a desired and usable condition for a longer time period despite the escape and adherence of cosmetic material around the sealing area of the cosmetic case.

Moreover, sealing ring 28 provides a more positive sealing effect by means of establishing seal head 28*a* around the opening of cosmetic container 22*a* at the upper surface of inner case 22 to form a seal above cosmetic container 22*a*. This structure differs from conventional cosmetic cases which employ a grove around the lower part of the opening to cosmetic container 22, and being so differed, requires only the establishment of sealing groove 22*d* as means of attaching sealing ring 28 around the opening to cosmetic container 22*a*. As a result, the access area to cosmetic container 22*a* is enlarged, and the amount of cosmetic material carried within cosmetic case 10 can be increased without increasing external dimensions. Furthermore, as gap "i" provides for elastic deformation of sealing ring 28 in an inwardly radial direction, a mechanism which causes inner sealing flange 28*c* to slide along horizontal surface 22*e*,, the compression force applied to sealing ring 28 by ridge 30 is received by horizontal surface 22*e* as seal deformation proceeds inwardly in the radial direction. As a result of this mechanism, ridge 30 makes use of the elastic property of sealing ring 28 to create the aforementioned abrasive rubbing action thereon as a means of removing any cosmetic material adhering to the sealing surfaces.

Refill case 20 is secured within first compartment 18*a* of inner space 18 by means of ribs 18*e*, and by further means of tabs 18*f* of inner walls 18*c* and 18*d* inserting into slots 22*j* on inner case 22. Cosmetic application puff 40 or other like device can be held in second compartment 18*b*.

Refill case 20 is indexed within inner space 18 by means of the slight protrusion of ribs 18*e* formed on inner walls 18*c* and 18*d*. As a result of this structure, the need for a separator wall to define first compartment 18*a* (for refill case 20) and second compartment 18*b* (for the aforesaid application puff 40) is eliminated. As ribs 18*e* only protrude a small amount within inner space 18, inner space 18 can be generally defined as one continuous space over the length of outer case 12, a characteristic which simplifies the formation of inner space 18 through the use of less complex dies to manufacture outer case 12. While the figures show ribs 18*e* formed on both wall 18*c* and 18*d*, a single rib 18*e* may be formed on either wall 18*c* or 18*d* and provide the same indexing effect for refill case 20.

Furthermore, establishing orifice 12*f* in the floor area of outer case 12 allows the user of the cosmetic case to easily remove refill 20 from inner space 18 by pushing up on the bottom surface 22*i* of inner case 22 through orifice 12*f*, and thus easily separating slots 22*j* from tabs 18*f*. Refill case 20 can also be removed from inner space 18 by gripping said case from above and pulling out, thus providing two convenient methods of removal.

FIGS. 8 through 11 describe a second embodiment of the cosmetic case invention. In this second embodiment, cosmetic case 10 generally resembles that described in the first embodiment, but has an enlarged orifice 12*f* opened within floor area 12*b* of outer case 22, orifice 12*f* being of the approximate same shape but slightly smaller than lower part 22*i* of inner case 22. Also, protruding surface 28*k* is formed on lower part 22*i* of inner case 22 to the approximate same size as orifice 12*f* and in a manner as to allow protruding surface 28*k* to fit within orifice 12*f* when refill case 20 is installed.

Enlarged orifice 12*f* exposes a larger area of lower part 22*i* of inner case 22, and thus allows multiple fingers to be used to press against lower part 22*i* to remove refill case 20. This structure allows easier separation and release of the joint formed between tabs 18*f* and slots 22*j*.

FIGS. 12 through 17 describe a third embodiment of the cosmetic case invention in which cosmetic case 10 is comprised of;

- outer case 12,
- outer cover 16 open and closably installed to outer case 12 to allow access therein,
- inner case 22 of refill case 20, inner case 22 being installable or removable to first compartment 52*b* within inner space 18,
- inner cover 24 which is able to open or close on inner case 22 to allow access therein,
- second latch 48*d* formed to outer cover 16 and able to install to or detach from outer case 12,
- push-piece 54 installed to outer case 12, push-piece 54 being operable in a manner so as to release the joint formed at second latch 48*d*,
- second latch 50*d* formed on inner cover 24, second latch 50*d* being able to form a joint with inner case 22,
- and intermediate piece 56 installed between main case 22 and push-piece 54, intermediate piece 56 being employed to release the joint between second latch 50*d* and inner case 22 by means of the movement of push-piece 54.

Figure 12:
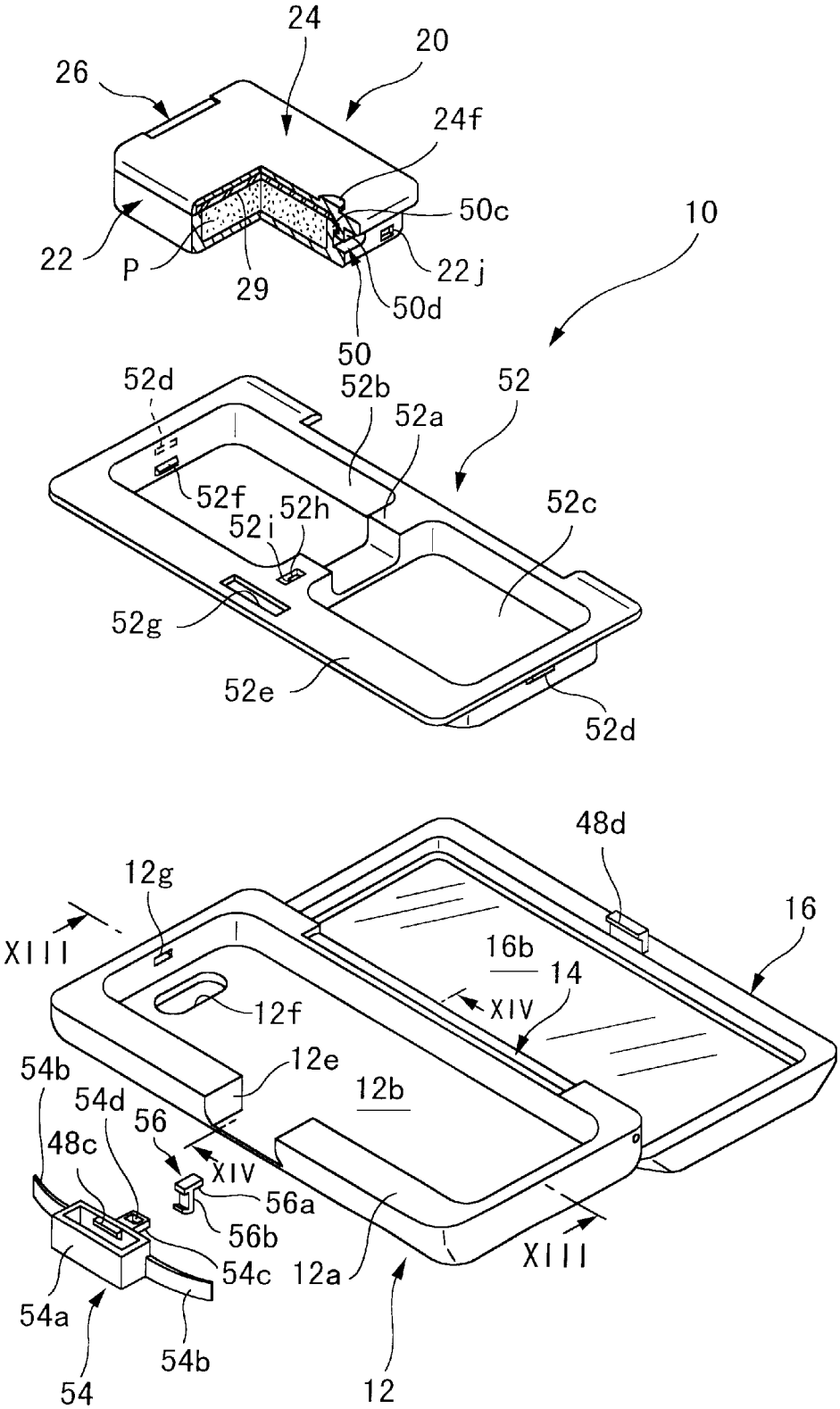
FIG. 12 is an oblique view of the third embodiment of the cosmetic case invention.
Figure 13:
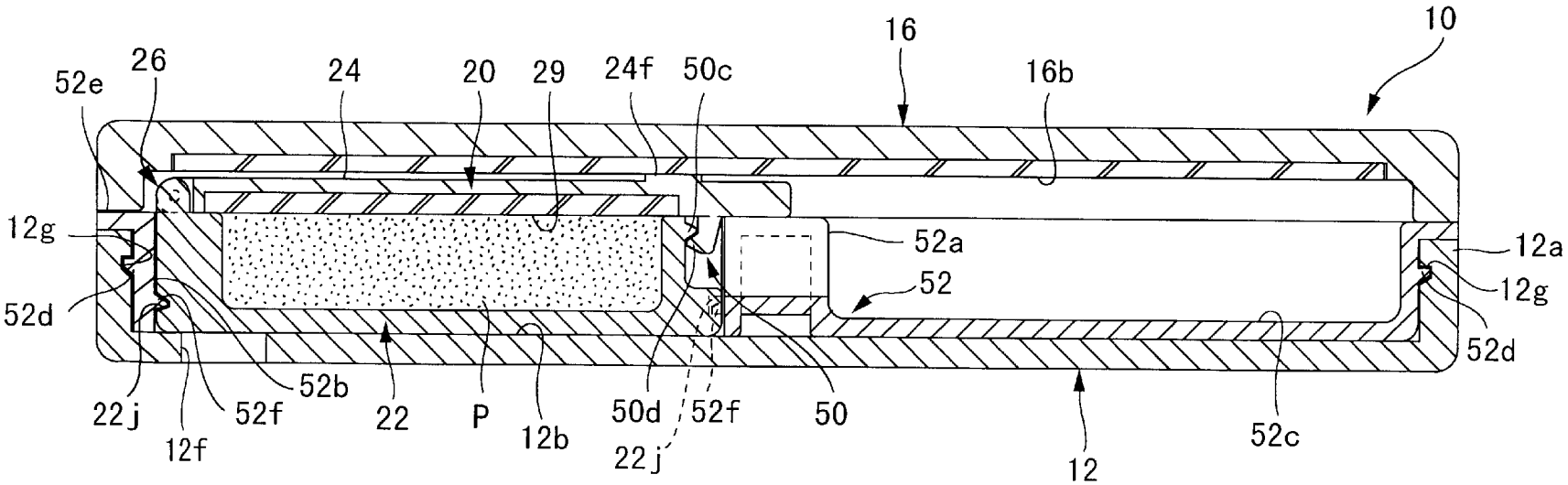
FIG. 13 is a cross section at line XIII—XIII of FIG. 12.
Figure 14:
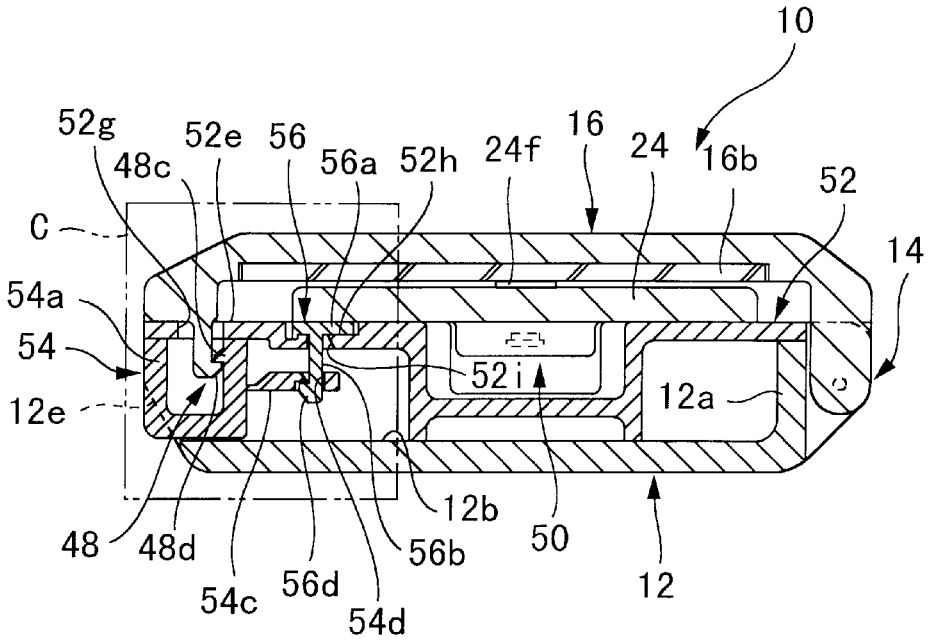
FIG. 14 is a cross section at line XIV—XIV of FIG. 12 with the inner and outer cover closed.

As shown in FIGS. 12 through 14, inner tray 52 is installed within outer case 12, inner tray 52 forming two separate compartments 52*b* and 52*c*. Divider wall 52*a* is established in the center of inner tray 52 in the fore-aft direction which results in the formation of first compartment 52*b* on the left side of divider wall 52*a*, and second compartment 52*c* on the right side. Tabs 52*d* are formed on the outer perimeter of inner tray 52 as a means of connecting inner tray 52 to outer case 12 through slots 12*g* formed on the inner wall of outer case perimeter 12*a*. Flange 52*e* comes into contact with the upper surface of perimeter 12*a* of outer case 12 when inner tray 52 is installed to outer case 12.

Refill case 20 holds cosmetic material P and can be easily installed to or removed from first compartment 52*b*. Tab 52 is formed on the inner periphery of first compartment 52*b* and is able to insert into slot 22*j* formed on the outer perimeter of inner case 22 as a means of securing refill case 20 in first compartment 52*b*.

Orifice 12*f* is formed in floor 12*b* of outer case 12 beneath first compartment 52*b*. Inserting a finger through orifice 12*h*, from the bottom of outer case 12 will allow the convenient; removal of inner case 20 from first compartment 52*b*.

Push-piece 54 is installed within cutout section 12*e* formed on outer case 12 in a manner as to be movable in the fore-aft direction. Part of push-piece 54 includes touch part. 54*a*, the main body thereof being of hollow square cross section. Plate spring 54*b* is installed at the rear portion of touch part. 54*a* and at each side thereon. With touch part 54*a* residing in cutout section 12*e*, the outer ends of plate springs 54*b* contact the front surface of inner tray 52, and are thus able to support touch part 54*a* and allow its fore-aft movement within cutout section 12*e*.

Second latch 48*d* is installed on the inner opening side of outer cover 16, and 1st latch 48*c* is installed on the rear surface within the hollow internal area of touch part 54*a*. Second latch 48*d* and first latch 48*c* together comprise main latch mechanism 48. As shown in FIG. 14, when outer cover 16 is in a closed condition, second latch 48*d* resides within orifice 52*g* formed within flange 52*e* of inner tray 52, and forms a latched joint with first latch 48*c*, said latched joint serving as means of maintaining outer cover 16 in a closed condition.

Incorporating much the same structure as outer cover 16, second latch 50*d* is formed as a protruding part on the center of the opening side of inner cover 24, and first latch 50*c* is formed at the center of the right side of inner case 22, second latch 50*d* and first latch 50*c* comprising sub-latch mechanism 50. Second latch 50*d* joins with first latch 50*c* at the time when inner cover 24 is, and serves as means whereby inner cover 24 is secured in a closed condition.

As shown in FIG. 14, intermediate piece 56 is installed in the area between inner cover 24 and push-piece 54, and serves as means through which the forward movement of push-piece 54 can be converted into a vertical movement capable of pushing open inner cover 24. Intermediate piece 56 is comprised of release plate 56*a* which inclines to push up against the underside of the opening edge of inner cover 24, and inverted T-shaped drive part 56*b* located at the opposite end to plate 56*a*, drive part 56*b* being in contact with and drivable by push-piece 54. Horizontal plate 56*a* resides in cutout section 52*h* formed on the upper surface of inner tray 52, and drive part 56*b* resides in orifice 52*i* formed at the lower part of cutout section 52*h*. Contact piece 54*c* is formed on the back of touch part 54*a* and incorporates connector slot 54*d* at its forward part into which drive part 56*b* is inserted.

Figure 16:
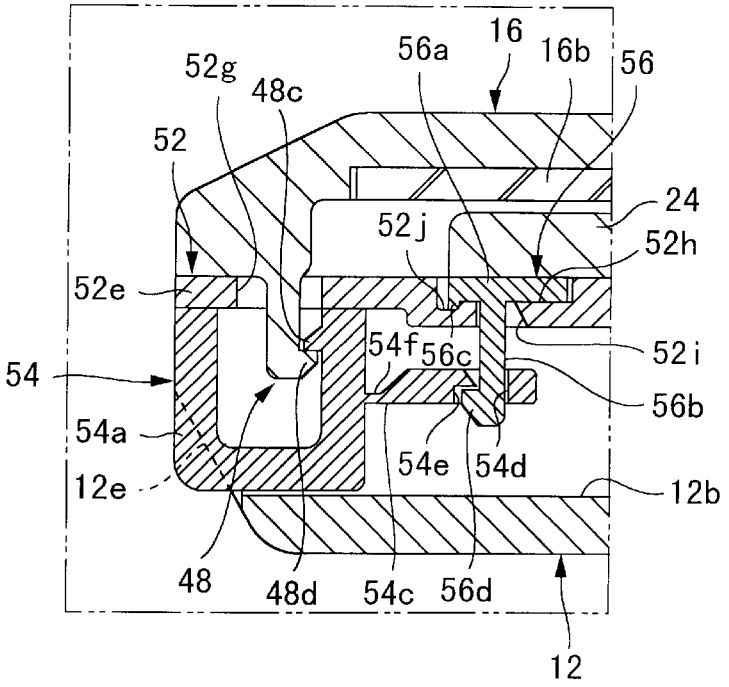
FIG. 16 is an enlarged view of part C of FIG. 14.

As shown in FIG. 16, pivot lip 56*c* is formed on the front lower part of release plate 56*a*, and mates with channel 52*j* (which is formed on the front edge of cutout section 52*h*) at the time when intermediate piece 56 is resting within cutout section 52*h*.

Pawl 56*d* is formed on the lower front extremity of drive part 56*b* and connects to notch 54*e* which is formed within connector slot 54*d*. Bending part 54*f* is formed in contact piece 54*c* at the point where contact piece 54*c* is joined to touch part: 54*a* as means of allowing a small amount of flex within contact piece 54*c*.

Vanity mirror 16*b* is installed to the inner surface of outer cover 16. Protruding part 24*f* is formed on the top of inner cover 24, and will come into contact with vanity mirror 16*b* when outer cover 16 is closed, thus providing means securely closing inner cover 24 simultaneously with outer cover 16. As shown in FIGS. 12 and 13, packing 29 is installed on the underside of inner cover 24 as a means of sealing the interior area of inner case 22.

As shown in FIGS. 13 and 14, when outer cover 16 and inner cover 24 are closed, main latch mechanism 48 and sub-latch mechanism 50 are in a mutually latched condition with push-piece 54 being maintained in an outward position as a result of the pressure applied by plate springs 54*b*. In this condition, push-piece 54 and intermediate piece 56 allow release plate 56*a* to reside beneath inner cover 24 in a horizontal position through contact piece 54*c*.

Figure 15:
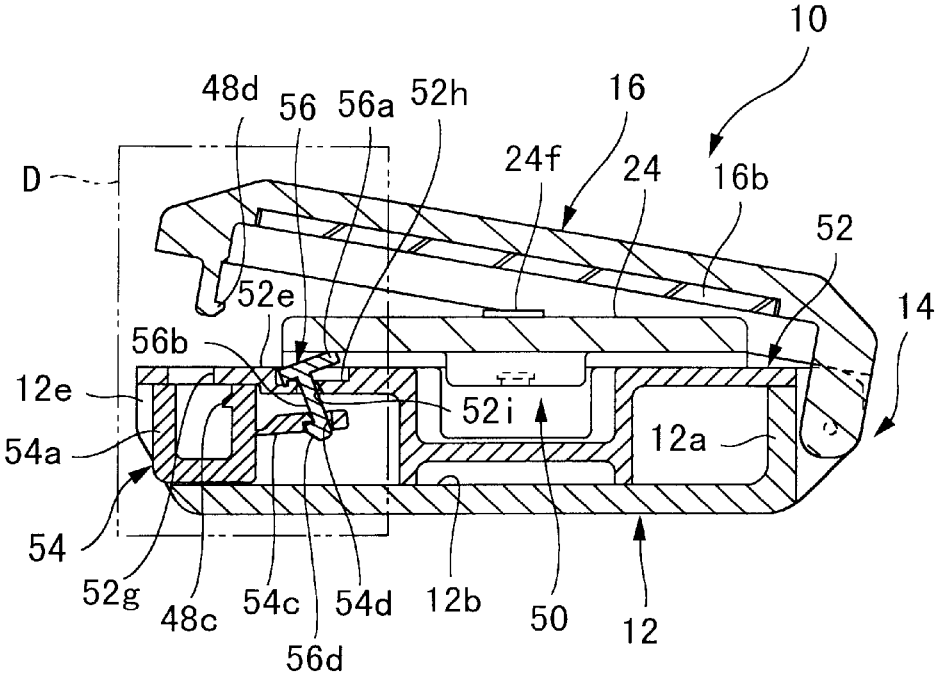
FIG. 15 is the FIG. 1 cross section showing the outer cover in a released condition.
Figure 17:
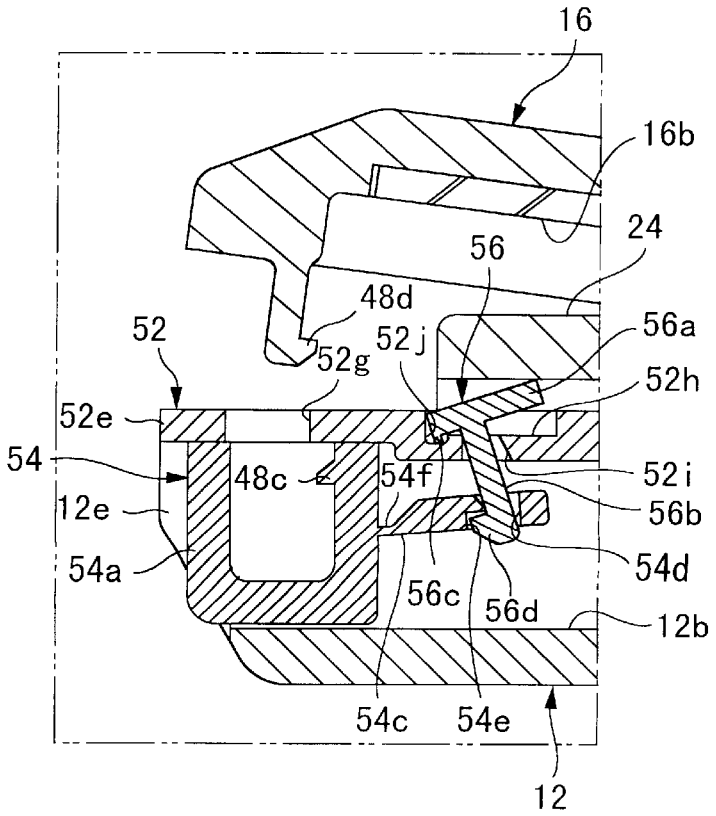
FIG. 17 is an enlarged view of part D of FIG. 15.

As shown in FIGS. 15 and 17, pressing push-piece 54 in an inward direction against the pressure applied by plate springs 45*b* will result in the release of main latch mechanism 48. As a result of this same action, contact piece 54*c* moves rearward and pushes back drive part 56*b* of intermediate piece 56, thus causing a upward rotating angular displacement of release plate 56*a* from pivot lip 56*c*. The increasing inclination of release plate 56*a* causes it to push up against: inner cover 24 and release sub-latch mechanism 50. Intermediate piece 56 itself does not release in an upward direction due to pawl 56*d* of drive part 56*b* being connected to notch 54*e* of contact piece 54*c*.

This mechanism releases both main latch mechanism 48 and sub-latch mechanism 50 as a means of opening both outer cover 16 and inner cover 24 to provide access to cosmetic material P contained within refill case 20. As a result of this structure, a simple one-push operation of push-piece 54 makes it possible to easily, conveniently, and simultaneously release two latching joint mechanisms.

Moreover, as intermediate piece 56 exists separately from inner cover 24 and push-piece 54, intermediate piece 56 and push-piece 54 can be made from different materials and applied. with different color treatments. This factor allows the appearance of push-piece 54 to easily conform to the external. appearance requirements of cosmetic case 10, and intermediate piece 56 to be fabricated in a manner which compliments the internal appearance of the cosmetic case. This factor also provides other advantages, such as the ability to fabricate intermediate piece 56 of a highly abrasion-resistant material so as to offer good durability, and the ability to fabricate push-piece 54 and intermediate piece 56 in various colors and surface finishes to allow for multiple design variations of cosmetic case 10.

The employment of intermediate piece 56 provides other advantages, such as the ability to adjust the operation of push-piece 54 so as to attain the desired type of release action and the desired extent of inclination of release plate 56*a* and corresponding opening of inner cover 24.

Figure 18:
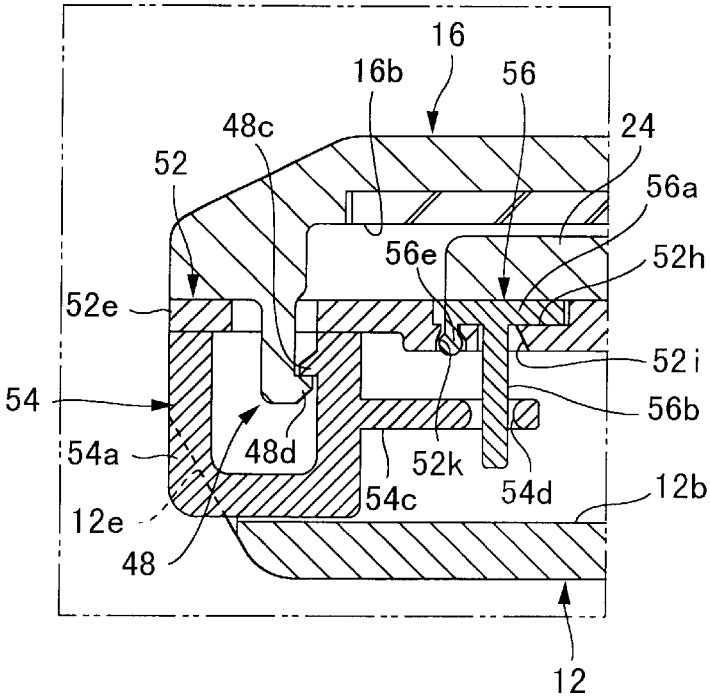
FIG. 18 is a modified example of the mechanism shown in the enlarged cross section of FIG. 16.
Figure 19:
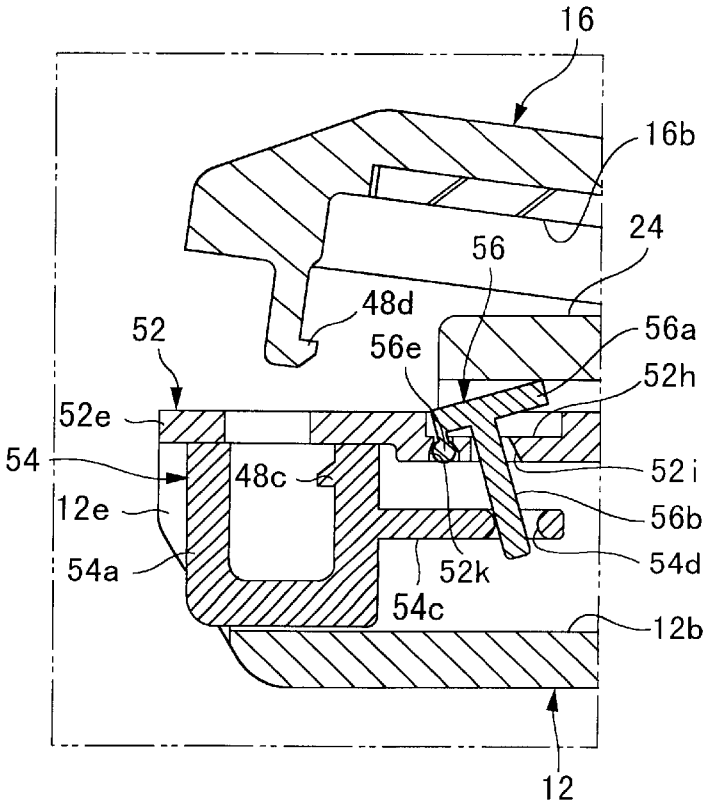
FIG. 19 is a modified example of the mechanisms shown in the enlarged cross sections of FIG. 17 and 18.
Figure 20:
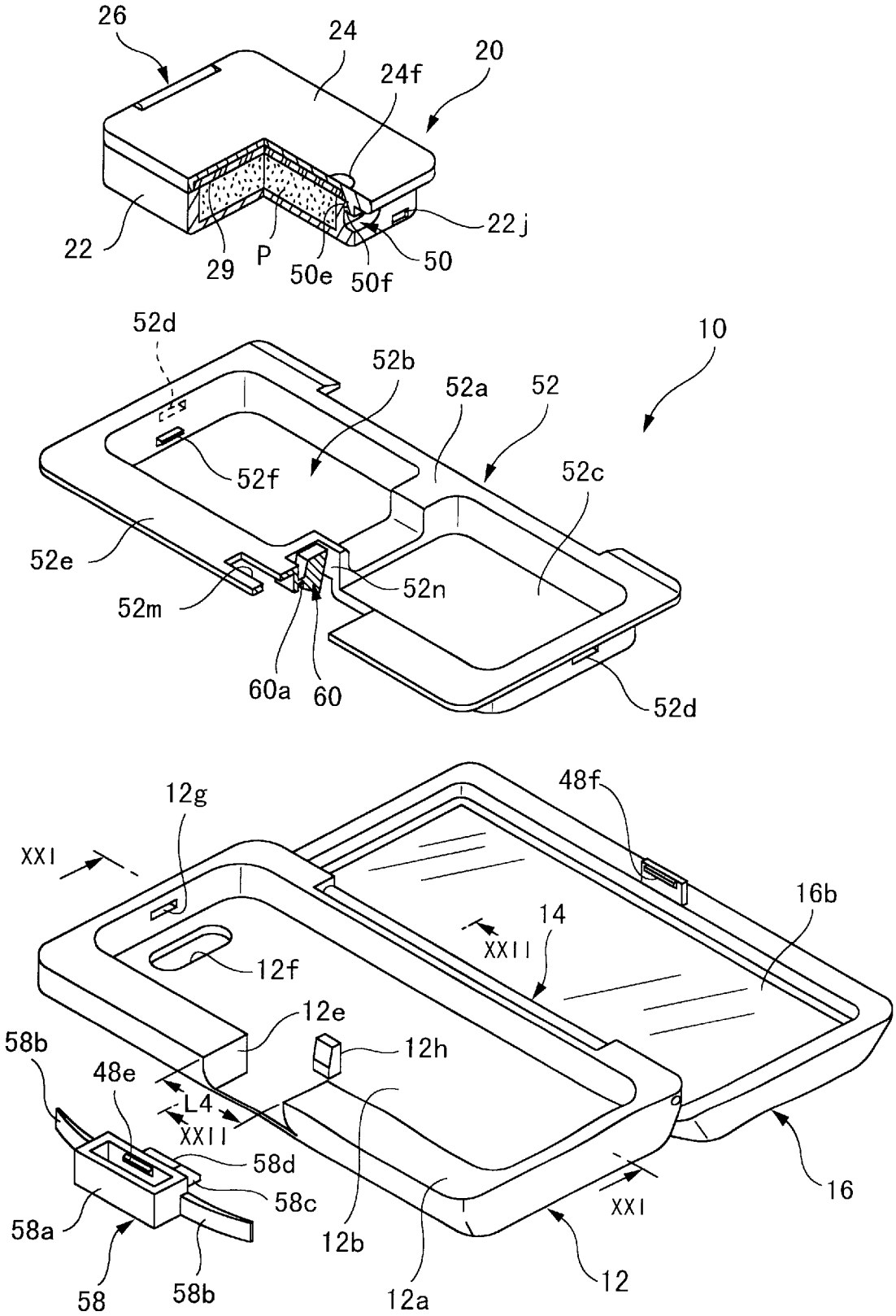
FIG. 20 is a fourth embodiment of the cosmetic case invention.

FIGS. 18 and 19 describe a modification of the structure of intermediate piece 56 as presented in the previous third embodiment in which pivot lip 56*c* was formed on the front lower edge of release plate 56*a*. In place of the aforesaid pivot lip 56*c*, this modified version provides for round pivot 56*e* to be formed as a spherical or cylindrical shape on the front lower edge of release plate 56*a*. Furthermore, pivot orifice 52*k* is formed as a support for round pivot 56*e* within cutout section 56*h* on inner tray 52. As pivot orifice 52*k* is formed smaller than round pivot 56*e* and at its upper side, and larger than round pivot 56*e* at its lower side, pivot orifice 52*k* is able to securely maintain round pivot 56*e* at a fixed point from where said round pivot can rotate as the inclination angle of release plate 56*a* changes. This modification eliminates the need to employ pawl 56*d* of the third embodiment, and allows the lower part of intermediate piece 56 to be of simple shaft construction residing in slot 54*d* of contact piece 54*c*.

As shown in FIG. 19, when push-piece 54 is depressed to open outer cover 16 and inner cover 24, drive part 56*b* is displaced by pressure applied from connector piece 54*c*, thus causing release plate 56*a* to incline upward as a result of its rotation-on round pivot 56*e* in pivot orifice 52*k*.

FIGS. 20 through 24 present a fourth embodiment of the invention in which cosmetic case 10 is comprised of;

outer case 12, outer cover 16 open and closably installed to outer case 12, inner case 22 of refill case 20, inner case 22 being installable or removable to first compartment 52*b* inner tray 52, inner cover 24 open and closably attached to inner case 22, main latch mechanism 48 installed between outer cover 16 and outer case 12 and forming an open and closable joint between outer cover 16 and outer case 12 sub-latch mechanism 50 installed between inner case 22 and inner cover 24 and forming an open and closable joint between inner case 22 and inner cover 24, push-piece 58 installed to outer case 12 and capable of operating in a manner as to release main latch mechanism 48, and flex piece 60 formed as an integral component extending inwardly from outer case 12, residing between outer case 12 and inner cover 24, and capable of releasing main latch 50 through a displaced movement provided by push-piece 58.

Push-piece 58 is structured as a hollow body square in cross section, and installed in cutout section 12*e* of outer case 12 so as to be movable in the fore-aft direction. Push-piece 58 includes touch part 58*a* as the external operating part, has a width dimension approximately equal to width L4 of cutout section 12*e* in outer cover 12, and is able to tightly slide within cutout section 12*e* without looseness. Plate springs 58*b* are attached to each side of touch part 58*a* and are in contact with the front surface of inner tray 52 in a manner which maintains the position of touch part 58*a* within cutout section 12*e*. The tension applied by plate springs 58*b* maintain touch part 58*a* in an extended condition in relation to outer case 12.

Figure 22:
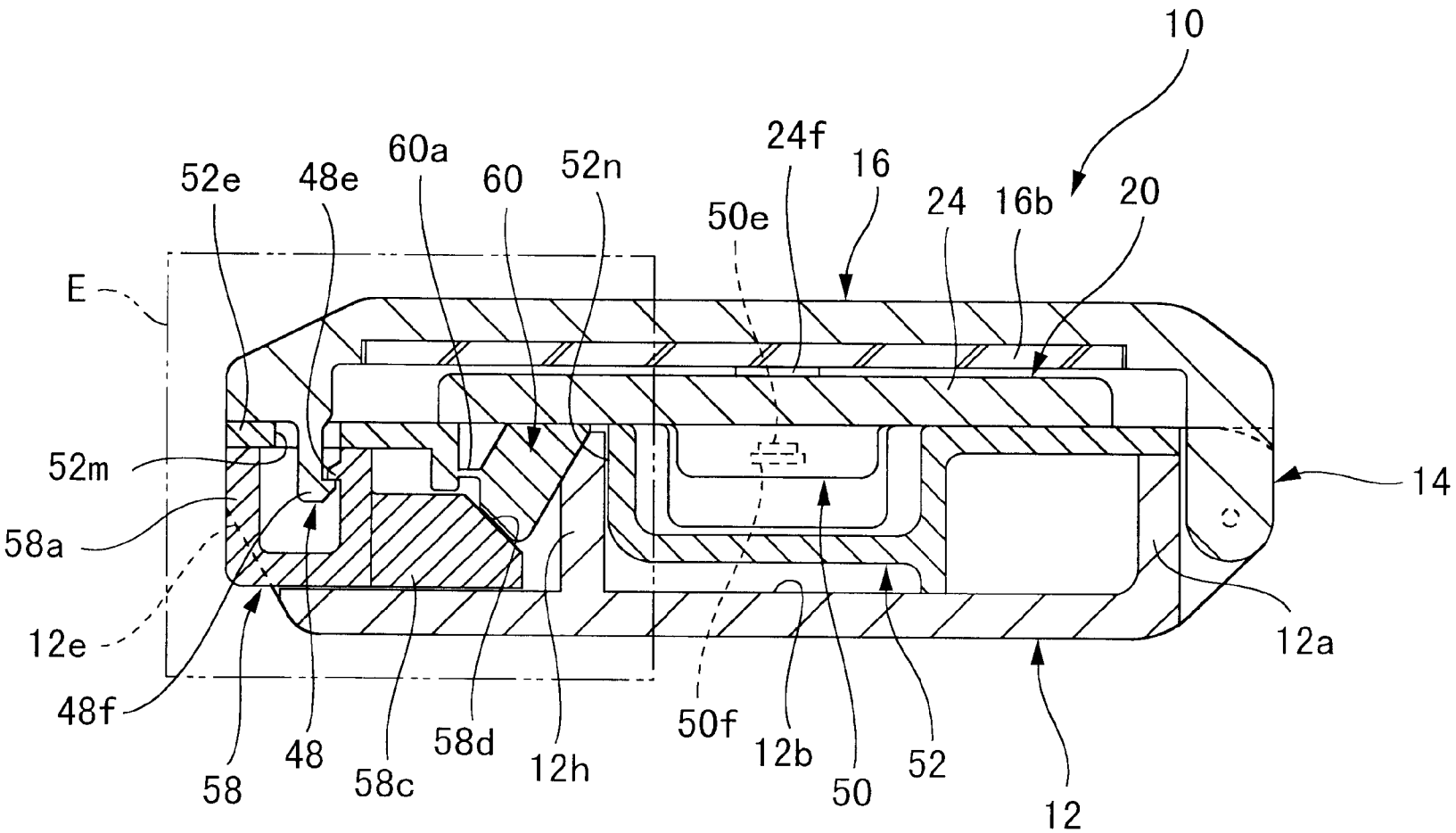
FIG. 22 is a cross section at line XXII—XXII of FIG. 20.

Second latch 48*f* is formed as an extension of outer cover 16 at the front center edge. First latch 48*e* is formed as an inward extension from the inner surface of touch part 58*a* Second latch 48*f* and first latch 48*e* comprise main latch mechanism 48. As shown in FIG. 22, when outer cover 16 if in a closed condition, second latch 48*f* extends through first orifice 52*m* formed in flange 52*e* of inner tray 52, and forms a locked joint with first latch 48*e*.

Second latch 50*f* is formed on the edge of the opening side of inner cover 24, and first latch 50*e* is formed at the center of the right side of inner case 22. Second latch 50*f* and first latch 50*e* form sub-latch mechanism 50. When inner cover 24 is in a closed condition, second latch 50*f* forms a locked joint with first latch 50*e* to maintain inner cover 24 in a closed condition.

As shown by FIG. 22, flex piece 60 is positioned between inner cover 24 and push-piece 58 in a manner whereby the inward movement of push-piece 58 causes flex piece 60 to bend upwards and apply pressure against open inner cover 24. Flex piece 60 is positioned within second orifice 52*n* formed to the rear of first orifice 52*m* of inner tray 52, first orifice 52*m* being employed to provide passage for second latch 48*f* when outer cover 16 is closed. Flex part 60*a* is formed integrally with inner tray 52 through connector part 60*a*, and extends rearward within, second orifice 52*n*.

Block 58*c* is formed as a rearward protrusion of touch part. 58*a* and incorporates inclined surface 58*d* on its rearward extremity, inclined surface 58*d* being oriented so as to be in contact with the lower part of flex piece 60. The upper surface of flex piece 60 is in contact with the underside of inner cover 24, and the lower surface is in contact with floor 12*b* of outer case 12. Stopper 12*h* is formed on floor 12*b* of outer case 12 as a means of preventing flex piece 60 from falling.

Figure 21:
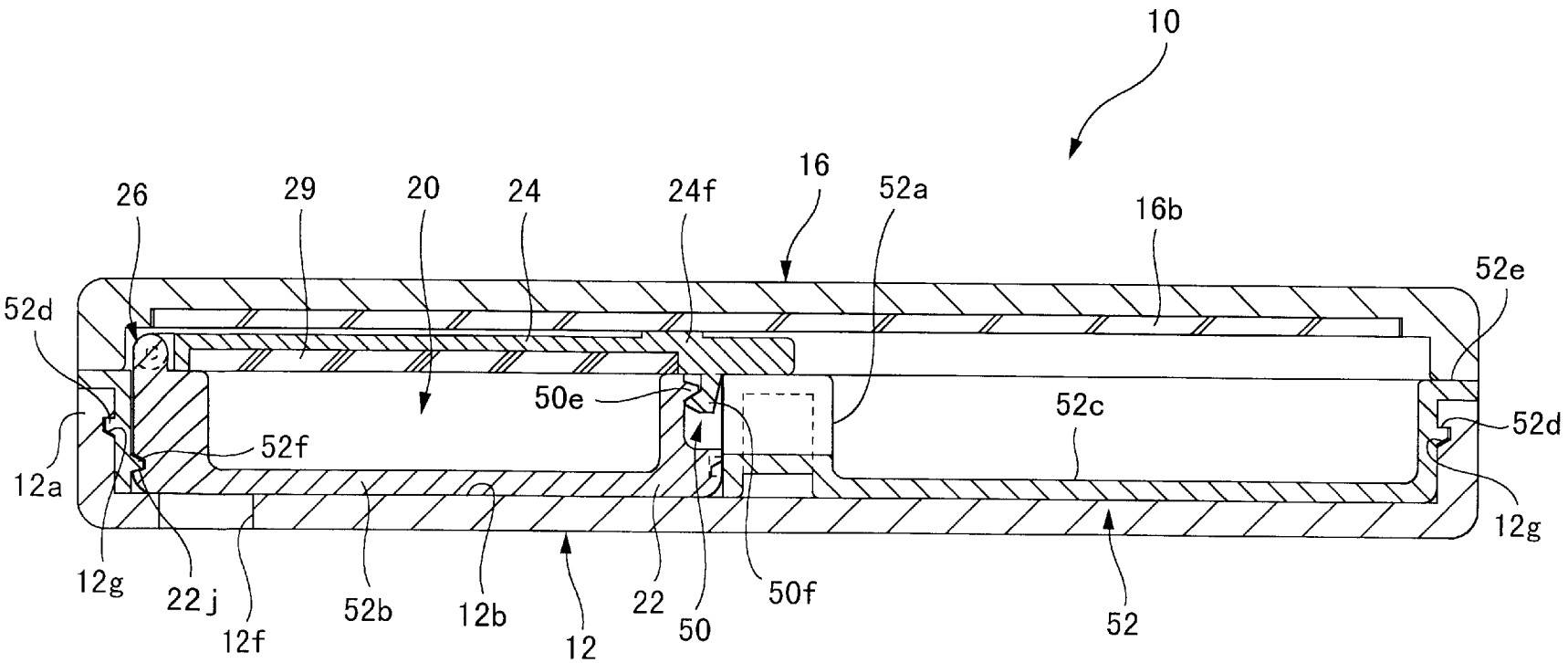
FIG. 21 is a cross section at line XXI—XXI of FIG. 20.
Figure 23:
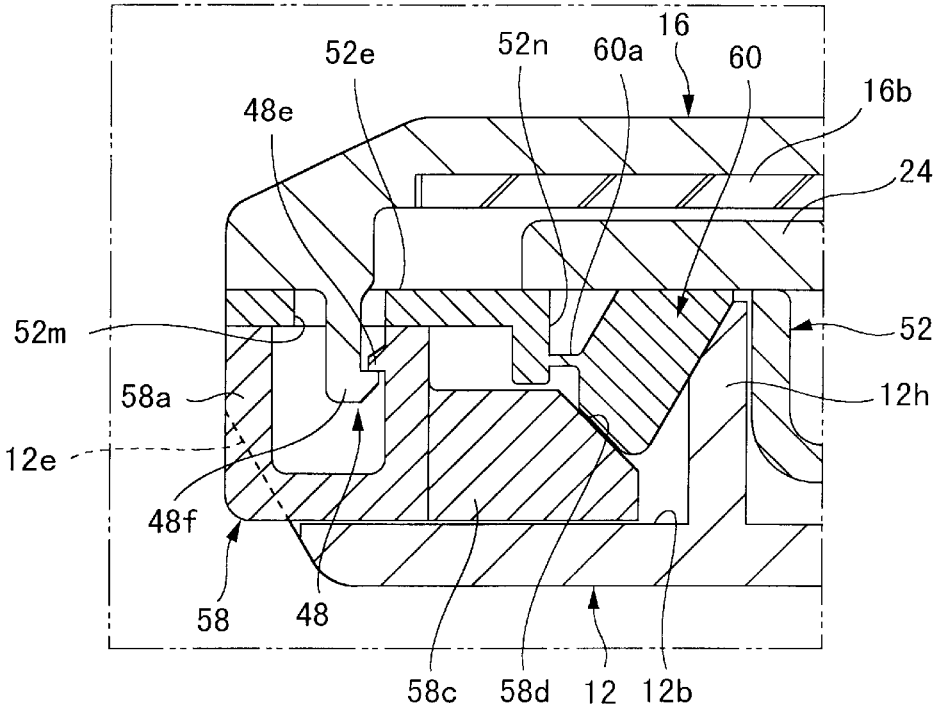
FIG. 23 is an enlarged view of FIG. 22.

As shown in FIGS. 21 and 22, when outer cover 16 and inner cover 24 are in a closed condition, corresponding main latch mechanism 48 and sub-latch mechanism 50 are closed and locked, and push-piece 58*a* is maintained in an extended position through the pressure applied by plate springs 58*b* (FIG. 23). In this condition, the outer face of touch part 58*a* is on approximately the same plane as the front face of outer case 12. Also, flex piece 60 is in a lowered position and in contact with inclined face 58*d* of operating block 58*c*.

Figure 24:
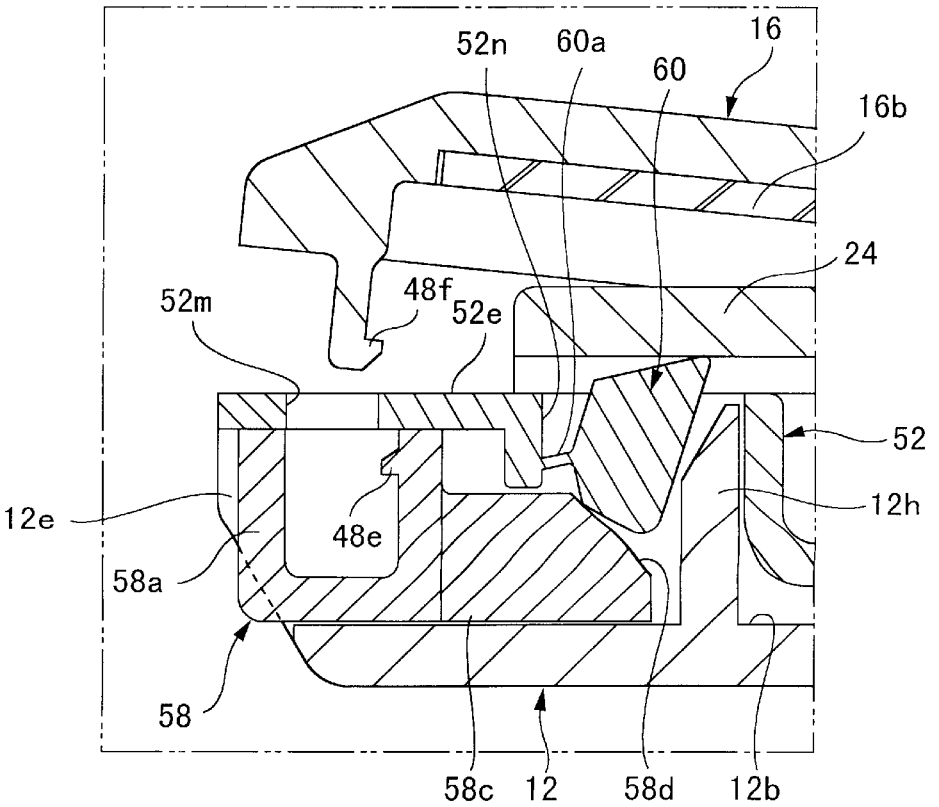
FIG. 24 is the FIG. 23 cross section with the push-piece mechanism released.

As FIG. 24 demonstrates, applying pressure to push-piece 58 against the counter pressure provided by plate springs 58*b* will release main latch mechanism 48 while block 58*c* moves in a rearward direction applying inclined face 58*d* against flex piece 60 and thus causing flex piece 60 to rise upward. As stopper 12*h* prevents flex piece 60 from moving in a rearward direction, flex piece 60 rises upward as a result of the elastic bending of connector piece 60*a* and pushes against inner cover 24 to release sub-latch mechanism 50. The release of sub-latch mechanism 50 and main latch mechanism 48 through this mechanism allows outer cover 16 and inner cover 24 to open.

Main latch 48 and sub-latch mechanism 50 can be thus sequentially released through the operation of push-piece 58. As a single displaced movement of push-piece 58 is able to open both outer cover 16 and inner cover 24, a remarkably easy and convenient mechanism is provided for opening a cosmetic case with an inner outer cover.

Specifically, as flex piece 60 operates as a component part of inner tray 52 installed on the main case side, inner tray 52 and flex piece 60 can be fabricated as a single piece, an advantage which reduces the number of required manufacturing processes, the number of components of which the cosmetic case is comprised, and the number of assembly processes needed to produce the cosmetic case. Moreover, as flex piece 60 is an integral part of inner tray 52, flex piece 60 will not rattle, vibrate, or come loose within the cosmetic case structure.

Figure 25:
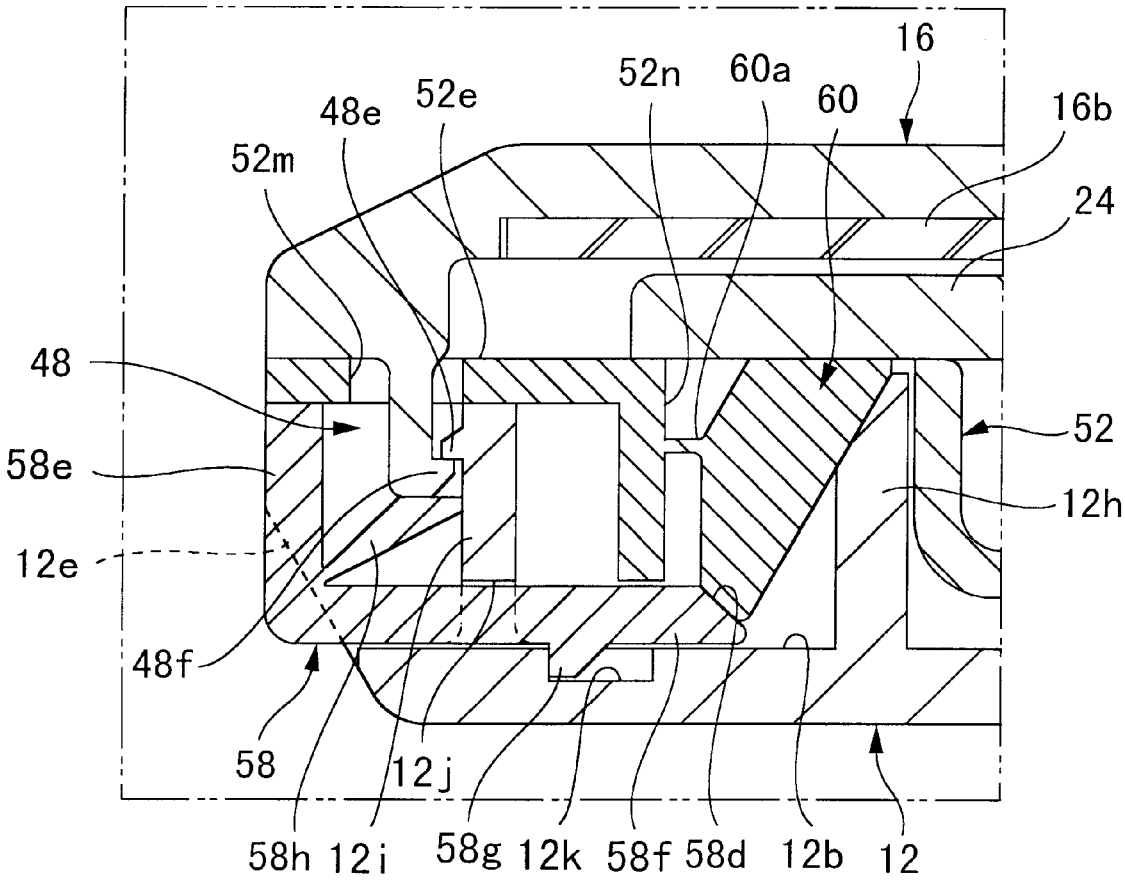
FIG. 25 is a modified example of the FIG. 23 mechanism.
Figure 26:
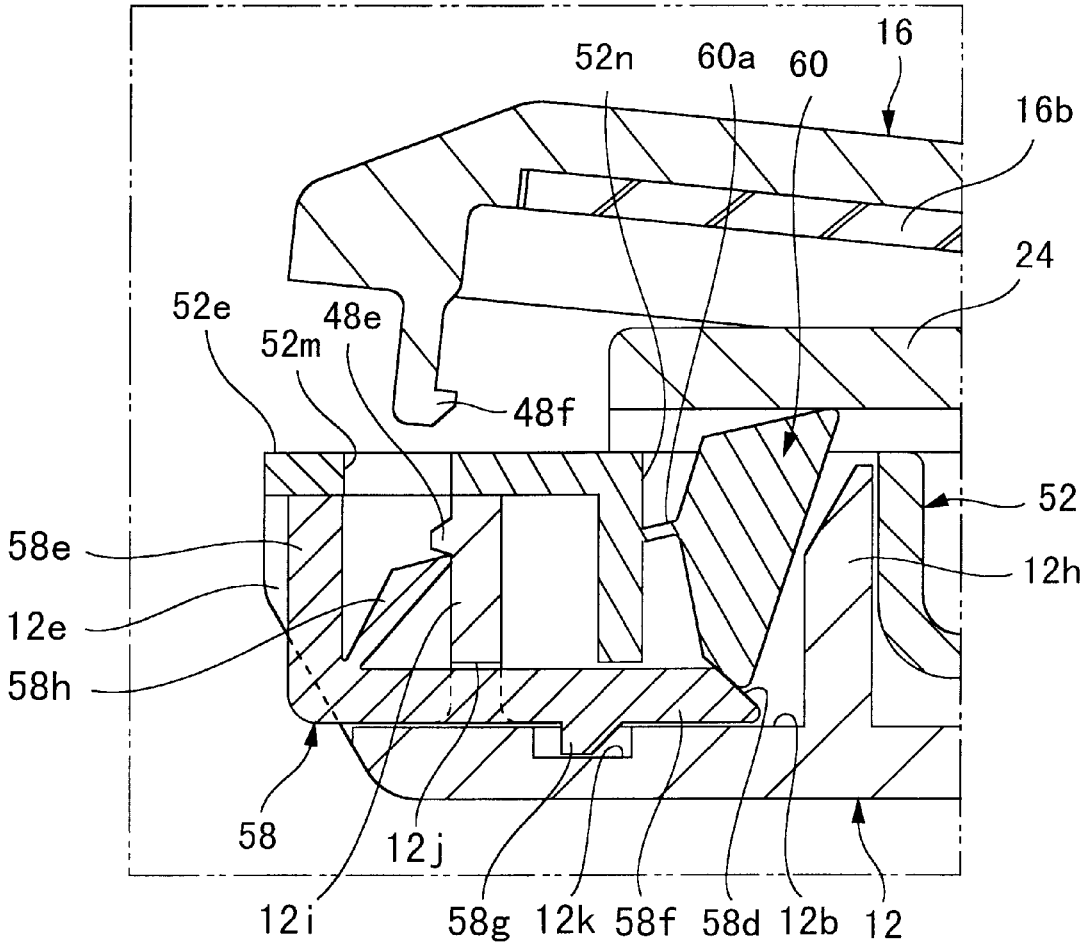
FIG. 26 is a modified example of the FIG. 23 mechanism.

FIGS. 25 and 26 describe other possible modifications of the flex-piece type of latch release mechanism.

First latch 48*e* of main latch mechanism 48 is not formed as part of the push-piece 48, but as an integral component of outer case 12, and therefore can be released by the forward movement of inclined piece 58*h* which is a integral component of push-piece 58. Specifically, latch 12*i* is formed within cutout section 12*e* of outer case 12. First latch 48*e* is formed as a protrusion on the upper extremity of latch 12*i*. Push-piece 58 is formed as an L-shaped structure comprised of operating part 58*e* and horizontal slide bar 58*f*. Inclined piece 58*h* protrudes out and inclines upward in a rearward direction from the rear surface of touch part 58*e*. The upper edge of inclined piece 58*h* is positioned against the front surface of first latch 48*e* and the lower edge of second latch 48*f* when both latches are forming a locked joint.

Slide bar 58*f* inserts through passageway 12*j* formed at the lower end of latch 12*i*. Inclined end surface 58*d* is formed on the extremity of slide bar 58*f* and contacts the lower end of flex piece 60. Stop dog 58*g* is formed on the bottom surface of slide bar 58*f* and rides in guide channel 12*k* in floor 12*b* of outer case 12 so as to limit the amount of outward travel of push-piece 58.

As shown by FIG. 25, depressing push-piece 58 when outer cover 24 is in a closed condition will result in inclined piece 58*h* riding up latch 12*i*, and as shown in FIG. 26, pushing up and releasing second latch 48*f*, and thereby releasing main latch mechanism 48. At the same time, inclined surface 58*d* of slide bar 58*f* pushes up flex piece 60 (as previously discussed in the fourth embodiment), thereby releasing latch mechanism 50.

Figure 28:
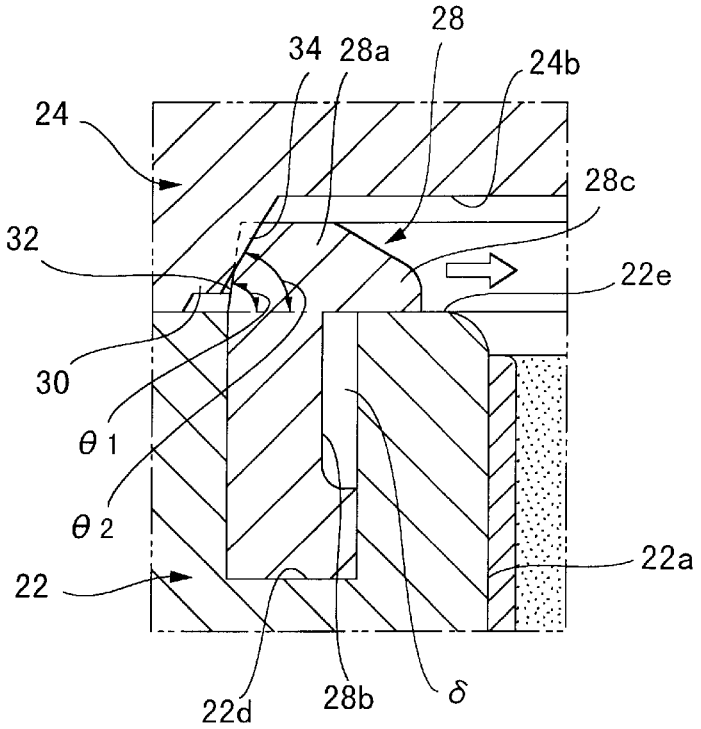
FIGS. 28 through 37 are possible modifications of the sealing mechanism shown in FIG. 27.
Figure 29:
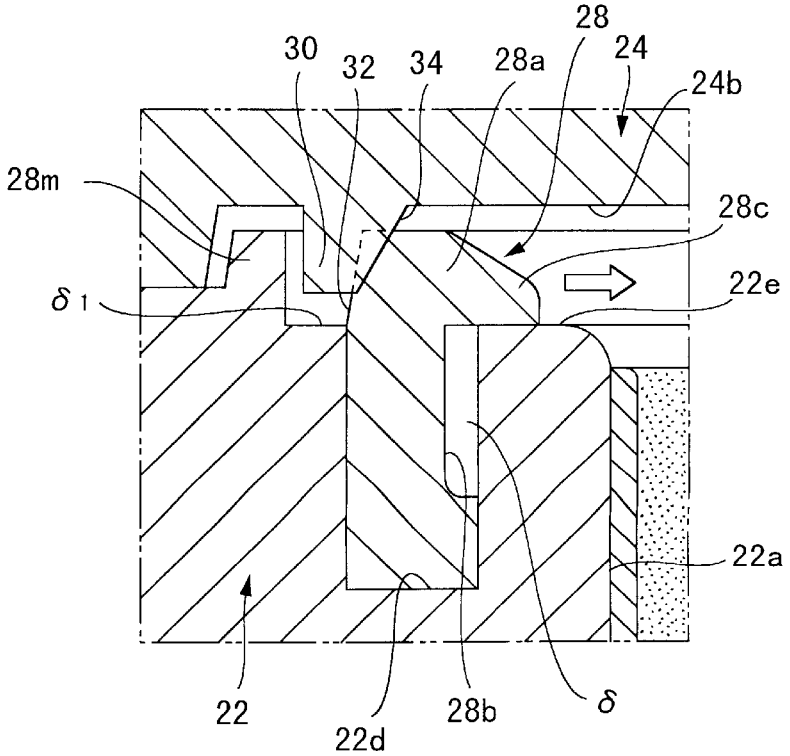
Figure 30:
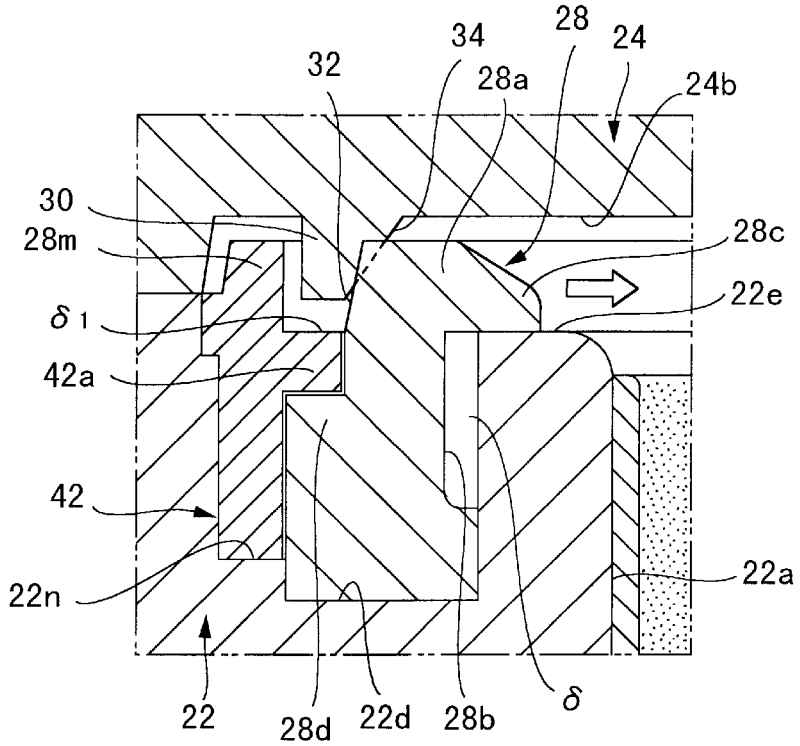
Figure 33:
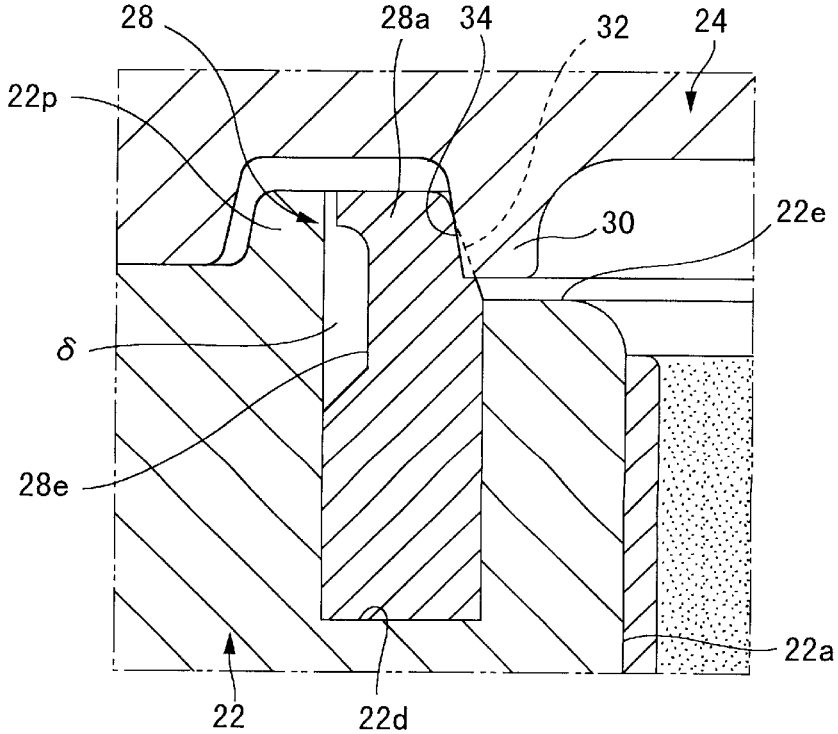
Figure 34:
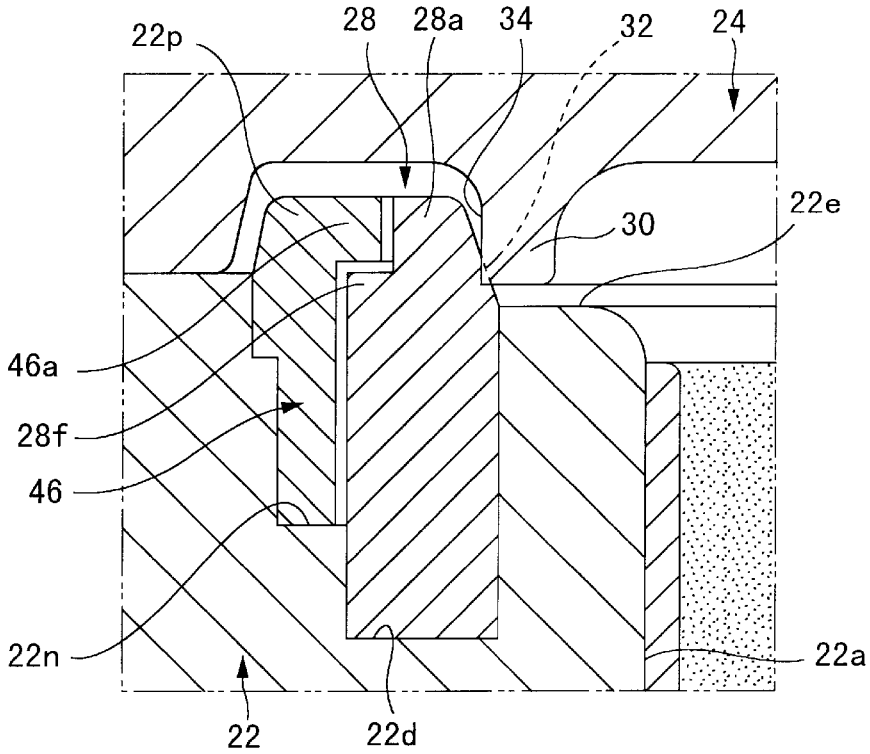
Figure 35:
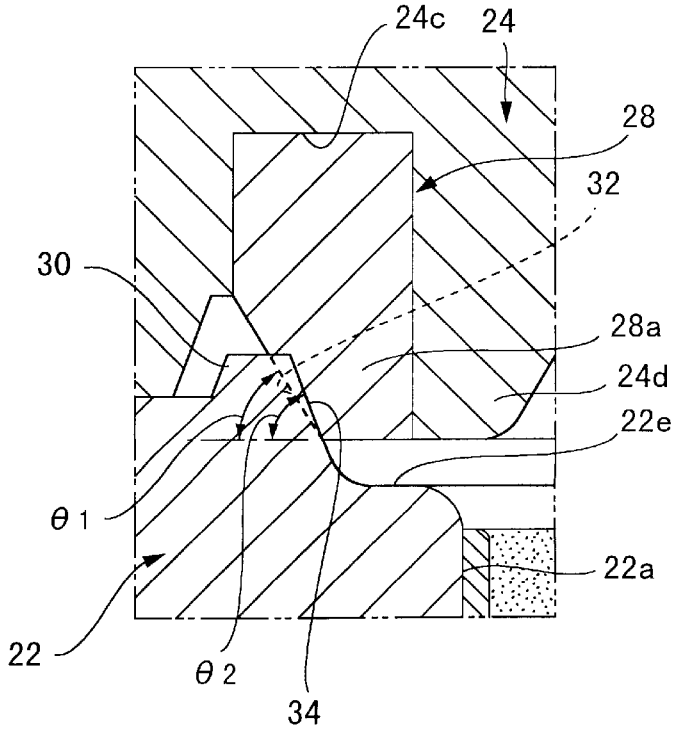
Figure 36:
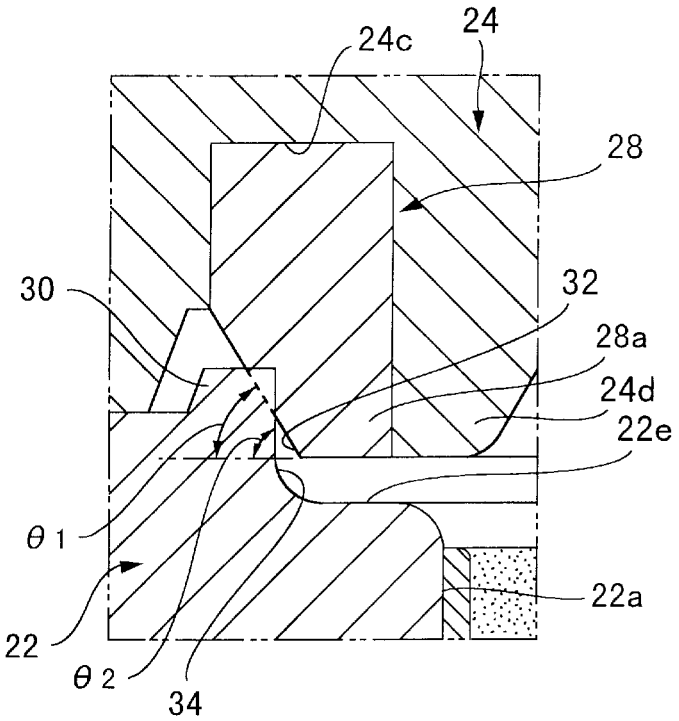
Figure 37:
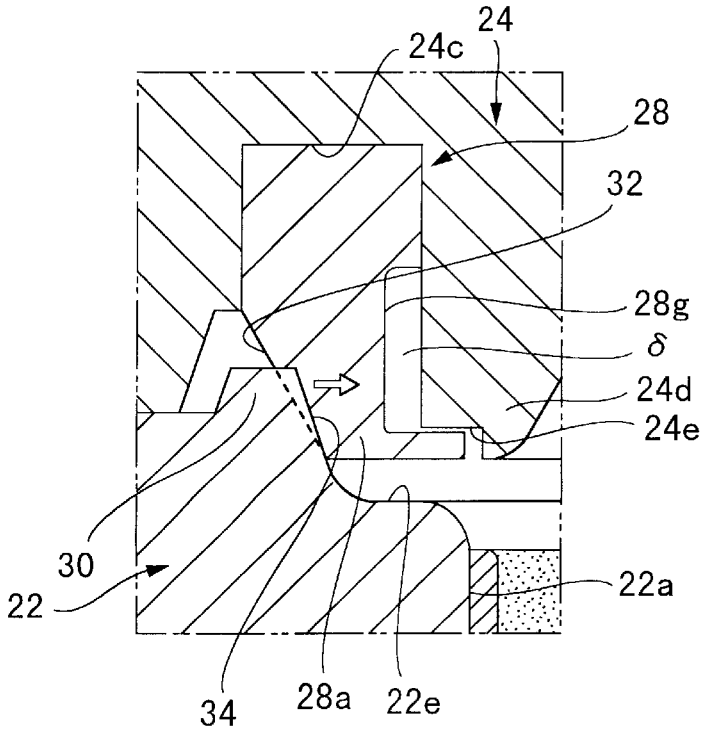

FIGS. 28 through 37 present additional embodiments of the sealing mechanism applied to seal cosmetic container 22*a*. As discussed previously, refill case 20 is a replaceable type which can be installed to or removed from cosmetic case 10 and utilized as what is generally referred to as a "compact." FIGS. 28 through 30 illustrate the sealing mechanism as the previously discussed embodiment in which ring-shaped sealing ridge 30, which is formed on the lower surface of inner cover 24, applies pressure to the outer circumference of seal head 28*a* of sealing ring 28. FIGS. 31 through 34 illustrate a type of sealing mechanism whereby sealing ridge 30, which is formed on the lower surface of inner cover 24, applies pressure to the inner circumference of seal head 28*a*. FIGS. 35 through 37 illustrate a sealing mechanism in which sealing ring 28 is installed to inner cover 24, and sealing ridge 30 is formed on inner cases 22.

In the FIG. 28 structure, angle "θ2" of second inclined surface 34, formed on sealing ridge 30 of inner cover 24, is established as smaller than angle "θ1" of first inclined surface 32 (formed on seal head 28*a* of sealing ring 28). This structure provides the same operating mechanism and effect as the aforementioned sealing mechanism embodiment. While the figure shows angle "θ2" of second inclined surface 34 as smaller than 90 degrees, this angle may also be established as larger than 90 degrees.

FIG. 29 shows a sealing structure in which a gap is formed on the upper surface of inner case 22 at the periphery of sealing ring 28 by means of upwardly facing ring-shaped protrusion 28*m*. Protrusion 28*m* defines the inner and outer areas of cosmetic container 22*a*, and is formed at a level higher than inner surface 22*e*.

In this embodiment, space 1161 is formed between sealing ring 28 and ring-shaped ridge 28*m* as a means of preventing cosmetic material from collecting on the outer perimeter of cosmetic container 22*a*.

In FIG. 30, ridge 28*m* is formed by means of separate ring piece 42 which is installed to the top perimeter of inner case 22 at the outer circumference of sealing ring 28. Circular groove 22*n* is formed at the outer periphery of seal ring 28 as a means of providing installation space for separate ring piece 42. Lip 42*s* is formed on the inner circumference of ring piece 42 and extends over sealing ring outer lip 28*d* as a means of retaining sealing ring 28.

In this embodiment, ring piece 42 provides means of securing sealing ring 28 to inner case 22 by retaining said ring within groove 22*d* at the outer perimeter of sealing ring. This structure provides a more convenient means of installing sealing ring 28 as compared to the more difficult process of pressure inserting an elastic ring into a groove.

Figure 31:
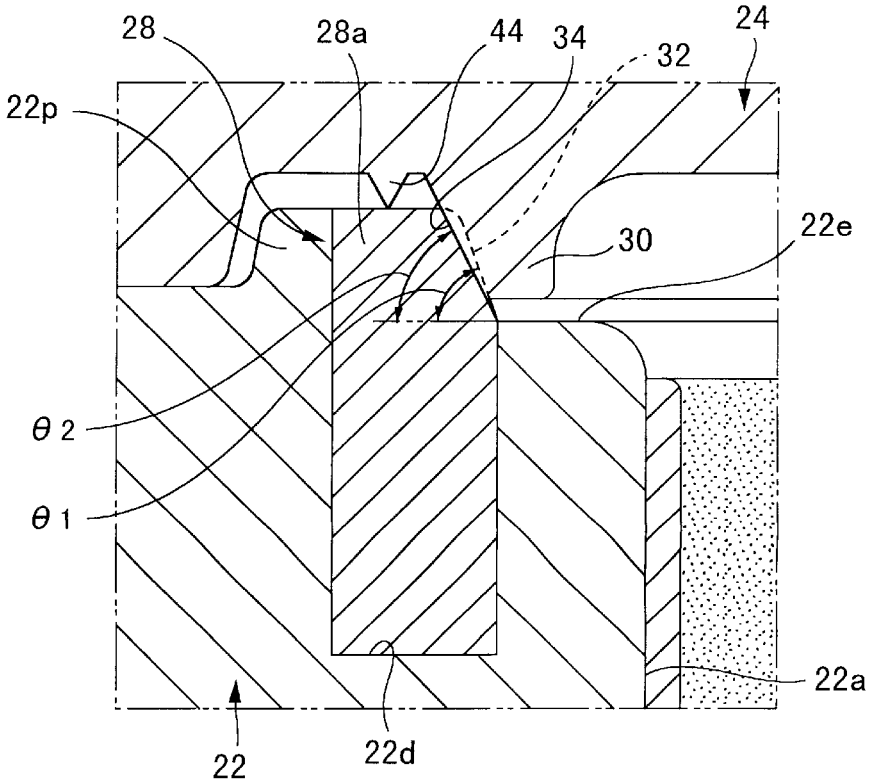

In the embodiment shown in FIG. 31, sealing ring 28 is installed within ring groove 22*d* formed at the outer perimeter opening of cosmetic container 22*a*, and first inclined surface 34 is formed on the upper inner periphery of sealing ring 28. Ring-shaped sealing ridge 30 is formed on the underside of inner cover 24 at the inner periphery of sealing ring 28, the outer circumference of ridge 30 being in pressure contact against second inclined surface 34. First inclined surface 32 angle "θ1" is established as a larger angle than second inclined surface 34 angle "θ2". The top of protruding part 22*p* is established at approximately the same height as the top of seal head 28*a* as means of preventing the outward deformation of seal head 28*a*. Compression ridge 44 is formed as a radial protrusion of inner cover 24, is positioned at the top surface of seal head 28*a*, and will come into pressure contact with the top of seal head 28*a* when inner cover 24 is in a closed condition.

When inner cover 24 is in the process of closing, any cosmetic material, which may be adhering to second inclined surface 34 of inner cover 24 and first inclined surface 32 of sealing ring 28, is removed as a result of the mutual abrasive rubbing action generated on surfaces 32 and 34, thus providing an effective self-cleaning effect for the sealing mechanism. Moreover, when inner cover 24 is completely closed, compression ridge 44 is in pressurized contact with sealing ring 28, thus creating an additional sealing point to increase the effectiveness of the sealing mechanism.

Figure 32:
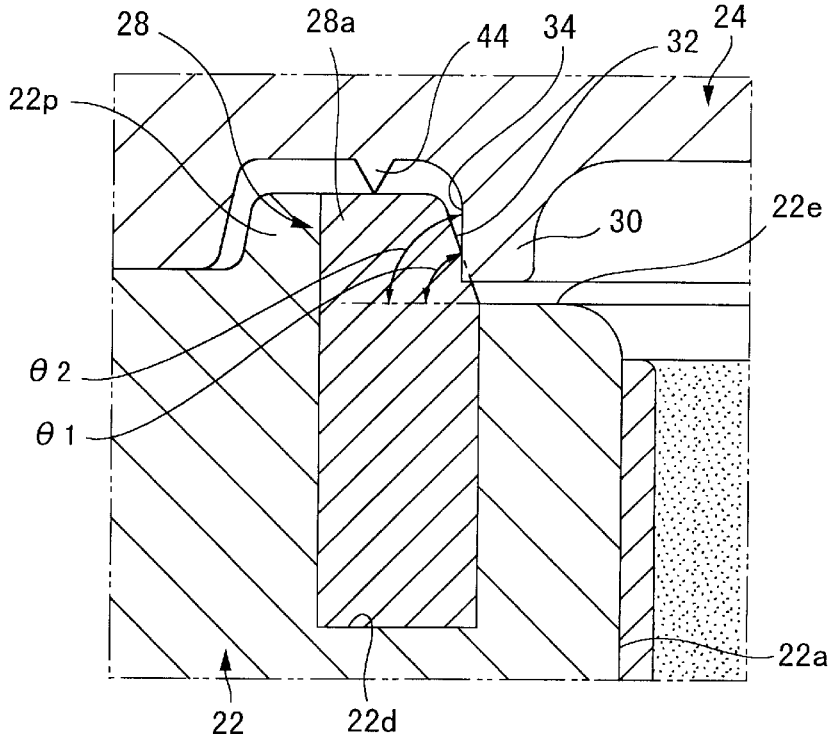

FIG. 32 presents a sealing mechanism in which second inclined surface 34 angle "θ2" on ridge 30 is established as a significantly larger angle than that of first inclined surface angle 32 on seal head 28*a*, angle "θ2" being so inclined as to form an approximate right angle. Moreover, angle "θ2" may be further established as exceeding 90-degrees.

FIG. 33 presents a sealing mechanism in which sealing ring groove 28*e* is formed on the upper outer periphery of sealing ring 28 opposite to first inclined surface 32. Groove 28*e* results in a smaller adjacent sealing ring cross section, thereby aiding the elastic deformation within that area. Furthermore, groove 28*e* provides space "δ" within groove 22*d* as an area into which sealing ring 28 can elastically expand in an outward direction. This embodiment provides means for a highly efficient sealing effect for cosmetic container 22*a* whereby sealing ring 28 is allowed to elastically deform in an outward direction during the mutual abrasive rubbing action occurring between inclined surfaces 32 and 34.

FIG. 34 describes a sealing mechanism whereby protruding part 22*p* is formed separately from inner case 22 by means of separate ring part 46 which is in contact with the outer circumference of sealing ring 28. Groove 22*n* is formed at the outer circumference of sealing ring 28 to provide an installation space for ring part 46. Lip 46*a* is formed on the upper inner perimeter of ring part 46, and edge 28*f* on the upper outer circumference of sealing ring 28, lip 46*a* serving as means of retaining sealing ring 28 through contact at edge 28*f*.

In this embodiment, sealing ring 28 is effectively secured to inner case 22 by means of ring part 46 and groove 22*d*, ring part retaining sealing ring 26 at said ring's outer circumference. This structure also provides easier means of installing sealing ring 28 to inner case 22 as compared to the more difficult process of pressure inserting an elastic ring into a groove.

FIG. 35 describes a sealing mechanism in which ridge 30 is formed on the upper circumference and as an integral part of cosmetic container 22*a*. In this embodiment, sealing ring channel 24*c* is formed on the lower surface of inner cover 24 opposite to ridge 30, and sealing ring 28 is installed to ring channel 24*c*. Seal head 28*a* is formed at the lower end of sealing ring 28, first inclined surface 32 is formed on the outer circumference of sealing ring 28. and second inclined surface 34 is formed on the inner periphery of ridge 30 opposite to first inclined surface 32. First inclined surface 32 angle "θ1" is established as a smaller angle than that of second inclined surface 34 angle "θ2". The upper surface of inner case 22 formed by ridge 30 resides at a higher point than surface 22*e* which is located at the lower inner periphery of ridge 30. Edge 24*d* is formed at the lower inner perimeter of ring channel 24*c* at a position approximately equal to the lower extremity of seal head 28*a*, and functions so as to prevent the inward expansion of sealing ring 28.

As a result of this structure, first inclined surface 32 on seal head 28*a* comes into contact with second inclined surface 34 on ridge 30 when inner cover 24 closes, and a mutual abrasive rubbing action is generated between surfaces 32 and 34 to remove any adhering cosmetic material off of ridge 30 and sealing ring 28. Resultantly, this mechanism provides means of cleaning the sealing surfaces when inner cover 24 is closing.

FIG. 36 describes a sealing mechanism in which second inclined surface 34 angle "θ2", formed on ridge 30 of inner case 22, is established as an approximate right angle and as an angle greater than angle "θ1" of first inclined surface 32 on seal head 28*a*. In this case angle "θ2" may also be established as greater than 90-degrees.

FIG. 37 describes a sealing mechanism in which sealing ring groove 28*g* is formed on the inner circumference of seal 28 opposite to first inclined surface 32. Ring channel 28*g* forms a smaller adjacent cross section within seal 28 thereby aiding in the seal's elastic deformation. Ring channel 28*g* also creates space "δ" which allows sealing ring 28 to deform in an inward radial direction. This structure provides increased sealing efficiency by utilizing the inward deformation of sealing ring 28 to improve the mutual abrasive rubbing action occurring between inclined surfaces 32 and 34. Moreover, as sealing ring 28 is deformed in the inward direction as a result of the pressure applied by ridge 30 to seal head 28*a*, cutout section 24*e*, formed within edge part 24*d*, limits the sliding length of seal head 28*a*. This mechanism not only provides for a cosmetic material removal effect resulting from the mutually abrasive rubbing action between the sealing surfaces, but also establishes an appropriate level of elastic deformation to maximize the cleansing action.

The aforementioned embodiments of the cosmetic case invention as relating to the cutout section 12*d* provided for hinge part 26 of refill case 20, the structures of container space 18 and ribs 18*e*, the configuration of container space 18 and orifice 12*f*, the sealing mechanisms formed by sealing ring 28 and ring ridge 30, and the design of the push-piece assembly are not limited solely to the embodiments presented here, but encompass other embodiments and variants which may become apparent to those skilled in the art.

Figure 38:
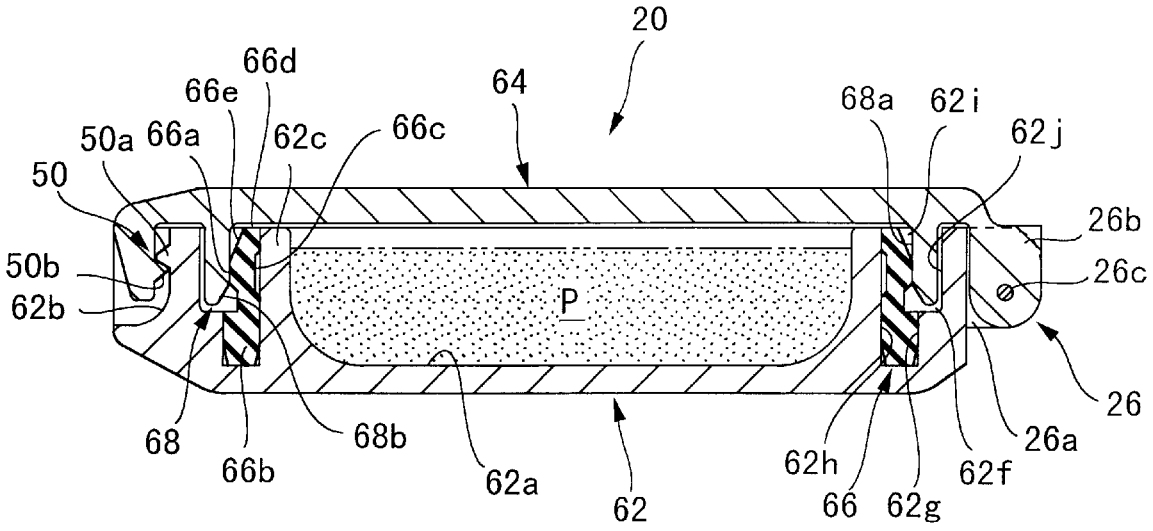
FIG. 38 is a lateral cross sectional view of a modification of the sealing mechanism used in the cosmetic case invention.
Figure 39:
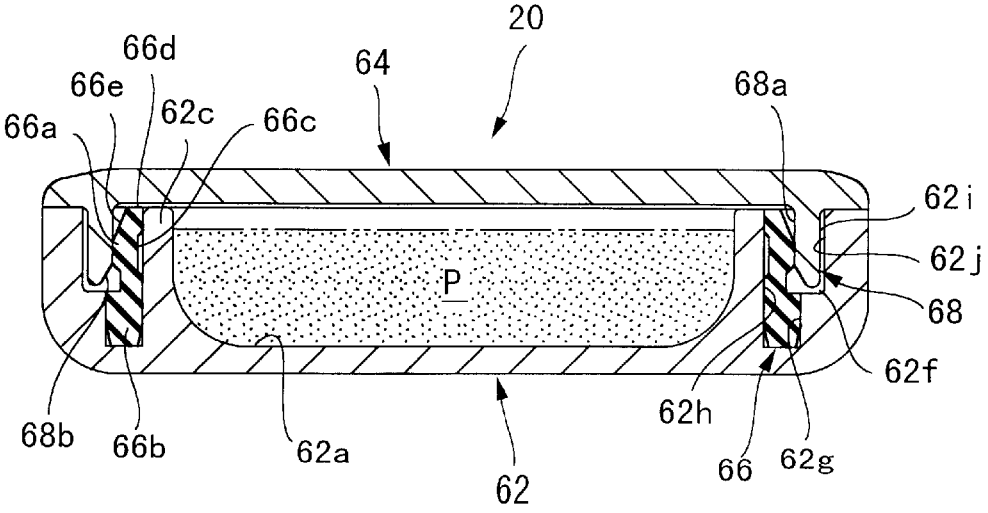
FIG. 39 is a front cross sectional view of the case shown in FIG. 38.

FIGS. 38 and 39 describe refill case 20. The basic structure of refill case 20 is comprised of main body 62 on which cosmetic container 62*a* is formed, and cover part 64 rotatably installed to main body 62 so as to cover or reveal the inner area of cosmetic container 62*a*. Sealing ring 66 is installed around the peripheral opening of cosmetic container 62*a* formed within main body 62, and expanded seal part 66*a* is formed on the outer periphery of sealing ring 66. Cover 64 forms a joint with the outer periphery of sealing ring 66 by means of cylindrical rib 68 which has an inner diameter smaller than the outer diameter of expanded seal part 66*a*. While cover 64 is moving to a closed position, inner surface 68*a* of rib 68 simultaneously rubs against and compresses the largest external diameter area of expanded seal part 66*a* of sealing ring 66.

Cover 64 is pivotably installed to main body 62 by means of hinge 26 so as to cover or expose the inner area of cosmetic container 62*a*. Latch 50 is employed at the front edge and between main body 62 and cover 64 as means of maintaining cover 64 in a closed condition. Outer hinge part 26*b*, formed as an extended section of the center rear part of cover 64, is installed over inner hinge part 26*a* which is formed as an extended section of the center rear part of main body 62. Hinge pin 26 is inserted through outer hinge part 26*b* and inner hinge part 26*a*. Hinge 26 is structured so as to provide sufficient play as means of allowing cover 64 to smoothly and evenly compress sealing ring 26. Latch mechanism 50 is comprised of first latch 50*a* formed within recess 62*b* at the center front edge of main body 62, and second latch 50*b* formed as an extension of cover 64 at the center front edge thereon. First latch 60*a* and second latch 50*b* interlock to form a secured latching mechanism when cover 63 is in a closed condition.

Sealing ring 66 is formed from rubber or other elastic material and is installed within channel 62*f* located around the external perimeter of the opening to cosmetic container 62*a*. Lower seal part 62*g* is formed at the bottom of sealing ring 66 and is inserted within lower channel 62*f* and compressed by inner walls 62*h* to prevent inner radial movement of the seal. Seal groove 66*c* is provided on the inner circumference of sealing ring 66, opposite to expanded seal part 66*a*, to allow the inward radial deformation of expanded seal part 66*a*.

Figure 40:
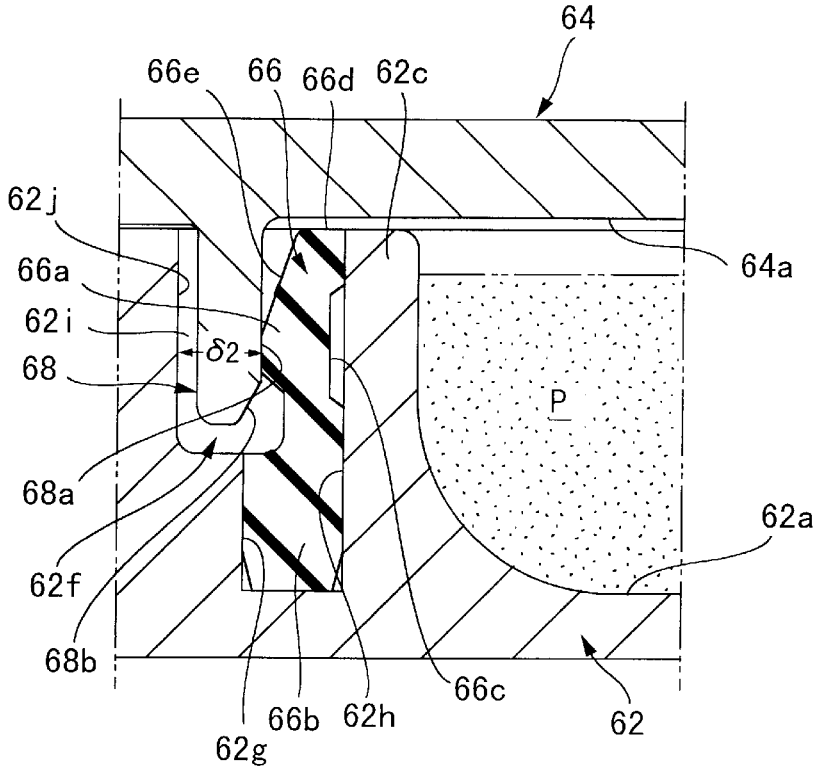
FIG. 40 is an enlarged view of the sealing mechanism of the FIG. 38 cross section.

The upper area of expanded seal part 66*a* is positioned in area 62*i* formed within ring channel 62*f*. The area between the largest external diameter of outer seal part 66*a* and inner wall of channel 62*f* defines space "δ2" into which cylindrical lip 68 enters as it compresses outer seal part 66*a*. As shown in FIG. 40, taper face 66*e* starts from top surface 66*d* of sealing ring 66 and inclines downward to form a diametrically increasing dimension. The cross section of outer seal part 66*a* turns inward sharply soon after the largest diameter formed by taper face 66*e*. While top surface 66*d* of sealing ring 66 is established at the same height as outer wall 62*c* of cosmetic container 62*a*, establishing said height a small amount over or under that of outer wall 62*c* will have no adverse effect.

Cylindrical rib 68 is structured as a low cylinder shape integral with bottom surface 64*a* of cover 64, along a path prescribed by the contour of sealing ring 66, and to a smaller inner diameter than the outer diameter of sealing ring 66. As a result of these structures, rib 68 forms a joint at the outer circumference of sealing ring 66 by sliding over the sealing ring and compressing expanded seal part 66*a*. Chamfered section 68*b* is provided on the extremity of the inner circumference of rib 68 as a means of guiding rib 68 over sealing ring 66.

When cover 64 is in a closed condition, inner wall 68*a* of cylindrical rib 68 is in pressure contact with the outer diameter of outer seal part 66*a*, and thus provides for an effective seal of cosmetic container 62*a*. This type of sealing mechanism is able to maintain cosmetic material P in a desirable and usable condition by preventing the evaporation of any solvents contained therein.

Moreover, as sealing ring 66 is in proximity to cosmetic container 62*a*, using a puff or other like implement to remove cosmetic material P from container 62 will commonly result in some of the cosmetic material falling onto the sealing ring. In this embodiment, the closing action of cover 64 will generate an abrasive rubbing action between rib 68 and expanded seal part 66*a*, a rubbing action which has the effect of removing any cosmetic material P which may have adhered to sealing ring 66. With cover 64 in a closed condition, a tight and effective seal is provided as a result of the pressurization of expanded seal part 66*a* by cylindrical lip 68 at a sealing surface which has been cleaned of cosmetic material residue.

Figure 41:
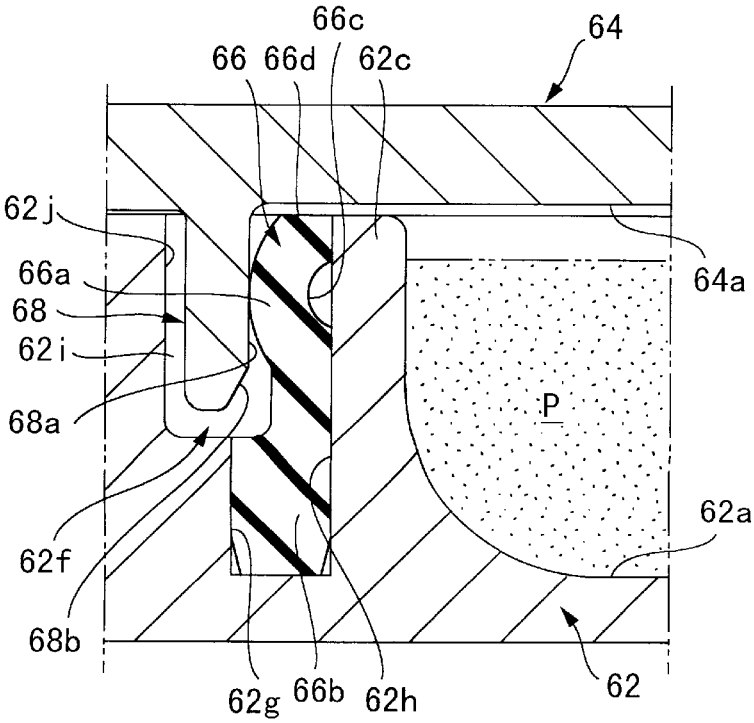
FIG. 41 is a modified version of the FIG. 40 sealing mechanism.

FIG. 41 describes a further embodiment of the sealing mechanism in which outer seal part 66*a* is formed as a partial round cross section around the perimeter of sealing ring 66. Round channel 66*c* is formed on the inner periphery of sealing ring 66 as a similar cross section opposite to outer seal part 66*a*. This structure also provides for the formation of an abrasive rubbing action type of sealing action between the inner perimeter of cylindrical lip 68 and the outer circumference of outer sealing part 66*a*. An effective seal is formed for cosmetic container 62*a* as a result of outer seal part 66*a* being compressed by the inner circumference of cylindrical lip 68 on a sealing surface which has been cleaned of cosmetic material residue.

Figure 42:
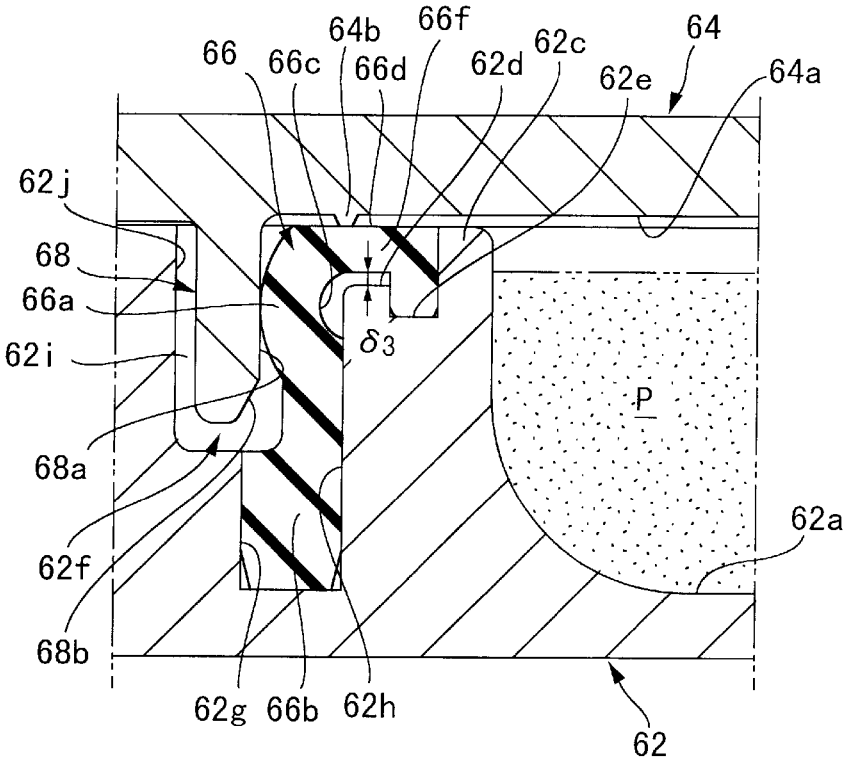
FIG. 42 is an addition modified version of the sealing mechanism shown in FIG. 40.

FIG. 42 describes a further embodiment of the sealing mechanism in which, similar to that shown in FIG. 41, outer seal part 66*a* is formed to partial round cross section. In this modification, however, step part 62*d* is formed at the upper area of wall 62*c* of cosmetic container 62*a*, the outer circumference of step 62*d* being formed lower than its inner circumference. Ring channel 62*e* is formed at the bottom of step 62*d* around the perimeter of wall 62*c*. The end of sealing ring 66 extends into step 62*d* along the entire circumference. Space "δ2" is formed in the area between the bottom of seal extension part 66*f* and step 62*d*. The tip of seal extension part 66*f* is secured within ring channel 62*e*. An inner area extending from extended seal part 66*a* to seal extension part 66*f* is open and separated from wall 62*c* by seal groove 66*c* and space "δ2".

Compression ridge 64*b* is formed on lower surface 64*a* of cover 64 and opposed to upper surface 66*d* of seal extension part 66*f*. When cover 64 is in a closed condition, ridge 64*b* compresses seal extension part 66*f*. As compression ridge 64*b* applies pressure on upper surface 66*d* of seal extension part 66*b* when cover 64 is closed, this pressure has the effect of further outwardly deforming outer seal part 66*a*, and thereby applying still further pressure against perimeter wall 68*a* of rib 68. The mechanism provides a further improvement in sealing efficiency.

Figure 43:
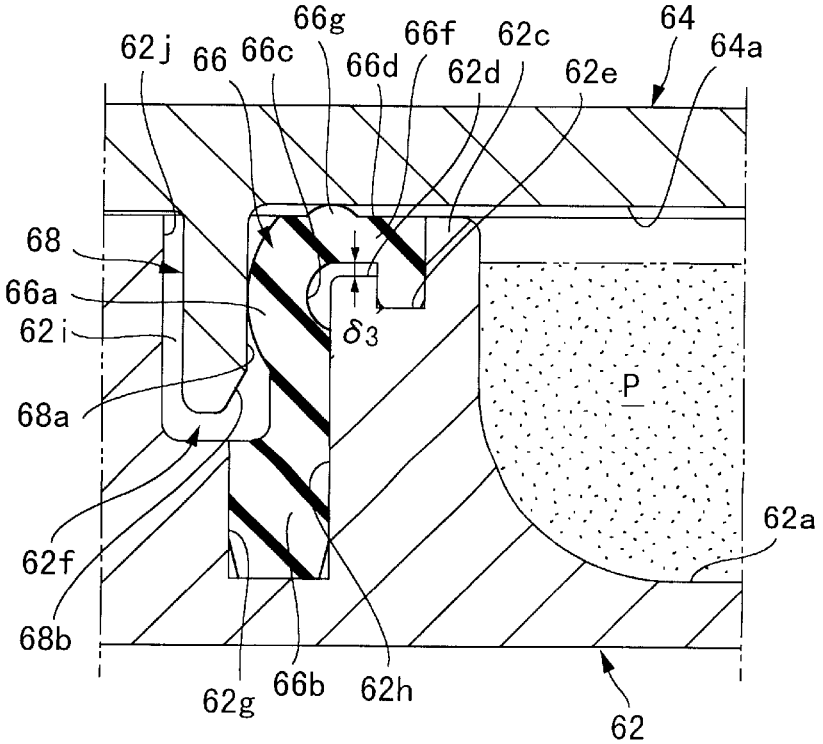
FIG. 43 is a still further modified version of the sealing mechanism shown in FIG. 40.

FIG. 43 describes a sealing structure similar to that shown in FIG. 42. Expanded seal part 66*a* is formed to partial round cross section, and top surface 66*d* extends along step 62*d* of wall 62*c* at the perimeter of cosmetic container 62*a*. Space "δ3" is formed between seal extension part 66*f* and step 62*d*, and the leading extremity of seal extension part 66*f* is secured within channel 62*e*.

In this embodiment, compression ridge 66*b* is formed on the upper surface of seal extension part 66*f* in proximity to underside 64*a* of cover 64. When cover 64 is in a closed condition, ridge 66*b* compresses seal extension part 66*f*. As ridge 66*b* provides for increased compression pressure on the upper surface of seal extension part 66*f* when cover 64*b* is closed, this pressure has the effect of further outwardly deforming outer seal part 66*a*, and thereby applying still further pressure against perimeter 68*a*.

While all of the aforementioned embodiments describe sealing ring 66 as being installed to main body 62, and cylindrical rib 68 to cover 64, it is also possible, and in certain cases may be preferable, to install sealing ring 66 to cover 64 and cylindrical rib 68 to main body 62 around the perimeter opening cosmetic container 62*a*.

Figure 44:
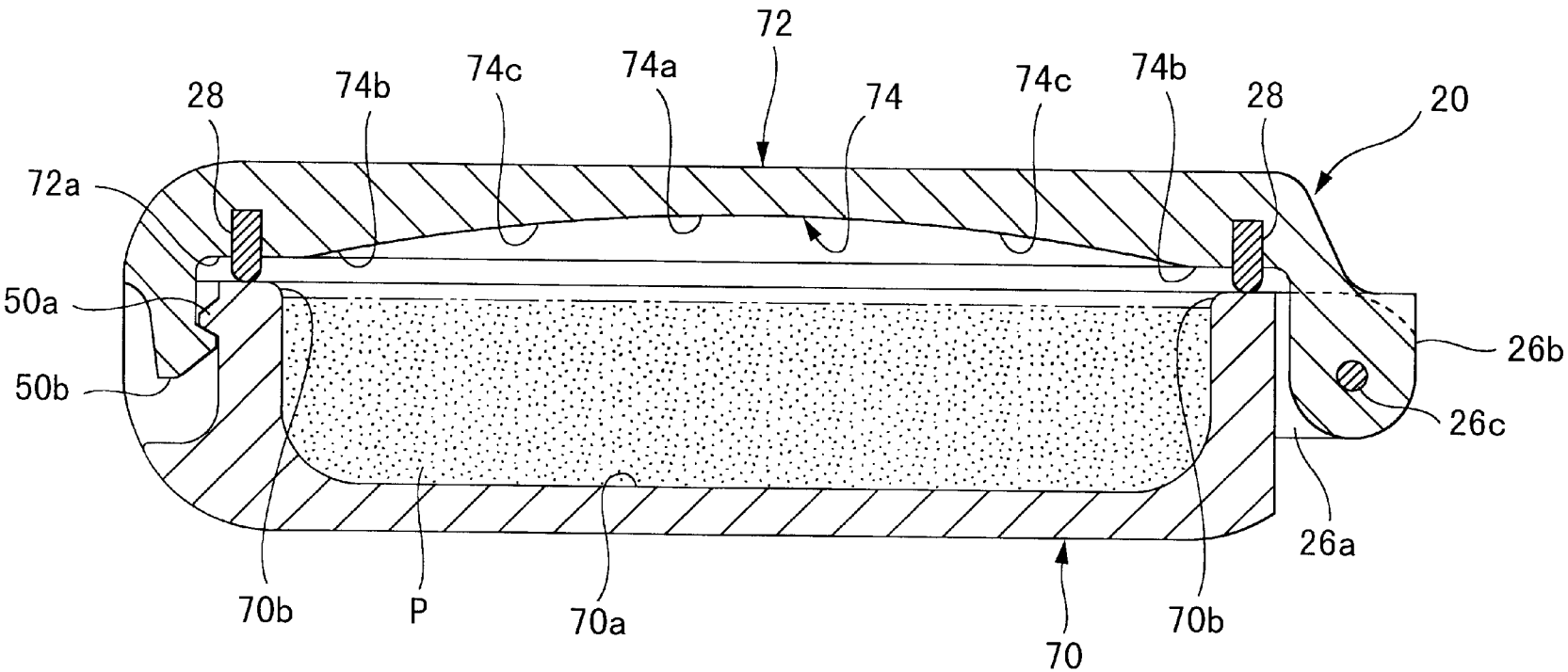
FIG. 44 is a lateral cross sectional view of the inner cosmetic case specified by the invention.

FIG. 44 presents a further embodiment of the cosmetic case invention in which refill case 20 is comprised of main case 70, as the cosmetic material containing space, and cover 72 which is capable of sealing said material containing space. As previously discussed, refill case 20 is a replaceable type capable of insertion to and removal from a main cosmetic case, and is further usable independently as what is commonly referred to as a compact. Main case 70 and cover 72 may be fabricated from polypropylene or other synthetic resin material. Recessed part 26*a* and extending part 26*b* are correspondingly formed on main case 70 and cover 72, and hinge pin 26*c* is inserted through outer hinge part 26*b* and inner hinge part 26*a* as means of pivotably attaching cover 72 to main case 70. First latch 50*a* and second latch 50*b* are provided at the opposite side or main case 70 and cover 72 from the hinge, both of said latch pieces being mutually connectable as means of maintaining cover 72 in a closed condition.

Cosmetic container 70*a* is formed as a flat bottomed round space within main case 70, and is filled with cosmetic material P which may include a large proportion of evaporable solvent material.

Sealing ring 28 is installed to inner surface 72*a* of cover 72, may be comprised of rubber or other similar elastic material, and is formed to provide an opening larger than that of cosmetic container 70*a*. When cover 72 is in a closed condition, sealing ring 28 provides a pressure seal against the upper perimeter of main case 70 around the opening to container 70*a*. Sealing ring 28 maintains the internal area of main case 20 in a sealed condition at this time.

Concave surface 74 is formed within the perimeter of sealing ring 28 on inner surface 72*a* of cover 72, and is of partial hemispherical shape. Curved inclined surface 74*c* is a radially expanding dome shape defined by ceiling part 74*a* and lower periphery 74*b*. The flat area at the perimeter of concave surface 74 is formed to the approximate same contour as that of cosmetic container 70*a*. When cover 72 in a closed condition, peripheral part 74*b* of concave surface 74 is positioned directly above peripheral part 70*b* of cosmetic container 70*a*.

Figure 45:
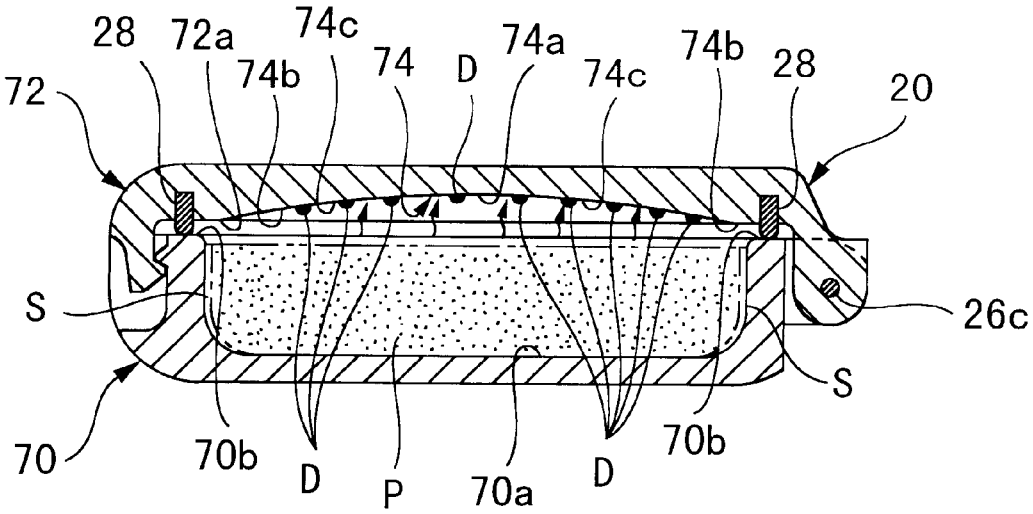
FIG. 45 is the FIG. 44 cross section with the addition of adhered condensed droplets.
Figure 46:
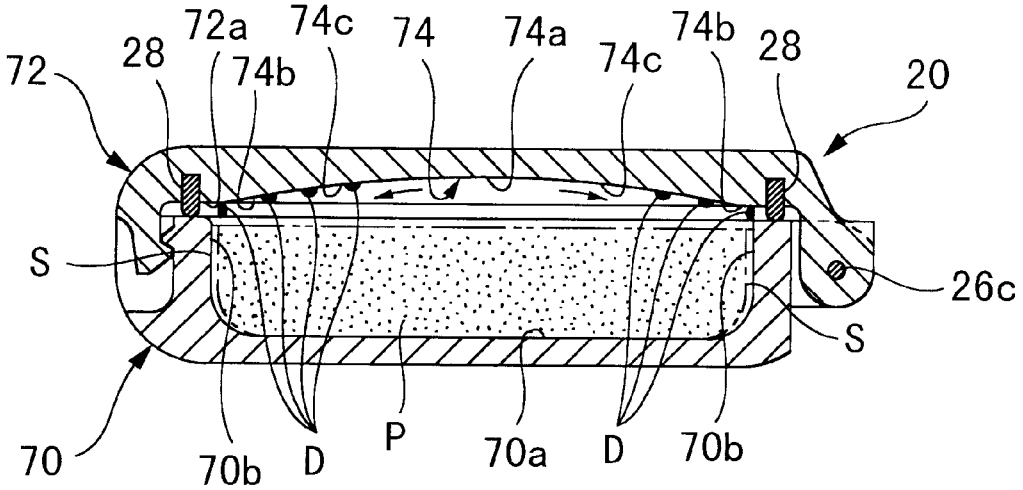
FIG. 46 is the FIG. 44 cross section with the addition of the flow movement of adhered condensed droplets.

FIGS. 45 and 46 describe a first embodiment of the mechanism which prevents condensation droplets from falling onto the cosmetic material surface. The placement of refill case 20 in a high temperature environment will hasten the evaporation of oil-based or other solvent components within cosmetic material P. Evaporated solvents are contained within the internal space of refill case 20 due to the sealing effect provided by sealing ring 28 until the ambient temperature falls, thus resulting in the cooling of refill case 20 and the condensation of the aforesaid solvents into multiple droplets that collect on inner surface 72*a* of cover 72.

Continuous condensation of the evaporated solvents will result in an increase of droplets D collecting on cover recess 74. Before dropping onto the cosmetic material, however, droplets D will flow, as shown in FIG. 46, from ceiling part 74*a* to outer perimeter 74*b* in an outward radial direction along curved inclined surface 74*c*. Upon reaching outer perimeter 74*b*, the lowest point on the inside of cover 72, droplets D will then fall onto the outer peripheral area of cosmetic material P.

In this manner, the flow of droplets D is controlled along curved inclined surface 74*c* to outer perimeter 74*b*, and thus droplets D are prevented from falling onto the center area of cosmetic material P. This mechanism results in the surface condition of material P being maintained in a visually pleasing, usable, and unadulterated condition.

Space S is formed between cosmetic material P and the inner perimeter of cosmetic container 70*a* as a result the shrinkage of cosmetic material P resulting from solvent evaporation. As this embodiment establishes the position of outer perimeter 74*b* of concave surface 74 and outer perimeter 70*b* of cosmetic container 70*a* at the same location, droplets D forming on concave surface 74 will flow to the perimeter area, fall into space S, and be eventually absorbed back into cosmetic material P.

Figure 47:
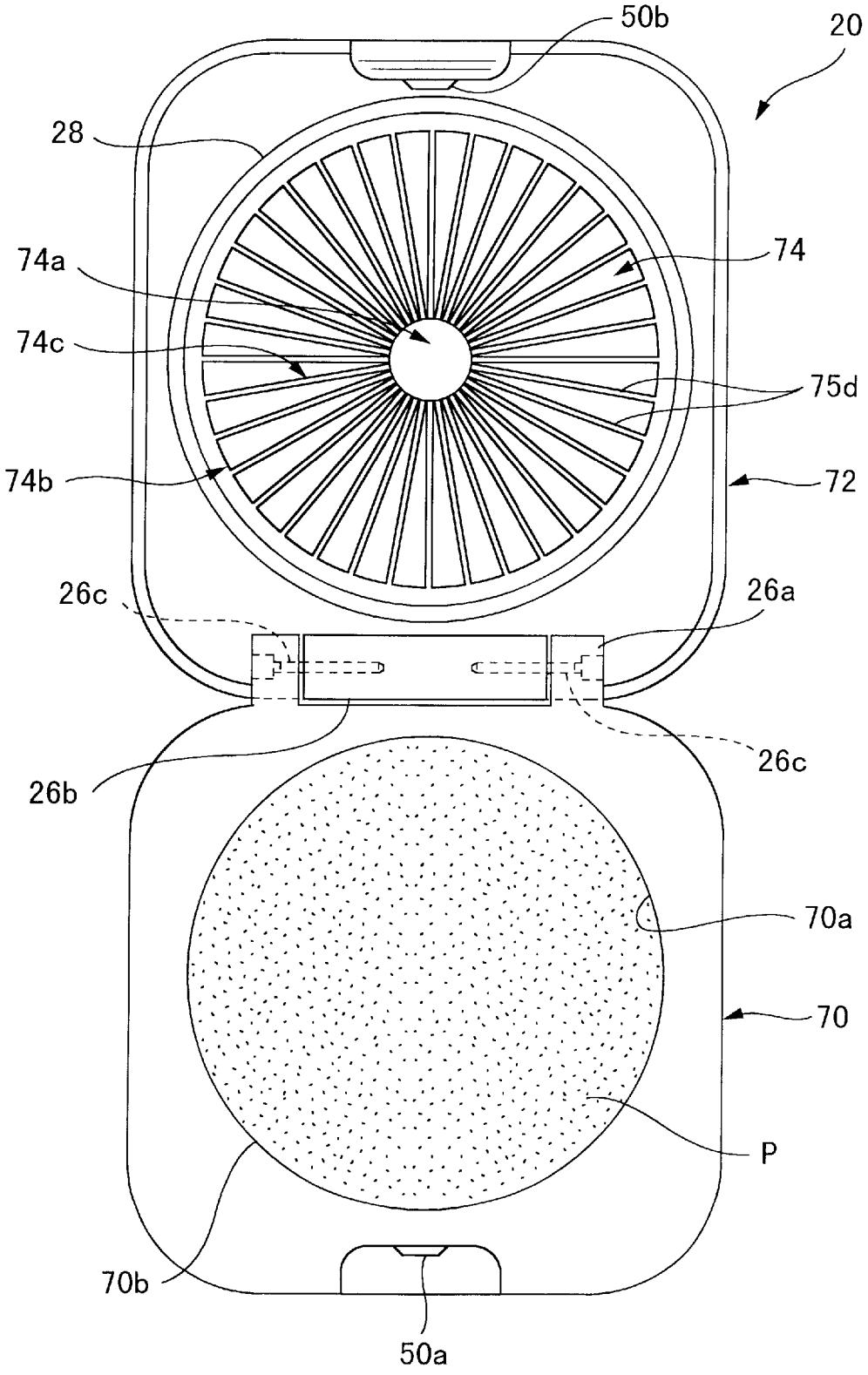
FIG. 47 is a plan view of a modification of the cosmetic case invention with the inner cover open.
Figure 48:
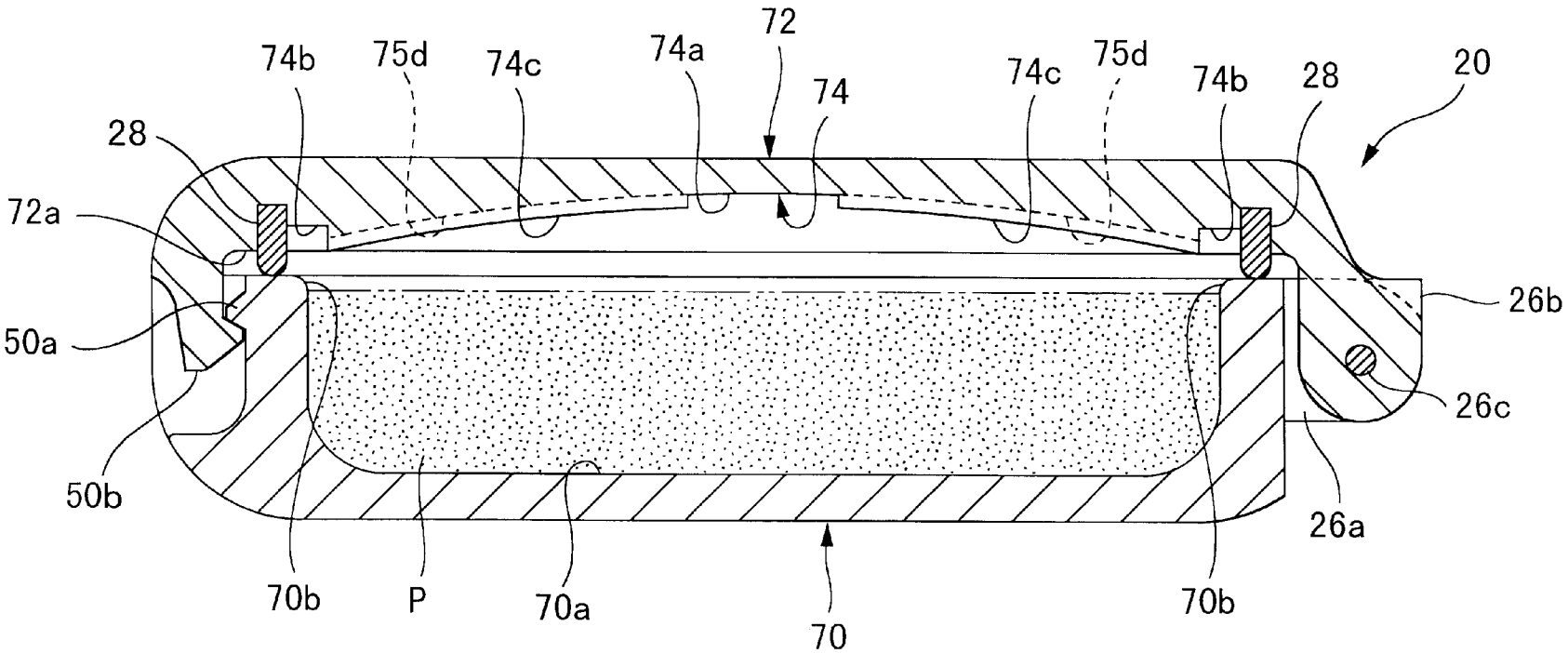
FIG. 48 is a lateral cross sectional view of the cosmetic case invention shown in FIG. 47.

FIGS. 47 and 48 describe a further embodiment of the mechanism to prevent the fall of condensation droplets within the refill case. In this embodiment, radially oriented grooves are formed on concave surface 74 as means of guiding condensation droplets to the peripheral area. As shown in FIG. 48, concave surface 74 is formed on inner surface 72*a* of cover 72, and a round recessed area is formed at ceiling part 74*a*. Radial channel 74*b* is formed as a ring-shaped recess at the perimeter of concave surface 74. Multiple radially dispositioned grooves 74*d* are formed on inclined concave surface 74*c* and connect to the aforesaid ring-shaped recess.

As a result of refill case 20 being structured in this manner, condensation droplets forming on concave surface 74*c* flow radially outward within grooves 74*d* to radial channel 74*b*. Droplets collecting in radial channel 74*b* then fall back onto the peripheral area of cosmetic material P, and are thus prevented from falling onto the center area.

Moreover, grooves 74*d* on concave surface 74 provide a larger surface area compared to a flat dome surface, thus promoting the condensation of solvent droplets within grooves 74*d*. Furthermore, as grooves 74*d* provide an enlarged surface area for the collection of condensation droplets, more droplets can be formed without the risk of prematurely falling. Moreover, radial grooves 74*d* generate a smooth and controlled flow of droplets along concave surface 74 to perimeter 74*b* where said droplets are disposed of.

While this embodiment prescribes refill case 20 as incorporating radial grooves 74*d*, these grooves can also be established as a stepped grooves following the radial contours of the inclined surface. This type of structure will also provide an effective condensate droplet disposal function as will other types of groove formations.

Figure 49:
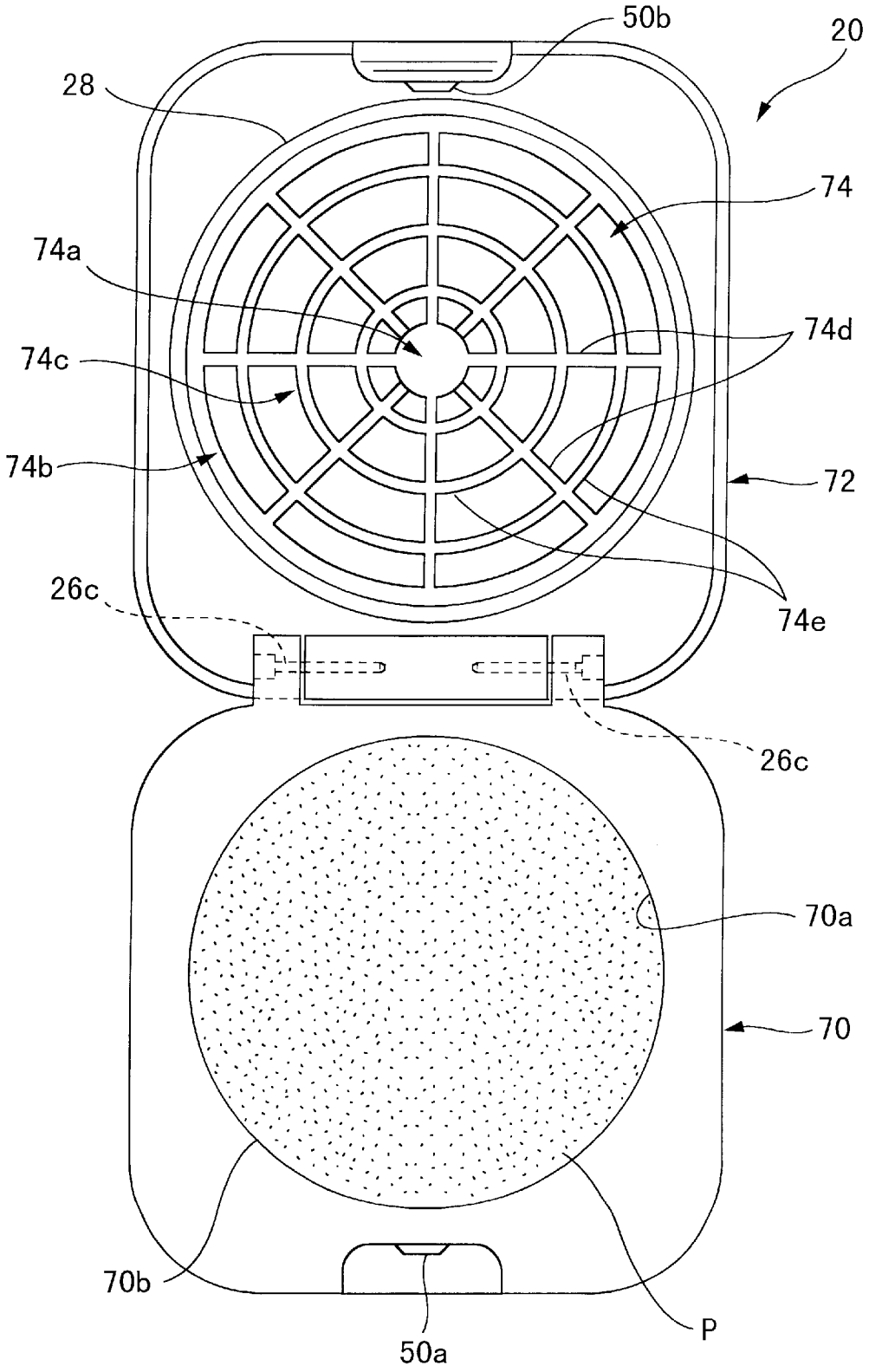
FIG. 49 is a plan view of a modified version of the cosmetic case invention.
Figure 50:
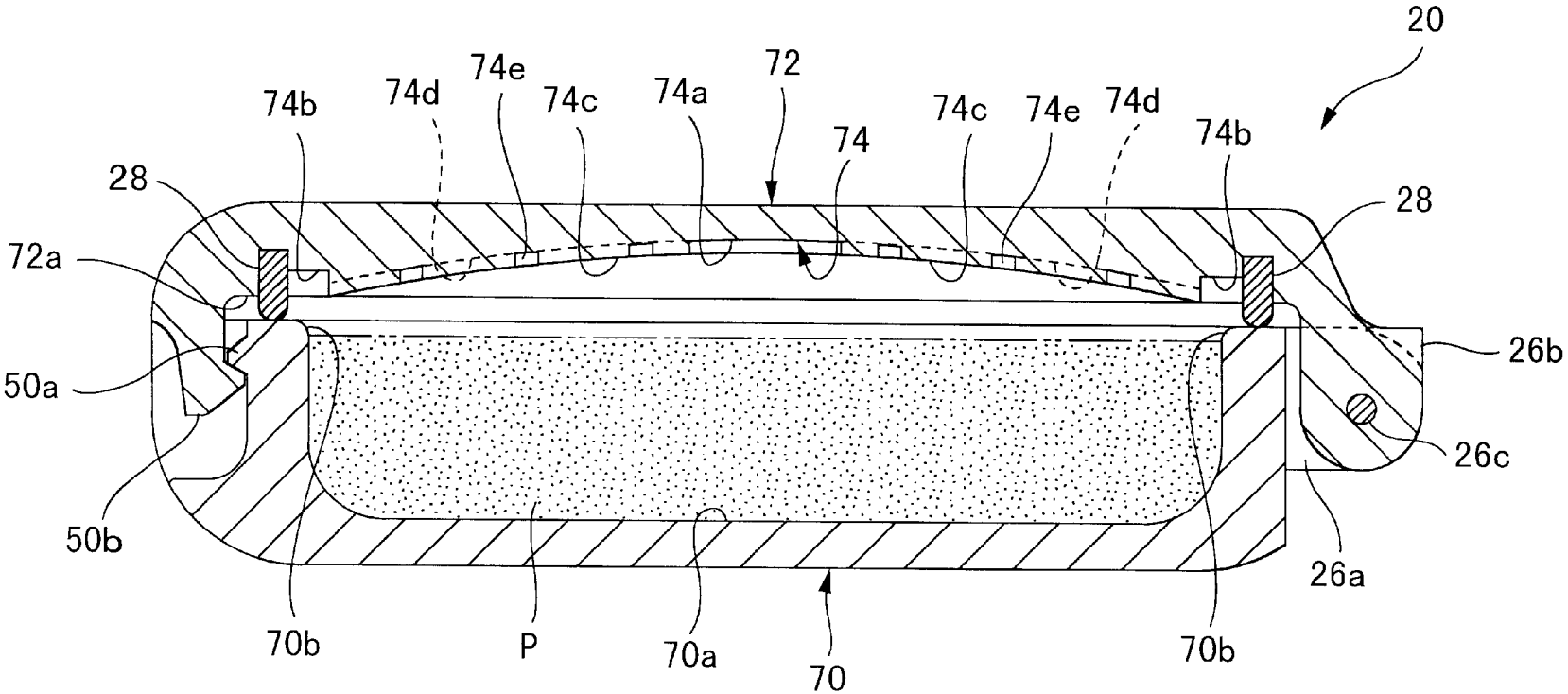
FIG. 50 is lateral cross section of the FIG. 49 view.

FIGS. 49 and 50 describe a modification of refill case 20 in which circumferential compartments are formed between the radial grooves shown in the FIG. 47 embodiment. In the FIG. 49 embodiment, concave surface 74 is formed on inner surface 72*a* of cover 72, and in addition to multiple radial grooves 74*d*, a multiplicity of concentric circular ridges form compartments 74*e* on inclined surface 74*c* with ceiling part 74*a* defining the center.

Thus structured, refill case 20 provides a mechanism by which condensation droplets not only flow along radial grooves 74*d* for disposal at perimeter 74*b*, but are also more efficiently collected by means of concentric circumferential compartments 74*e*. This structure of grooves 74*d* and compartments 74*e* also enlarges the effective surface area, thus propagating the condensation of evaporated solvents, preventing the premature falling of droplets onto the cosmetic material surface, and aiding the smooth flow of droplets along concave surface 74 to perimeter 74*b*.

Figure 51:
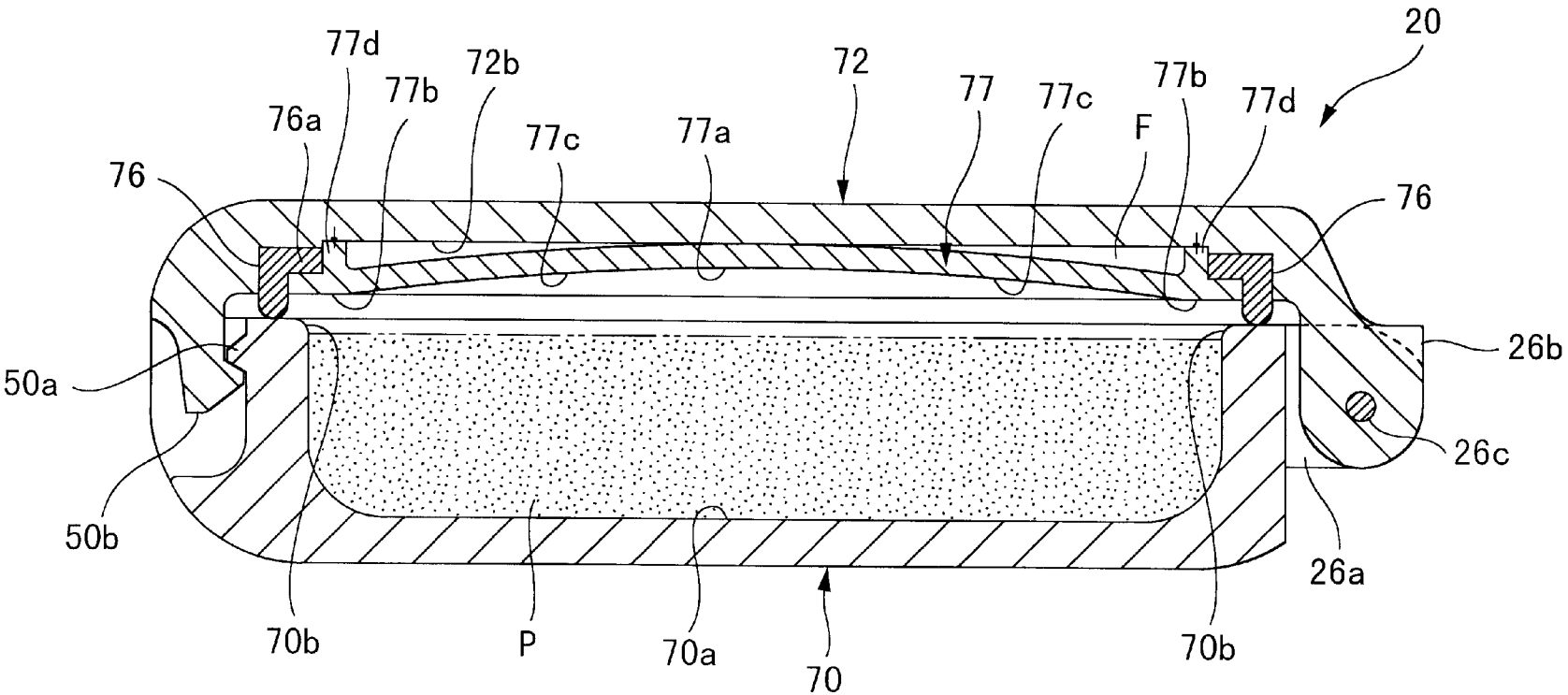
FIG. 51 is a modified version of the cosmetic case invention.

FIG. 51 presents a further embodiment in which refill case 20 incorporates a separate concave part installed to the inner surface of cover 72. In this embodiment, recess 72*b* is formed on inner surface 72*a* of cover 72, and sealing ring 76 and concave plate 77 are installed to recess 72*b*. Concave plate 77 is a concave disc form with a raised center section, positioned at the center of ceiling part 77*a*, and thereby establishes inclined surface 77*c* from the aforesaid ceiling part to plate perimeter 77*b*. Ring-shaped rib 77*e* is formed on plate perimeter 77*b* of concave plate 77.

Concave plate 77 is inserted against the inner perimeter of sealing ring 76 and attached to recess 72*b* on the lower surface of cover 72. Inner flange 76*a* is formed at the base of sealing ring 76. Rib 77*e*, which extends upward from concave plate 77, is secured to recess 72*b* formed in cover 72, thus pressing seal inner flange 76*a* against the inner periphery of the inner cover.

The previous embodiment of refill case 20 described a structure in which concave surface 74 was formed on inner surface 72*a* as an integral part of cover 72. As a result of this structure, the material thickness of cover 72 steadily increases in a radial direction extending from ceiling part 74*a* to perimeter 74*b*. Resultingly, a significantly large amount of material is required to form cover 72 at the perimeter 74*b* region, specifically in cases where concave surface 74 has a deep concave cross section, thus posing problems in regard to the fabrication process and resin-forming dies needed to manufacture cover 72. It thus becomes relatively difficult to form a concave surface 74 to a deep concave cross section using the aforesaid integral structure. If, however, the lower surface of cover 72 is formed as a separate component, the thickness of cover 72 has no relation to the inclination angle of its lower surface. Therefore, the lower surface can be made to a desirably large inclination to provide for an effective condensate droplet disposal mechanism within the cover.

As the contact area between the lower surface of cover 72 and concave plate 77 is relatively small, space F is formed between both structures, thus providing an insulating effect for the internal area of refill case 20 in regard to changes in external ambient temperature. The result of this effect is that condensation within refill case 20 is, to a certain extent, inhibited. Furthermore, an insulating material can be inserted within space F as a means of still further suppressing the condensation resulting from evaporated solvents.

Moreover, differing from the previous embodiments, the separate construction of concave plate 77 and cover 72 allows these components to be made from different materials. For example, a material for concave plate 77 can be selected not according to the appearance or decorative requirements of the cover, but according the insulation effect needed to suppress condensation within the case.

While the aforementioned embodiments have described the concave lower surface of cover 72 as a round shape, other shapes such as oblong, square, or rectangular shapes can effectively make use of the structures and mechanisms provided by the invention. While the aforementioned embodiments have shown the highest point of the concave surface as oriented in the center of the cover, said highest point can also be located at other areas within the cover. While the aforementioned embodiments have presented the inclined cover lower surface as a curve d concave plane, a straightly inclined lower surface such as an umbrella form, cone form, or other like formation may also be employed.

Figure 52:
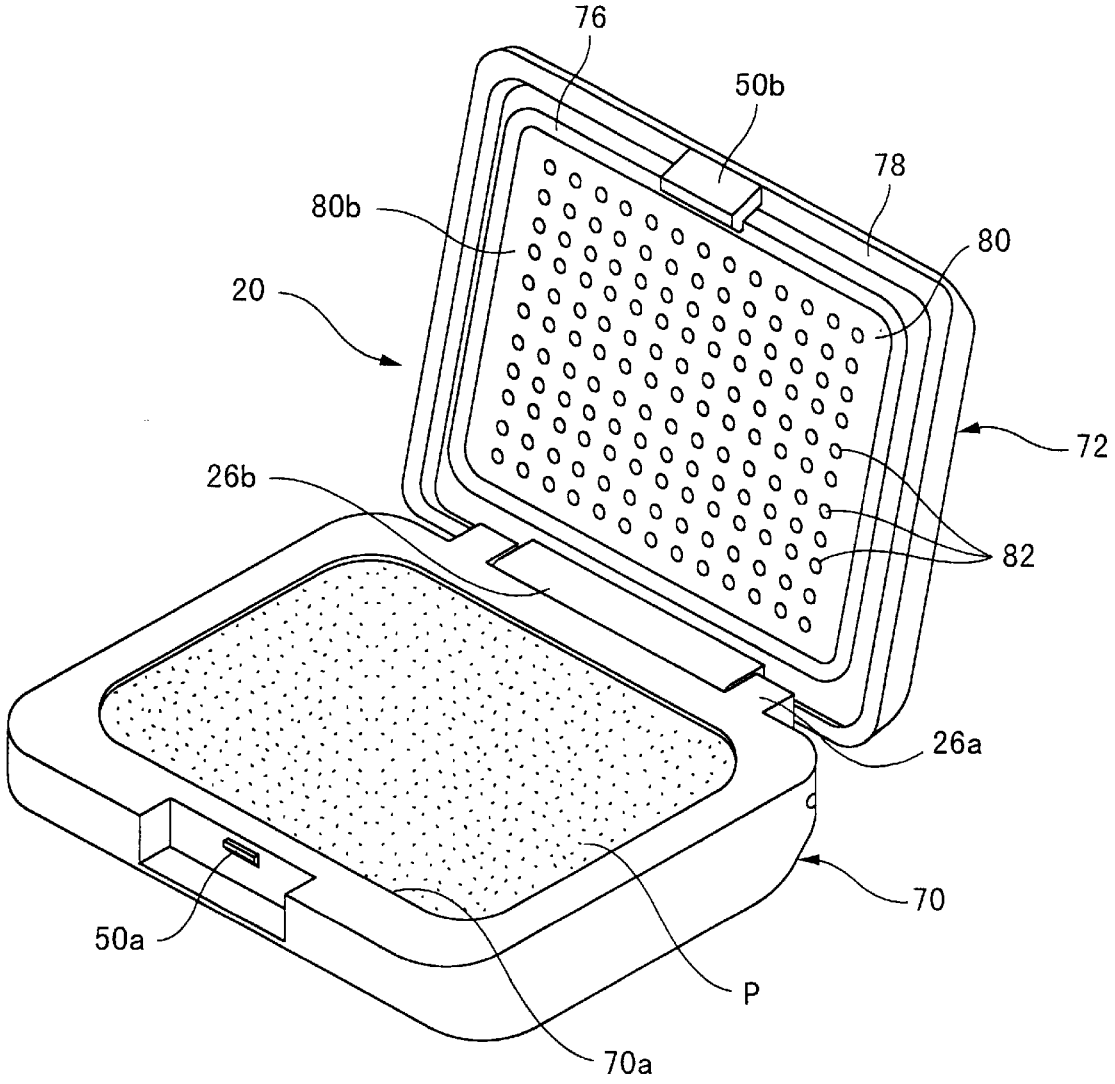
FIG. 52 is an oblique view of a further version of the cosmetic case invention.
Figure 53:
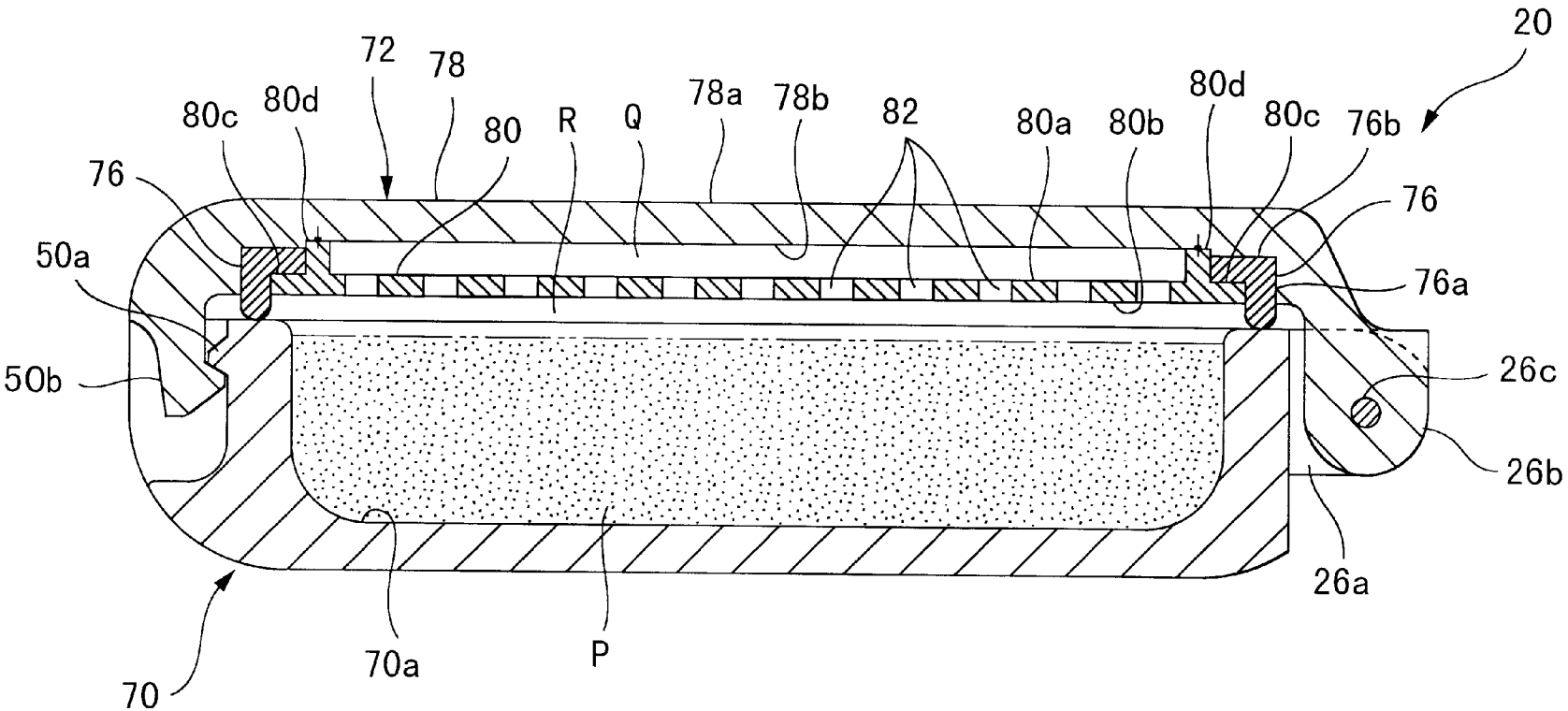
FIG. 53 is a lateral cross section of the FIG. 52 cosmetic case.

FIGS. 52 and 53 describe another embodiment of refill case 20 in which main case 70 incorporates cosmetic container 70*a* formed to approximate square shape in the center of refill case 20. Cover 72 is pivotably installed to the upper external surface of refill case 20, and is secured to refill case 20 by means of outer hinge part 26*b* and second latch piece 50*b*, said latch piece being of integral structure to external cover 78. When cover 72 is in a closed condition, external cover 78 is in contact with the upper surface of refill case 20, and inner cover plate 80 is oriented directly above cosmetic material P. Upper surface 78*a* of external cover 78 is the part of the refill case exposed to the environment. Condensation space Q is provided at lower surface 78*b* of external cover 78 and upper surface 80*a* of inner cover plate 80. Internal space R is provided between inner surface 80*b* of inner cover plate 80 and the surface of cosmetic material P.

A matrix pattern of multiple ventilation orifices 80*d* are formed within inner cover plate 80 as means of connecting condensation space Q and internal space R. Circular lip 80*d* is formed at peripheral part 80*c* of inner cover plate 80.

Sealing ring 76 is installed at the upper surface of inner cover plate 80 at peripheral part 80*c*. Sealing ring 76 is of compliant rubber or other elastic material construction and is structured so as to include ring upper perimeter 76*b* and ring flange 76*a*. Sealing ring 76 has a diametric dimension larger than that of cosmetic container 70*a*, and comes into pressure contact with refill case 20 when cover 72 is in a closed condition. Ring flange 76*a* is compressed by peripheral part 80*c* of inner cover plate 80. Therefore, sealing ring 76 can be secured to outer cover 72 by means of employing an ultra-high frequency welding or other process to join lip 80*d* of inner cover plate 80 to lower surface 78*b* of external cover 78.

The following discussion will deal with the capability of refill case 20 to prevent the fall of droplets formed on the inner cover surface through condensation as a result of the presence of evaporated solvents.

Fumes generated as a result of solvent evaporation within space R are not only present within space R, but will travel to condensation space Q through ventilation holes 82 provided in the inner cover. Therefore the solvent fumes are able to condense on lower surface 78*b* of external cover 78 as well as upper and lower surfaces 80*a* and 80*b* of inner cover plate 80. This structure provides three times the condensation surface area compared to that of a single surface cover.

Therefore, considered in terms of a specific volume of evaporable solvent existing within the cosmetic substance, the condensation propagation capability provided by lower surface 80*c* of inner cover plate 80 is reduced by two thirds as a result of lower surface 78*b* (on external cover 78) and upper surface 80*a* (on inner cover plate 80) existing within the same space. Moreover, condensation droplets forming within space Q are further prevented from dropping on cosmetic material P as a result of their collecting on surface 80*a* which is on top of inner cover plate 80. As a result of this structure, the fall. of condensation droplets onto cosmetic material P is not only, significantly reduced, but the excess formation of said droplets within a limited enclosed space is prevented.

As upper surface 78*a* of external cover 78 is exposed to the environment, the temperature of said surface will change in relation to external temperatures to a greater extent than inner cover plate 80, thus promoting the condensation of solvent droplets on lower surface 78*b*. Therefore, a major proportion of condensed solvent will collect within condensation space Q, and the condensation taking place within space R will be decreased with a resultant lesser chance of droplets falling onto the cosmetic material.

Figure 54:
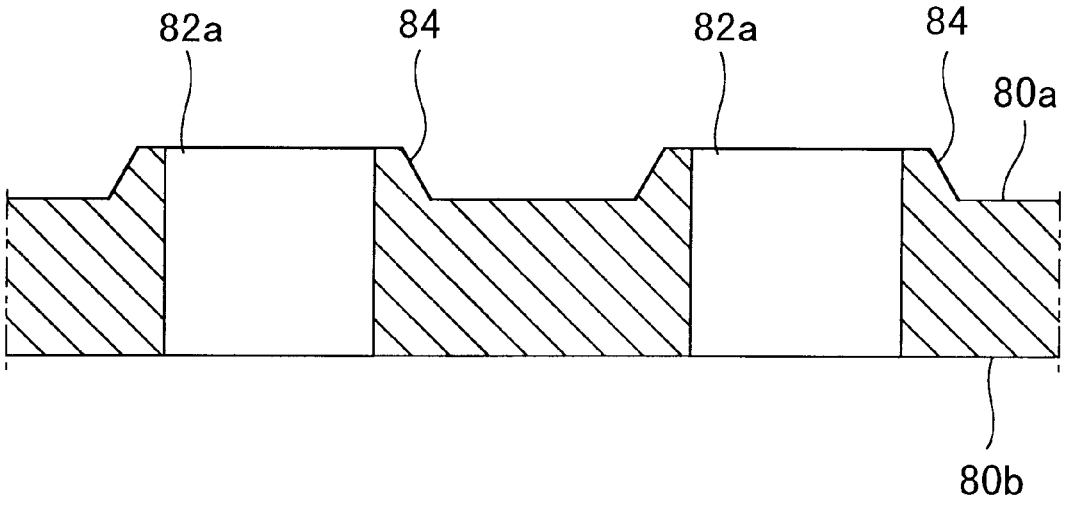
FIG. 54 is an enlarged cross section of the ventilation orifices which can be applied to the cosmetic case invention.
Figure 55:
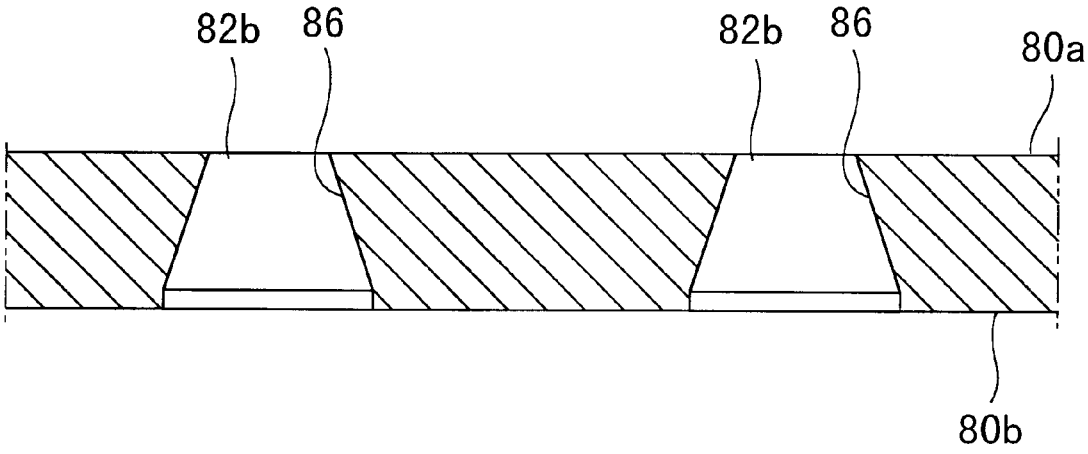
FIG. 55 is an enlarged cross section of a modification of the ventilation orifices shown in FIG. 54.

FIGS. 54 and 55 present further embodiments regarding the structure of the ventilation orifices. FIG. 54 illustrates lip 84 being formed as a raised step structure extending upward from the upper perimeter of orifice 82*a*. Lip 84 prevents condensation droplets formed on upper surface 80*a* (inner cover plate 80) from easily falling through the orifice and collecting on cosmetic material P.

FIG. 55 depicts a structure in which orifice 82*b* is formed as a tapered cone in cross section as resulting from the diameter of orifice wall 86 increasing steadily from upper surface 80*a* to bottom surface 80*b*. As the diameter of the orifice is smaller on upper surface 80*a*, condensation droplets accumulating on upper surface are prevented from easily falling through the orifice. As an additional structure to this mechanism, a drain channel can be formed within cover 72 as a means of guiding condensation droplets back to cosmetic material P at a desirable location.

Figure 56:
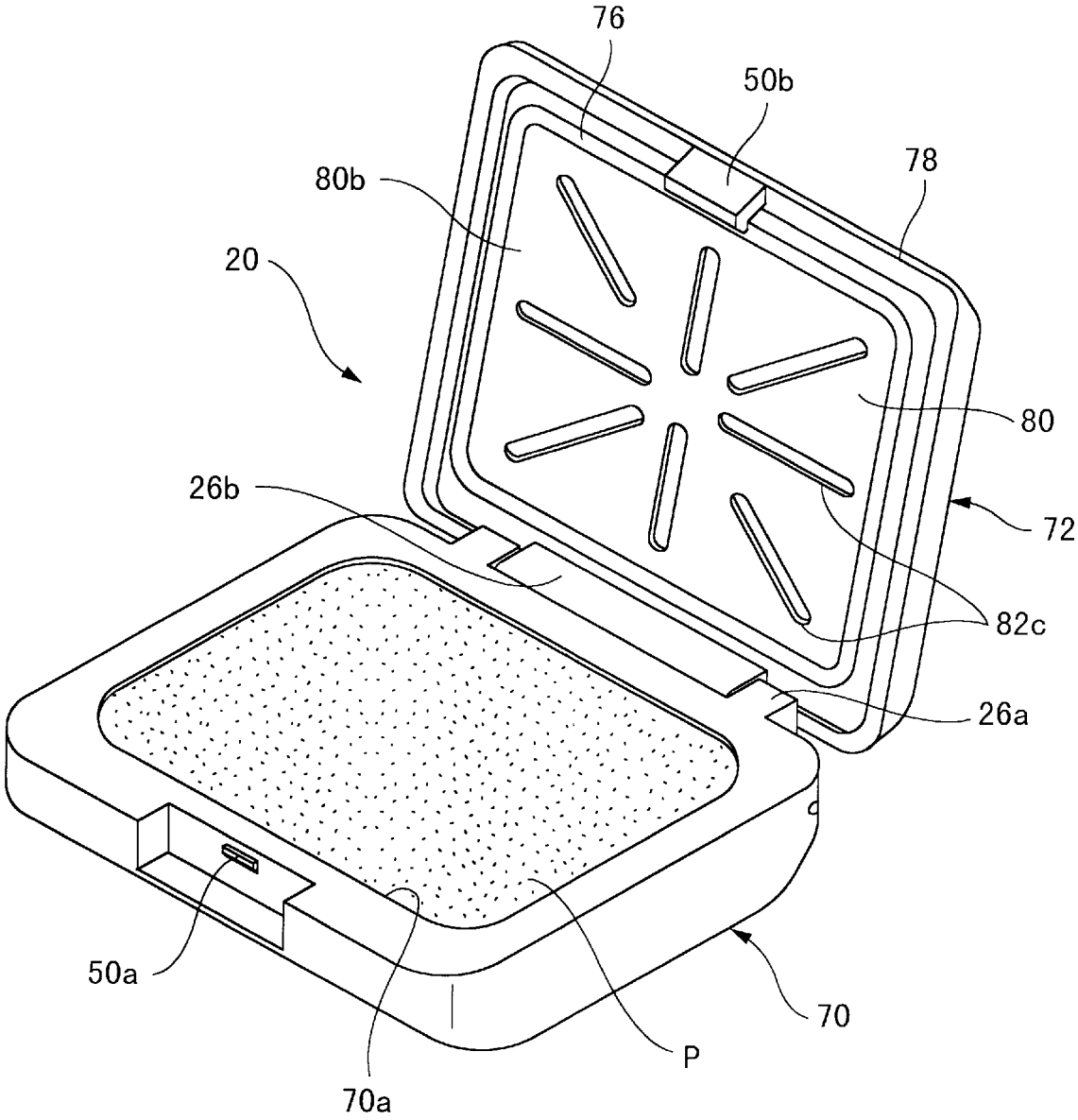
FIG. 56 is an oblique view of the cosmetic case invention showing a modification of the ventilation orifices.
Figure 57:
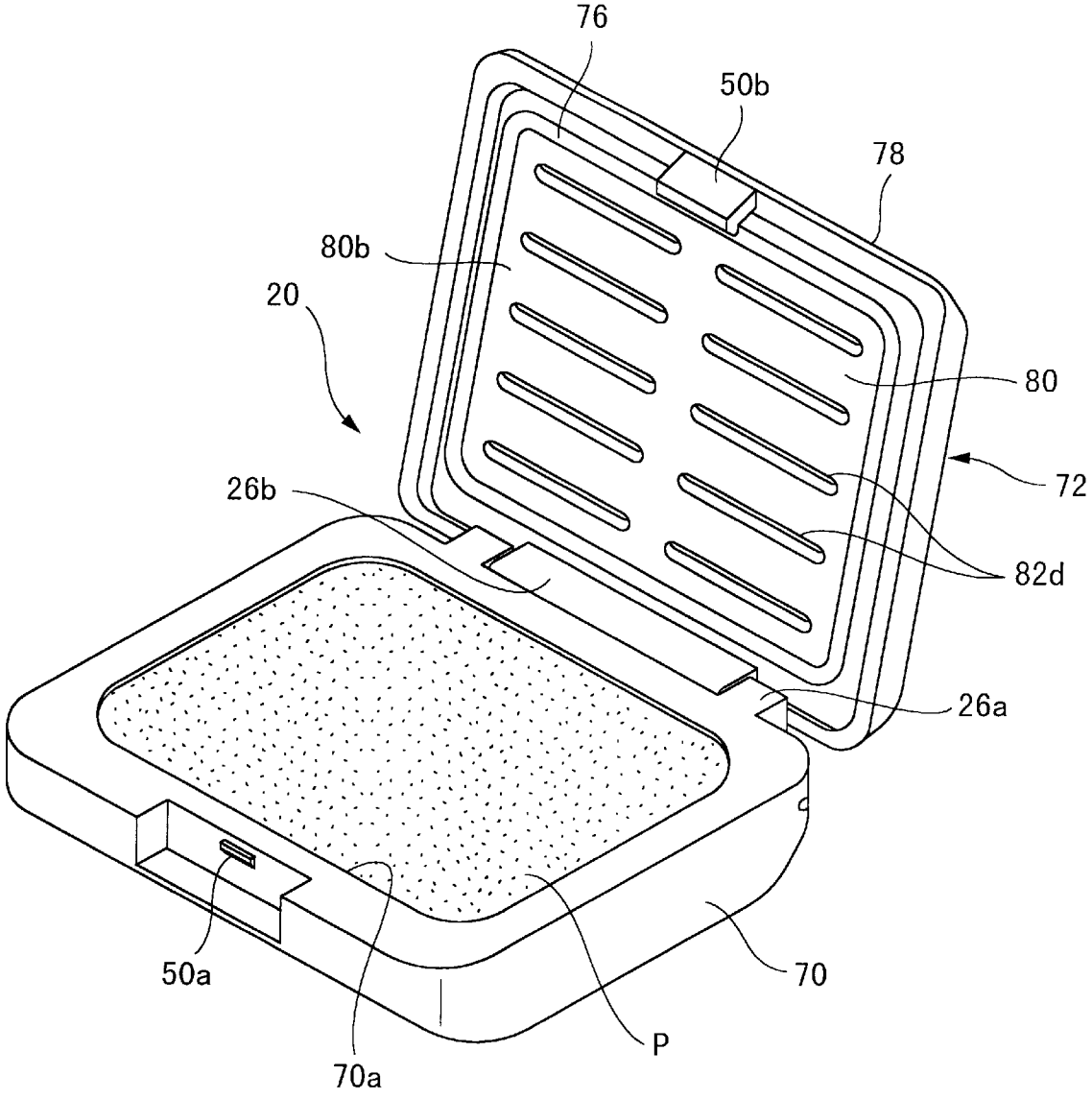
FIG. 57 is an oblique view of the cosmetic case invention showing a still further modification of the ventilation orifices.

FIGS. 56 and 57 present an additional embodiment of the ventilation orifices prescribed by the invention. In the FIG. 56 embodiment, ventilation orifices 82*c* are formed as multiple slits radially disposed so as to extend outward from the center of inner cover 80. In the FIG. 57 embodiment, multiple slits 82*d* are formed within inner cover 80 in parallel lines. As the aforementioned embodiments illustrate, the ventilation orifices employed within cover 72 can be formed in any number of shapes and disposed in any number of patterns and still provide the benefits set forth by the invention.

Figure 58:
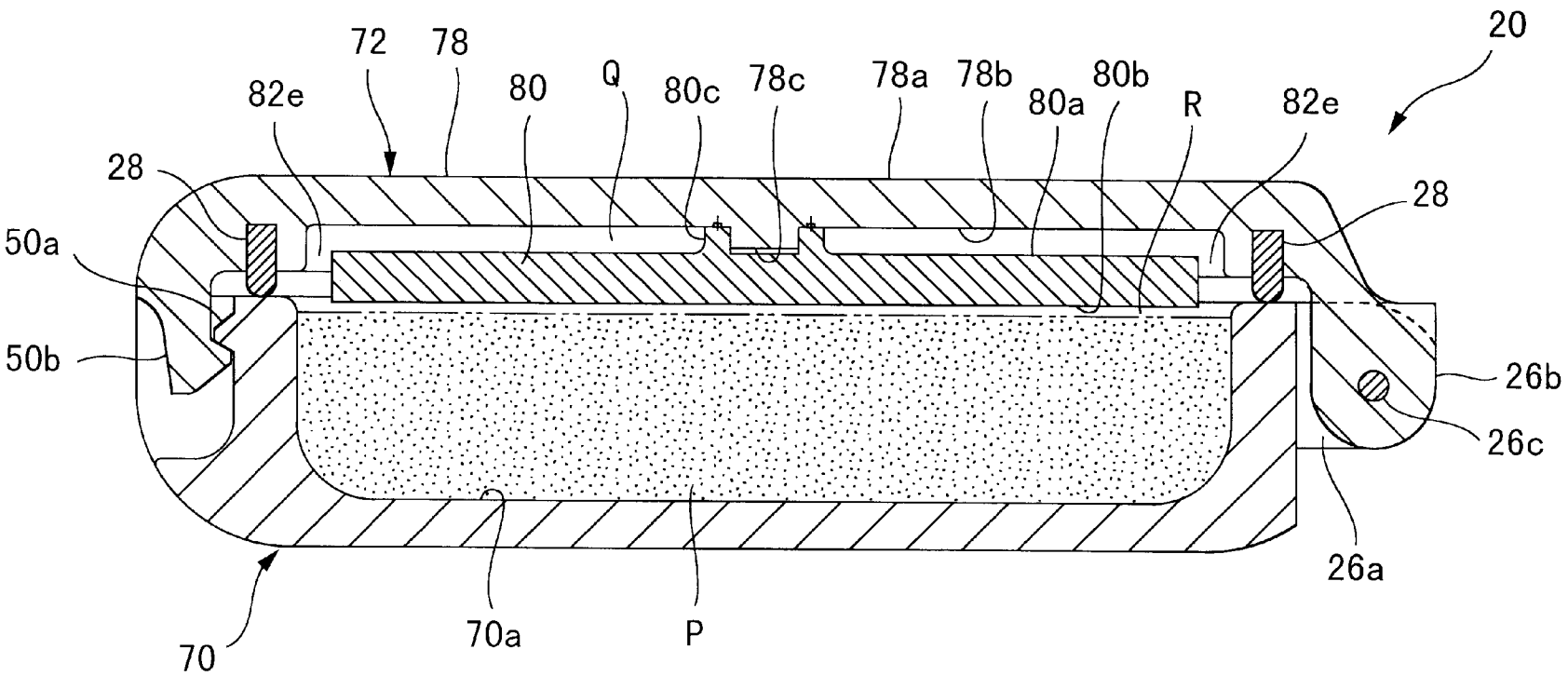
FIG. 58 is a lateral cross section of a modified version of the cosmetic case invention.

A second embodiment of the condensation droplet control mechanism prescribed by the invention is presented in FIG. 58 in which a structure is formed in the central region of inner cover plate 80 opposed to external cover 78. Cylindrical ridge 80*c* is formed in the center of upper surface 80*a* of inner cover plate 80, and is installed within protruding part 78*c* formed on lower surface 78*b* of external cover 78. Thus, cylindrical ridge 80*c* and protruding part 78*c* serve as means of attaching inner cover plate 80 to external cover 78. The height oft condensation space Q is therefore determined by the height of cylindrical ridge 80*c* or protruding part 78*c*. As a result of this attachment structure, ventilation orifice 82*e* can be formed as a space between the peripheral edge of inner cover plate 80 and external cover 78, and thus serves as means of connecting condensation space Q and space R.

Sealing ring 28 is secured to the inner periphery of external cover 78 beyond the peripheral edges of inner cover plate 80, and is formed to a diameter greater than that of cosmetic container 70*a*, thereby forming a pressure seal between cosmetic container 70*a* and cover 78 when cover 78 is closed, and thus effectively isolating space R and condensation space Q from the external environment.

As this type of structure establishes ventilation orifice 82*e* at the perimeter of inner cover plate 80, opening cover 72 will expose lower surface 80*b* as a continuous flat surface, and thus enhance the appearance of refill case 20 when in an open condition.

As compared to the previous embodiment, this embodiment forms a smaller attachment area between inner cover plate 80 and external cover 78, a characteristic which has the effect of decreasing the extent of temperature change of inner cover plate 80 in relation to the temperature change of external cover 78. As a result, the formation of condensation droplets on lower surface 80*b* (on inner cover plate 80) is inhibited, and there is less change of condensation droplets falling onto cosmetic material P.

Figure 59:
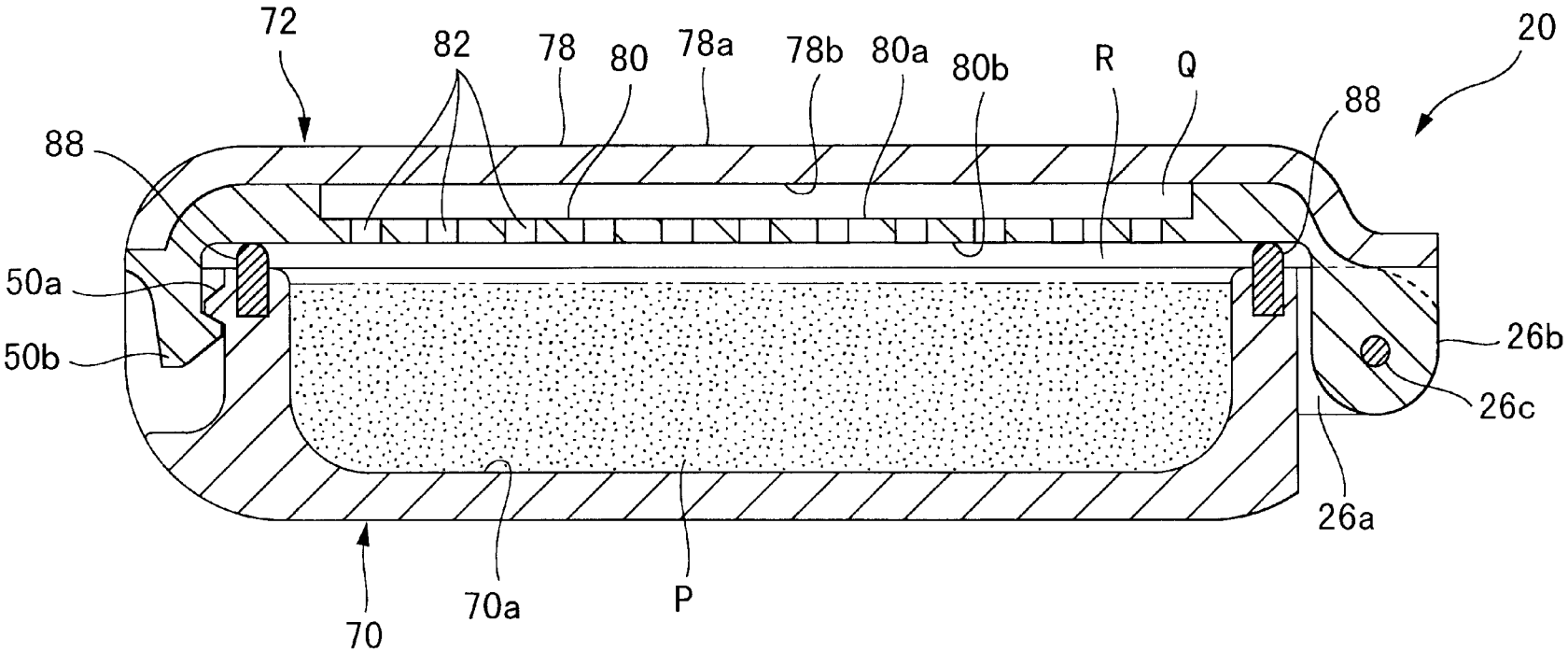
FIG. 59 is a lateral cross section of a further modified version of the cosmetic case invention.

FIG. 59 presents a third embodiment of the droplet prevention mechanism prescribed by the invention whereby the aforesaid inner cover plate is integrated to the refill case cover in a manner as to become an integral component of refill case 20. In this embodiment, external cover 78 forms a separate outer surface of the refill case, and second latch piece 50*b* and outer hinge part 26*b* are formed as integral components of inner cover plate 80. Upper surface 80*a* of inner cover plate 80 is recessed so as to create condensation space Q beneath lower surface 78*b* of external cover 78. Space R is formed between lower surface 80*b* of inner cover plate 80 and the surface of cosmetic material P. Multiple orifices 82 are formed in inner cover plate 80 as a means of connecting spaces R and Q.

Sealing ring 88 is secured within the outer periphery of cosmetic container 70*a*. Closing cover 72 will form a pressure seal between the upper edge of sealing ring 88 and lower surface of inner-cover plate 80, thus effective isolating space R and condensation space Q from the external environment.

Incorporating latch piece 50B and outer hinge part 26*b*, and their corresponding functions, as integral components of inner cover plate 80 allows external cover 78 to be installed to inner cover 80 as a separate and non-structural component of the refill case. Therefore, external cover 78 can be fabricated to a desirable external appearance before attachments to inner cover plate 80, and thus be employed as a separate decorative component. External cover 78 can be separately constructed from various materials and decorated in various ways, thus providing means to change the external appearance of the refill case without changing the underlying structure.

While the refill case embodiments presented here have been of approximate square shape, it is obvious that the refill case can also be formed to round, oblong, or other shapes without effecting the structures and mechanisms prescribed by the invention. While the refill case embodiments presented here have shown a cosmetic container directly fillable with a cosmetic material, a tray-type cosmetic material refill element can also be employed as means of placing a cosmetic material into the cosmetic container.

Figure 60:
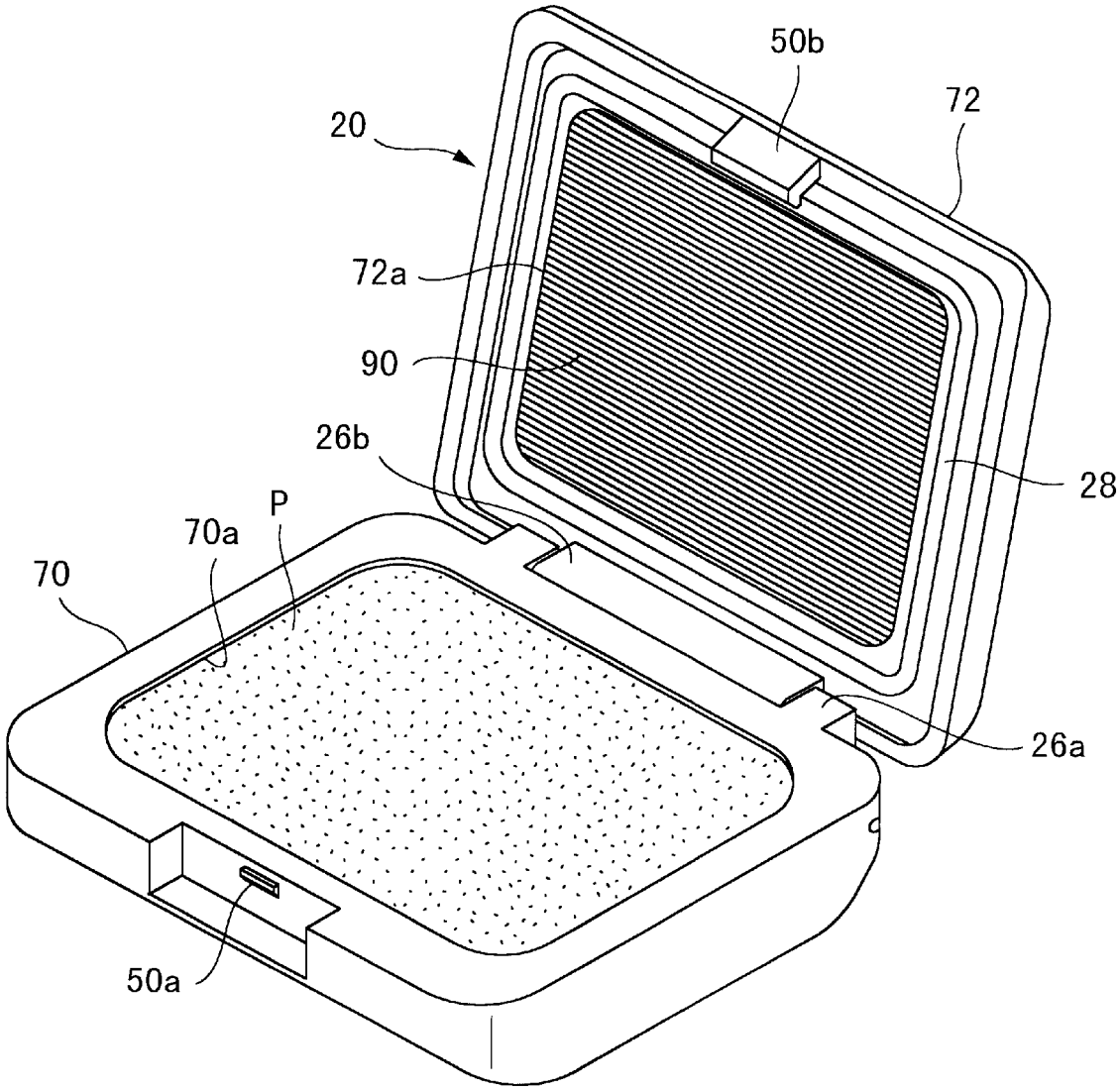
FIG. 60 is an oblique view of a still further modified version of the cosmetic case invention.
Figure 61:
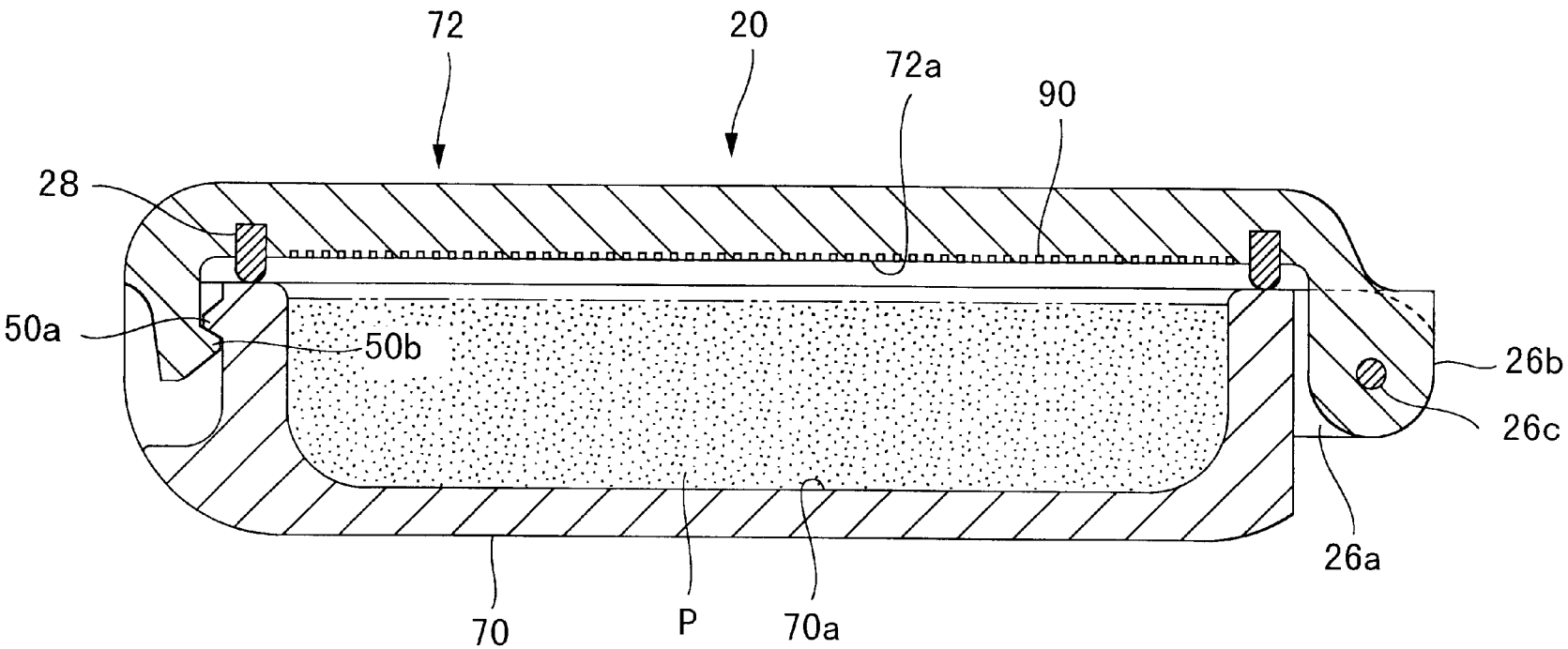
FIG. 61 is a lateral cross sectional view of the FIG. 60 cosmetic case.

FIGS. 60 and 61 present another embodiment of the refill case in which multiple groove lines 90 are formed on inner surface 72*a* of cover 72 within the perimeter of sealing ring 28. As shown in cross section in FIG. 61, groove lines 90 form square linear channels on inner surface 72*a*, are parallel. with hinge pin 26*c*, and cover the area directly above cosmetic material.

This structure is also capable of preventing condensation droplets on the inner surface of the cover from falling onto the cosmetic material beneath. As groove lines 90 provide for a larger surface area of inner surface 72*a* compared to a flat surface of the same dimensions, there is a lesser volume of potential condensate for each unit of surface area, a factor which inhibits the condensation of droplets on inner surface 72*a*.

Figure 62:
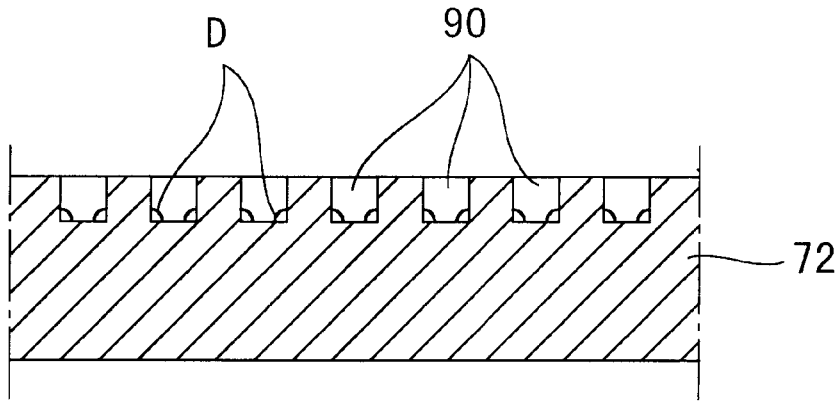
FIG. 62 is an enlarged cross section of the protruding and recessed lines preferred by the invention.

As shown in FIG. 62, solvent fumes condense into droplets D on surface 72*a*, and collect in the corners of groove lines 90 as a result of the liquid surface tension effect. As droplets D in groove lines 90 are prevented from joining with droplets in adjacent grooves, the formation of larger and heavier condensation droplets is inhibited, and the chances of droplets falling on the surface of the cosmetic material reduced. Moreover, as cover 72 stands vertically when the refill case is open, the horizontal orientation of grooves 90 prevents condensation droplets D from falling, and thus lessens the chances of the droplets from coming into contact with the hands of the person using the cosmetic case.

The closing action of cover 72 poses the risk of droplets D in grooves 90 moving in a manner as to connect with adjacent droplets to form larger and heavier droplets, and thus increasing their chances of falling from the peripheral edges of inner surface 72*a* onto the cosmetic material. To prevent this, inner surface 72*a* is made to a larger surface area than cosmetic container 70*a*. Any droplets that fall will land on the upper surface of main case 70 and adhere to the contact part of sealing ring 28 as a result of the liquid surface tension effect. This mechanism prevents droplets from moving to the surface area of cosmetic material P, and thus serves as another means of preventing condensation droplets from falling onto cosmetic material P.

Moreover, any cosmetic material adhering to inner surface 72*a* can be easily removed from grooves 90 by wiping with a cloth or tissue, thus maintaining the pleasing and desirable appearance of both cosmetic material P and inner surface 72*a*.

Figure 63:
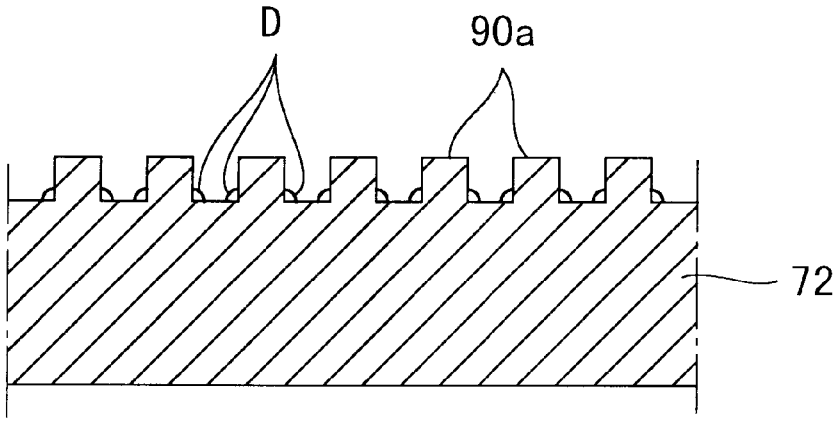
FIG. 63 shows a modified version of the protruding and recessed lines preferred by the invention.
Figure 64:
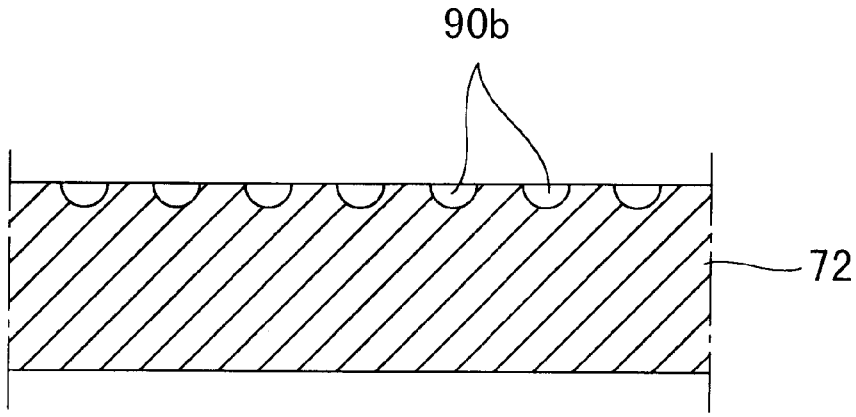
FIG. 64 shows a further modified version of the protruding and recessed lines preferred by the invention.
Figure 65:
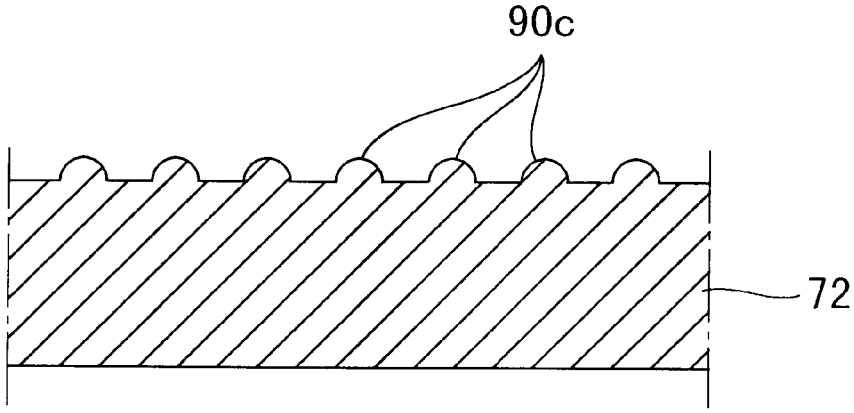
FIG. 65 shows a still further modified version of the protruding and recessed lines preferred by the invention.

While the FIG. 2 embodiment describes groove lines 90 formed on inner surface 72*a* as square in cross section, protruding square ridges 90*a* such as shown in FIG. 63 will provide the same effect. Moreover, round grooves 90*b* such as shown in FIG. 64, or round protruding ridges 90*c* such as shown in FIG. 65 will further provide the same effect. Employing round grooves or round ridges such as these eliminates the angular groove corners, and thus makes it easier to wipe the surface without catching the aforesaid cloth or tissue on the ridges.

Figure 66:
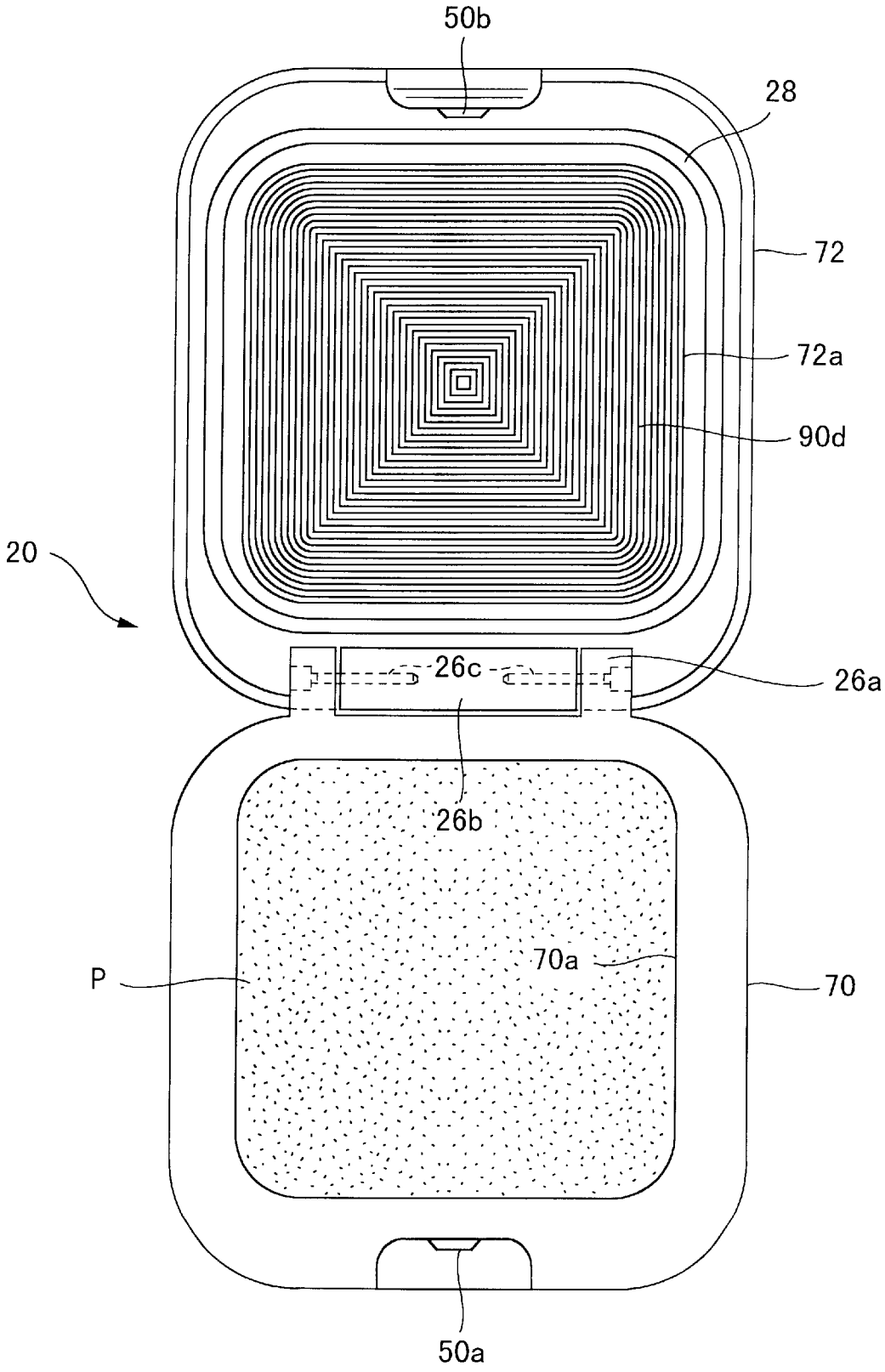
FIG. 66 is a plan view of a further modified version of the cosmetic case invention with the inner cover in an open condition.

FIG. 66 presents a further embodiment of the interior of refill case 20. While the previous embodiment provided for multiple grooves 90 as being oriented in a parallel line pattern on inner surface 72*a*, the FIG. 66 embodiment provides for groove lines 90*d* formed as multiply repeated concentric square shapes extending from the center of inner surface 72*a* and conforming to the shape of cover 72. In other words, the length of each groove is longer than the length of the adjacent inner groove positioned closer to the center of cover 72.

Groove lines 90*d* inhibit the formation of large droplets by preventing condensation droplets from passing over from one groove to the next, and thus repress the fall of condensation droplets on cosmetic material P. Moreover, the square shape of each groove eliminates open groove ends and therefore makes it difficult for droplets to fall, even when refill case 20 is in an inclined orientation.

Figure 67:
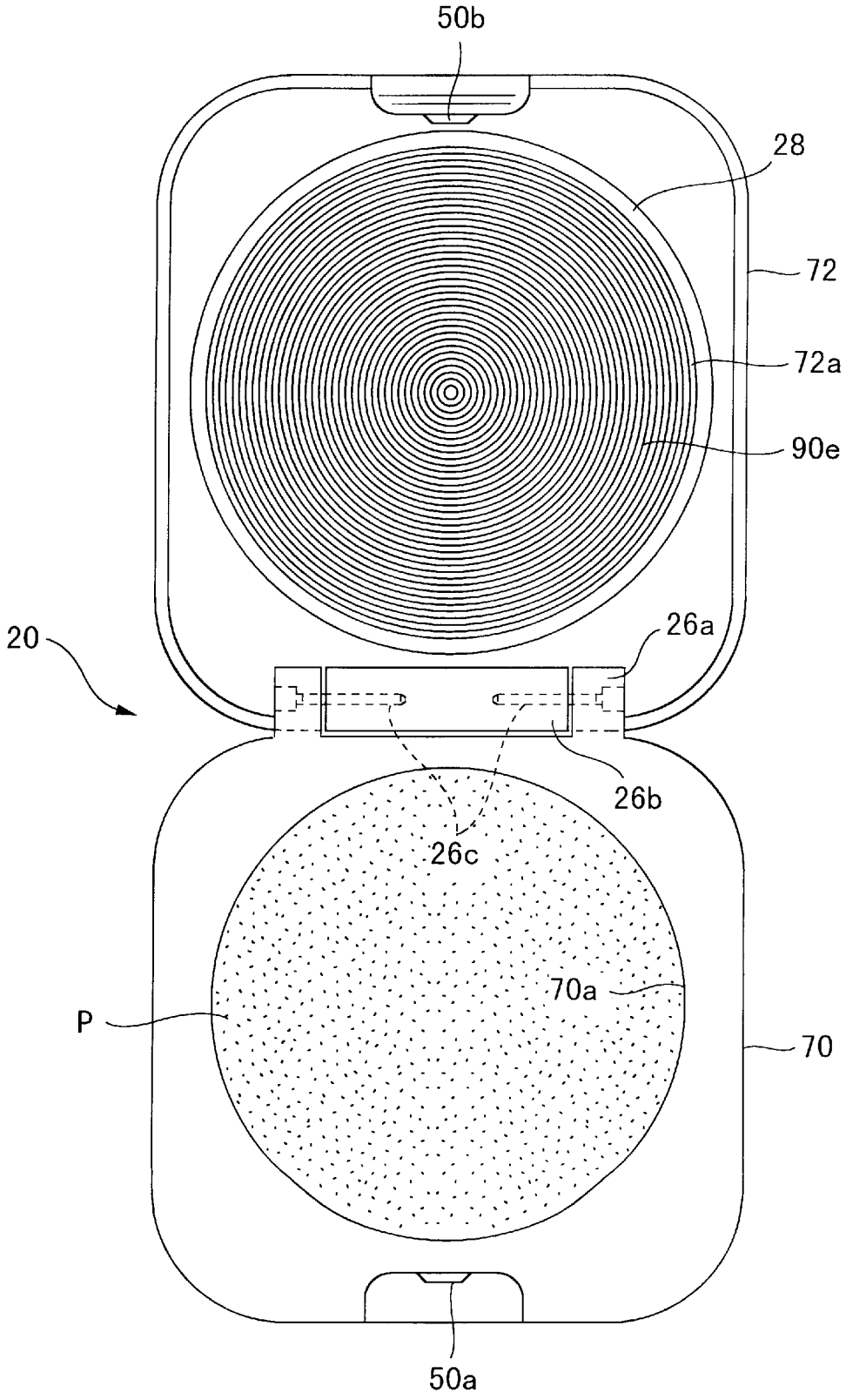
FIG. 67 is a plan view of a still further modified version of the cosmetic case invention with the inner cover in an open condition.

FIG. 67 describes a still further embodiment of refill case 20 in which cosmetic container 70*a* is formed as a round space within main case 70, and is filled with cosmetic material P. Sealing ring 28 is also of a round shape approximately corresponding to the size of the perimeter opening of cosmetic container 70*a*, an is installed to the inner surface of cover 72. When cover 72 is in a closed condition, sealing ring 28 comes into pressure contact with the upper surface of main case 70 around the perimeter of cosmetic container 70*a*.

Multiple concentric circular grooves 90*e* are formed on inner surface 72*a* within the area defined by sealing ring 28, and extend repeatedly in an outward direction from the center of inner surface 72*a*. This structure maintains the position of condensation droplets which may form on inner surface 72*a*, and prevents said droplets from becoming larger by joining with adjacent droplets. Thus, the fall of condensation droplets onto cosmetic material P is inhibited.

Furthermore, as circular grooves 90*e* have no ends from which condensation droplets can escape, the fall of droplets is further inhibited even when refill case 20 is inclined at an angle. Moreover, as grooves 90*e* are smooth and continuous, any cosmetic material P adhering to inner surface 72*a* may be easily removed.

Figure 68:
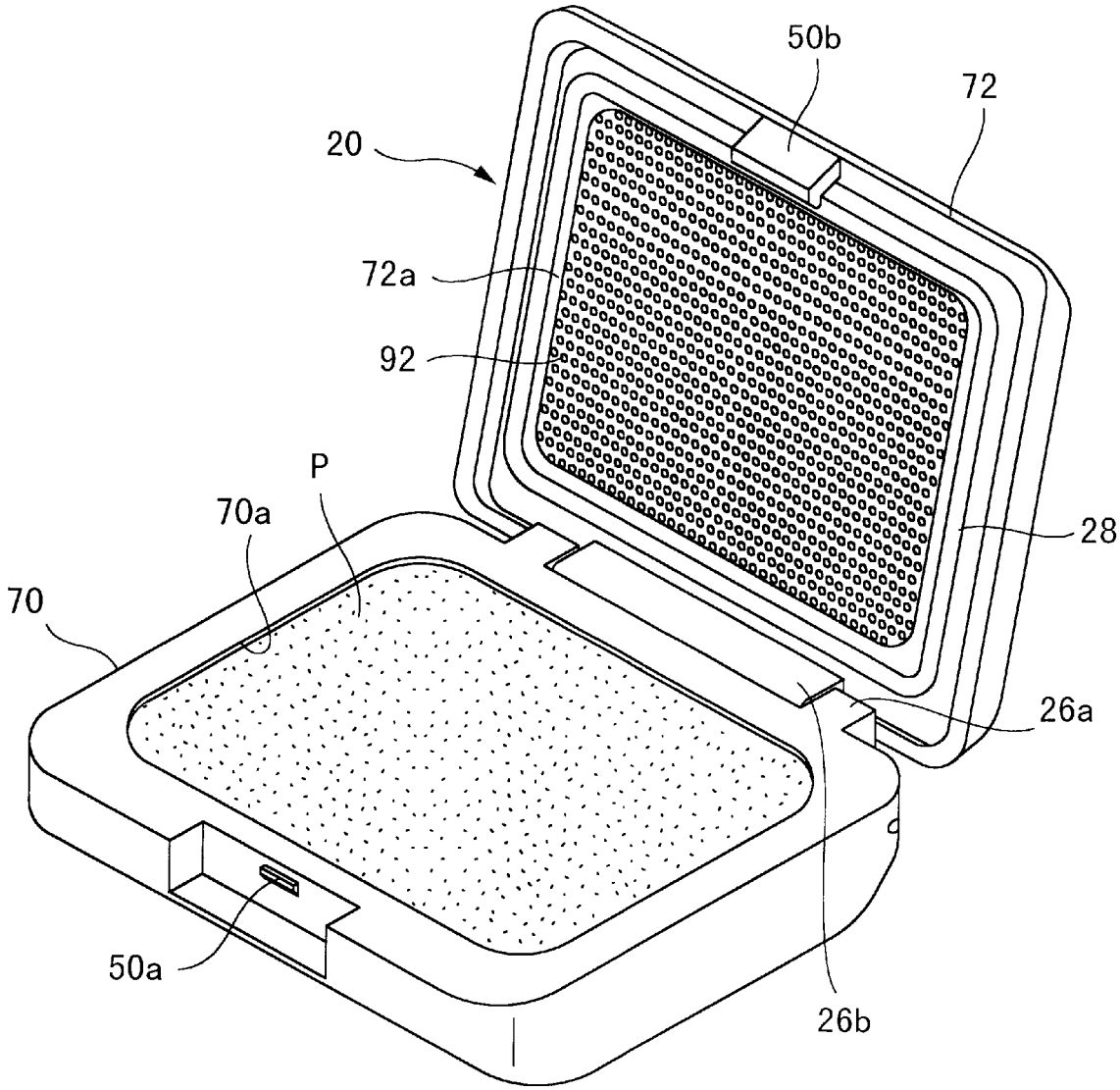
FIG. 68 is an oblique view of a still further modified version of the cosmetic case innovation with the inner cover in an open condition.
Figure 69:
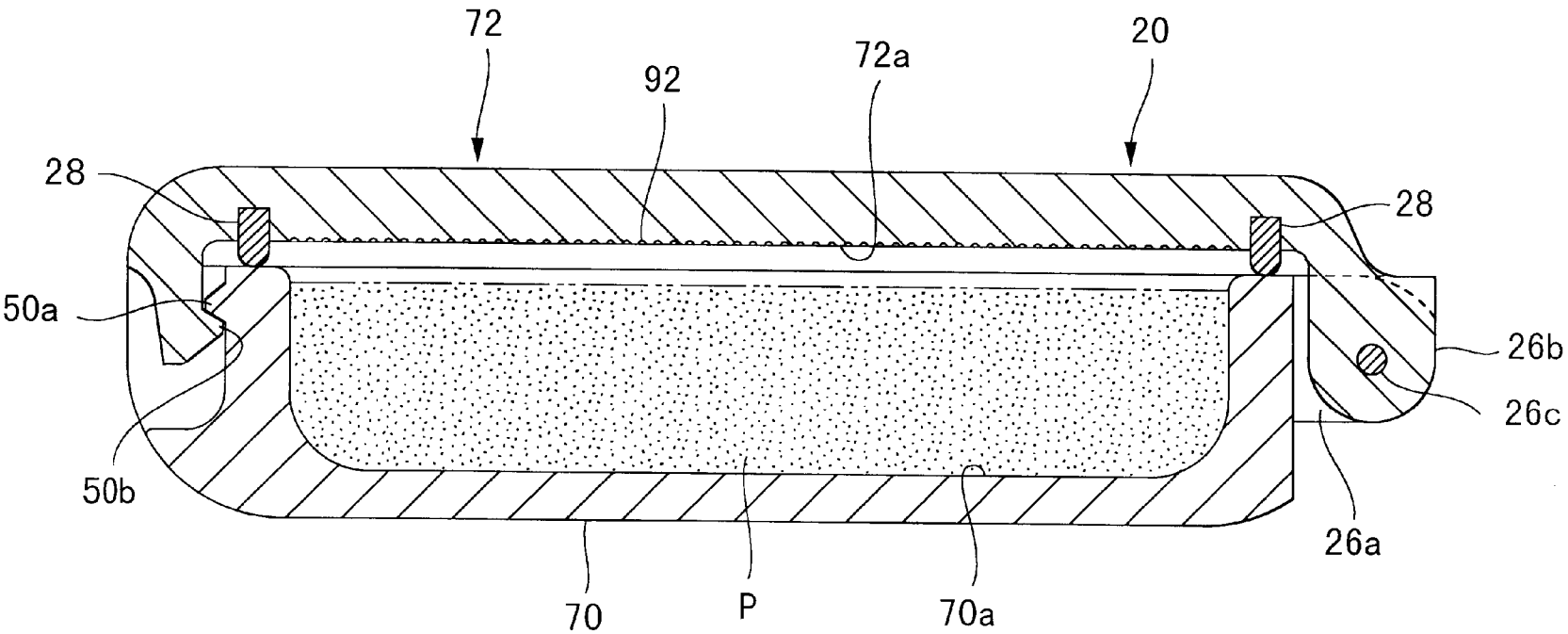
FIG. 69 is a lateral cross section of the cosmetic case shown in FIG. 68.

FIGS. 68 and 69 present an additional embodiment of refill case 20 in which multiple dimples 92 are formed within the perimeter of sealing ring 28 on inner surface 72*a* of cover 72. As FIG. 69 describes, dimples 92 are multiple hemispherical depressions formed in a matrix pattern on inner surface 72*a*. The area covered by dimples 92 is directly opposed to cosmetic material container 70*a* when cover 72 is closed.

This structure also provides means for preventing the fall of condensation droplets within refill case 20. Dimples 92 have the effect of increasing the surface area of inner surface 72*a* over an equivalent flat surface of the same external dimensions. As a result of this increased surface area, there is a lesser volume of potential condensate in relation to each unit of surface area. This effect inhibits the condensation of droplets on inner surface 72*a*.

Figure 70:
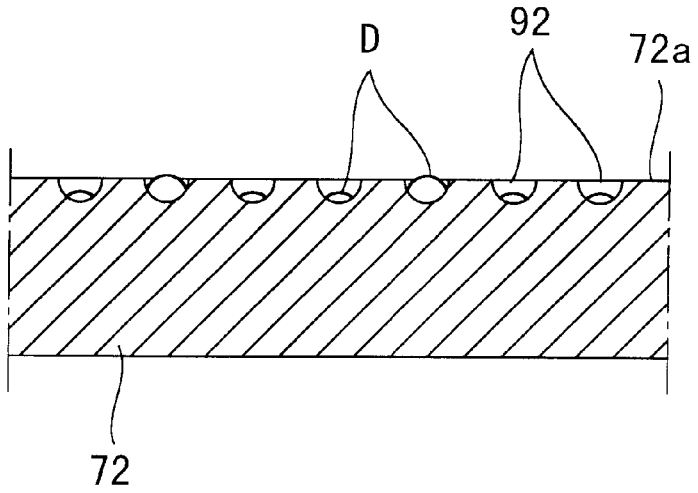
FIG. 70 is an enlarged cross sectional view of the dimple structure preferred by the invention.

As shown in FIG. 70, any condensation droplets D forming on inner surface 72*a* will be maintained within dimples 92 as a result of the liquid surface tension effect. As dimples 92 form hemispherical voids, a relatively large surface area on each droplet is able to form contact with the concave surface of the dimple, a characteristic which further inhibits the fall of the droplet from the dimple. Even in cases where droplets D become relatively large, the corresponding increase in surface area and the liquid surface tension effect operate to adhere the droplets within the dimples and prevent droplets from falling onto cosmetic material P.

Dimples 92 are mutually arranged so as to form specific gaps there between, the dimensions of which can be determined according to the predicted extent of evaporation of the solvent existing within cosmetic material P. The gaps can be made narrower, and the number of dimples increased, in cases where there is a large amount of solvent evaporation. Conversely, the gaps can also be made wider, and the number of dimples decreased, in cases where there is a smaller amount of solvent. evaporation.

While the embodiment presented here describes dimples 92, as arranged in a matrix pattern, said dimples can also be arranged in concentric circles, placed in radial alignment, or oriented in any number of possible patterns. Moreover, dimples 92 may be further varied in size as a means of providing a pleasing decorative pattern on inner surface 72*a*.

Moreover, dimples 92 may be formed as integral depressions within inner surface 72*a*, or may be formed on a separate plate which can be installed to inner surface 72*a*.

Figure 71:
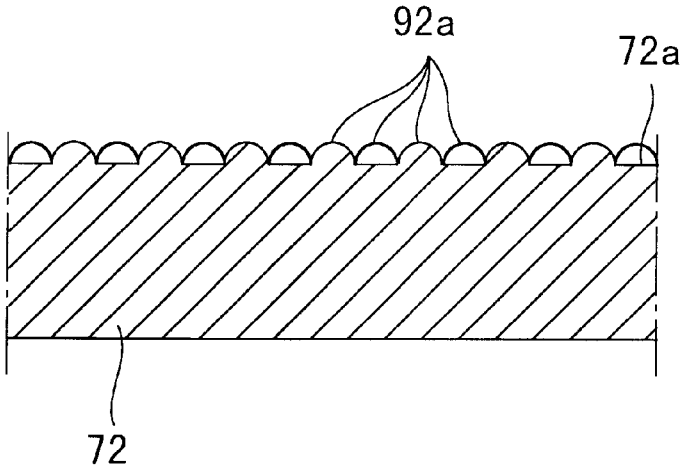
FIG. 71 is an enlarged cross sectional view of the hemispherical protrusions preferred by the invention.

FIG. 71 presents an additional embodiment of the dimple structure in which multiple hemispherical ridges 92*a* are formed on inner surface 72*a* as means of increasing the surface area, thereby reducing the amount of solvent capable of condensing on a specific unit of surface area and thus inhibiting the formation of condensation droplets.

Furthermore, in this embodiment of inner surface 72*a*, flat angular corners are not formed in the depressions between hemispherical ridges 92*a*. As a result, any adhered cosmetic material may be easily removed with a cloth, tissue, or other cleaning implement without said cloth, tissue, or other cleaning implement catching on inner surface 72*a*, and thus the structure provides for an easy means of removing any adhered cosmetic material or condensation droplets from inner surface 72*a*.

What is the claimed is:

1. A cosmetic case comprising a container body including a cosmetic material holding part therein, a container cover part attached to said container body, said container cover part being capable of exposing or covering said cosmetic material holding part, a latch installed between said container cover part and said container body, said latch being capable of joining or releasing said container cover part to or from said container body, and a sealing mechanism installed between said container body and said container cover part, for sealing said cosmetic material holding part, at a position encompassing said cosmetic material holding part, said sealing mechanism comprising:

a sealing ring encompassing said cosmetic material holding part, said sealing ring being installed either on said container cover part or said container body, a ring-shaped ridge formed either on said container body or said container cover part at a position so as to form a pressure seal when in contact with said sealing ring, and a sealing abrasion mechanism in which said sealing ring and said ring-shaped ridge have respective abrasion surfaces opposite to each other defined by inner and outer diameters thereof in a radial direction of said cosmetic material holding part, are established at appropriate dimensions so as to come into mutual sliding contact for a purpose of removing cosmetic material from a sealing surface established between said ring-shaped ridge and said sealing ring, when said container cover part is closed, so as to generate a mutually abrasive rubbing movement, wherein said sealing surface is positioned at a point above said cosmetic material holding part.

2. A cosmetic case as set forth in claim 1, wherein said abrasion surface on either said ring-shaped ridge or said sealing ring is established as an inclined surface.

3. A cosmetic case as set forth in claim 1, wherein said sealing ring can be elastically deformed in a radial direction.

4. A cosmetic case as set forth in claim 3, wherein an elastic deformation means is provided between said sealing ring and said container body, or between said sealing ring and said container cover part, as means for elastically deforming said sealing ring in a radial direction.

5. A cosmetic case as set forth in claim 1, wherein a channel is provided either on said container body or said container cover part at an outer periphery of said sealing ring, and a sealing ring securing part is installed either to said container body or said container cover part as means for securing said sealing ring within said channel.

6. A cosmetic case as set forth in claim 1, wherein a compression ridge is installed either to said container body or said container cover part as means for compressing either an upper part or a lower part of said sealing ring.

7. A cosmetic case as set forth in claim 1, wherein a radially protruding elastic part is formed on an outer perimeter of said sealing ring, and the inner perimeter of said ring-shaped ridge is formed to a smaller diameter than said radially protruding elastic part so as to form a pressure seal at the outer perimeter of said protruding elastic part, during the time when said container cover part is closing, by simultaneously abrading and compressing said protruding elastic part.

8. A cosmetic case as set forth in claim 7, wherein a projecting part is formed between an extremity of said sealing ring and said container cover part or said container body, whichever component having said ring-shaped ridge formed thereon, as means for applying pressure to said sealing ring by radially deforming said protruding elastic part.

9. A cosmetic case, comprising a container body including a cosmetic material holding part therein, a container cover part attached to said container body, said container cover part being capable of exposing or covering said cosmetic material holding part, a latch installed between said container cover part and said container body, said latch being capable of joining or releasing said container cover part to or from said container body, a sealing mechanism installed between said container body and said container cover part, for sealing said cosmetic material holding part, at a position encompassing said cosmetic material holding part, said sealing mechanism comprising:

a sealing ring encompassing said cosmetic material holding part, said sealing ring being installed either on said container cover part or said container body, a ring-shaped ridge formed either on said container body or said container cover part at a position so as to form a pressure seal when in contact with said sealing ring, and a sealing abrasion mechanism in which said sealing ring and said ring-shaped ridge have respective abrasion surfaces opposite to each other defined by inner and outer diameters thereof in a radial direction of said cosmetic material holding part, so as to come into mutual sliding contact for a purpose of removing cosmetic material from a sealing surface established between said ring-shaped ridge and said sealing ring, when said container cover part is being closed, in a manner as to generate a mutually abrasive rubbing movement, wherein said sealing surface is positioned at a point above said cosmetic material holding part.

10. A cosmetic case as set forth in claim 9, wherein said abrasion surface on either said ring-shaped ridge or said sealing ring is established as an inclined surface.

11. A cosmetic case as set forth in claim 9, wherein said sealing ring can be elastically deformed in a radial direction.

12. A cosmetic case as set forth in claim 11, wherein an elastic deformation means is provided between said sealing ring and said container body, or between said sealing ring and said container cover part, as means for elastically deforming said sealing ring in a radial direction.

13. A cosmetic case as set forth in claim 9, wherein a channel is provided either on said container body or said container cover part at an outer periphery of said sealing ring, and a sealing ring securing part is installed either to said container body or said container cover part as means for securing said sealing ring within said channel.

14. A cosmetic case as set forth in claim 9, wherein a compression ridge is installed either to said container body or said container cover part as means for compressing either an upper part or a lower part of said sealing ring.

15. A cosmetic case as set forth in claim 9, wherein a radially protruding elastic part is formed on an outer perimeter of said sealing ring, and an inner perimeter of said ring-shaped ridge is formed to a smaller diameter than said radially protruding elastic part so as to form a pressure seal at an outer perimeter of said protruding elastic part, during the time when said container cover part is closing, by simultaneously abrading and compressing said protruding elastic part.

16. A cosmetic case as set forth in claim 15, wherein a projecting part is formed between an extremity of said sealing ring and said container cover part or said container body, whichever component having said ring-shaped ridge formed thereon, as means for applying pressure to said sealing ring by radially deforming said protruding elastic part.

* * * * *